US012473910B2

(12) United States Patent
Foster et al.

(10) Patent No.: US 12,473,910 B2
(45) Date of Patent: Nov. 18, 2025

(54) FRACTURING PUMP ARRANGEMENT USING A PLUNGER WITH AN INTERNAL FLUID PASSAGE

(71) Applicant: Kerr Machine Co., Sulphur, OK (US)

(72) Inventors: Kelcy Jake Foster, Sulphur, OK (US); Christopher Todd Barnett, Stratford, OK (US); Micheal Cole Thomas, Azle, TX (US); John Keith, Ardmore, OK (US); Nicholas Son, Davis, OK (US)

(73) Assignee: Kerr Machine Co., Sulphur, OK (US)

( * ) Notice: Subject to any disclaimer, the term of this patent is extended or adjusted under 35 U.S.C. 154(b) by 0 days.

(21) Appl. No.: 19/078,792

(22) Filed: Mar. 13, 2025

(65) Prior Publication Data

US 2025/0290505 A1 Sep. 18, 2025

Related U.S. Application Data

(60) Provisional application No. 63/574,498, filed on Apr. 4, 2024, provisional application No. 63/571,174, filed on Mar. 28, 2024, provisional application No. 63/569,201, filed on Mar. 24, 2024, provisional application No. 63/565,378, filed on Mar. 14, 2024.

(51) Int. Cl.

| | |
|---|---|
| ***F04B 53/12*** | (2006.01) |
| ***F04B 53/16*** | (2006.01) |
| *E21B 43/26* | (2006.01) |

(52) U.S. Cl.

CPC ..... *F04B 53/125* (2013.01); *F04B 53/129* (2013.01); *F04B 53/164* (2013.01); *F04B 53/166* (2013.01); *E21B 43/2607* (2020.05)

(58) Field of Classification Search

CPC ..... F04B 53/12; F04B 53/125; F04B 53/126; F04B 53/129; F04B 53/164; F04B 53/166; F04B 53/168; F04B 53/22

See application file for complete search history.

(56) References Cited

U.S. PATENT DOCUMENTS

| | | | |
|---|---|---|---|
| 1,662,725 | A | 3/1928 | Toney |
| 1,836,498 | A | 12/1931 | Gustav |

(Continued)

FOREIGN PATENT DOCUMENTS

| | | | |
|---|---|---|---|
| CN | 104179676 | A | 12/2014 |
| CN | 207974953 | U | 10/2018 |

(Continued)

*Primary Examiner* — Michael Leslie

(74) *Attorney, Agent, or Firm* — Tomlinson McKinstry, P.C.

(57) ABSTRACT

A fluid end made of a housing and a plunger reciprocating therein. The plunger has a hollow bore formed therein, and a valve assembly situated on one end of the plunger. The plunger may have a sleeve situated within the bore that aids in the installation of the valve assembly. The plunger may have a second bore extending perpendicularly from the hollow bore. The first bore may be connected to an attachment piece which connects to a conduit. The conduit may then be connected to a manifold which is configured to provide a fluid to the plunger's bore. The housing may be made of a static section and a plurality of dynamic sections. The dynamic sections may thread into the housing. The static section may be made of two pieces to aid with installation of a dynamic seal.

20 Claims, 70 Drawing Sheets

(56) References Cited

U.S. PATENT DOCUMENTS

| | | | |
|---|---|---|---|
| 2,495,880 | A | 1/1950 | Volpin |
| 2,545,506 | A | 3/1951 | Walsh |
| 2,567,496 | A | 9/1951 | Pittenger |
| 2,898,858 | A | 8/1959 | Fisher |
| 2,957,422 | A | 10/1960 | Loeber |
| 3,005,412 | A | 10/1961 | Camp |
| 3,053,500 | A | 9/1962 | Atkinson |
| 3,062,198 | A | 11/1962 | Richardson |
| 3,301,197 | A | 1/1967 | Dodson et al. |
| 3,474,808 | A | 10/1969 | Elliott |
| 3,558,244 | A | 1/1971 | Uchiyama |
| 3,809,508 | A | 5/1974 | Uchiyama |
| 3,887,305 | A | 6/1975 | Ito |
| 4,518,329 | A | 5/1985 | Weaver |
| 4,520,837 | A | 6/1985 | Cole et al. |
| 4,527,961 | A | 7/1985 | Redwine |
| 4,915,602 | A | 4/1990 | Tschopp |
| 4,948,349 | A | 8/1990 | Koiwa |
| 5,061,159 | A | 10/1991 | Pryor |
| 5,073,096 | A | 12/1991 | King et al. |
| 5,088,521 | A | 2/1992 | Johnson |
| 5,207,242 | A | 5/1993 | Daghe et al. |
| 5,226,445 | A | 7/1993 | Surjaatmadja |
| 6,382,940 | B1 | 5/2002 | Blume |
| 6,910,871 | B1 | 6/2005 | Blume |
| 7,168,440 | B1 | 1/2007 | Blume |
| 7,296,591 | B2 | 11/2007 | Moe et al. |
| 7,513,483 | B1 | 4/2009 | Blume |
| 7,513,759 | B1 | 4/2009 | Blume |
| 7,591,450 | B1 | 9/2009 | Blume |
| 8,141,849 | B1 | 3/2012 | Blume |
| 8,317,498 | B2 | 11/2012 | Gambier et al. |
| 8,590,614 | B2 | 11/2013 | Surjaatmadja et al. |
| 9,291,274 | B1 | 3/2016 | Blume |
| 9,371,919 | B2 | 6/2016 | Forrest et al. |
| 9,416,887 | B2 | 8/2016 | Blume |
| 9,435,454 | B2 | 9/2016 | Blume |
| 9,470,226 | B2 | 10/2016 | Johnson |
| 9,631,739 | B2 | 4/2017 | Belshan et al. |
| 9,732,746 | B2 | 8/2017 | Chandrasekaran et al. |
| 9,822,894 | B2 | 11/2017 | Bayyouk et al. |
| 10,240,597 | B2 | 3/2019 | Bayyouk et al. |
| 10,711,778 | B2 | 7/2020 | Buckley |
| 10,808,851 | B1 * | 10/2020 | Surjaatmadja ..... E21B 41/00 |
| 11,009,016 | B2 | 5/2021 | Davids |
| 11,105,327 | B2 | 8/2021 | Hurst et al. |
| 11,280,326 | B2 * | 3/2022 | Hurst ..... F04B 15/02 |
| 11,578,710 | B2 * | 2/2023 | Nowell ..... F04B 15/02 |
| 11,592,011 | B2 | 2/2023 | Nowell et al. |
| 11,952,990 | B2 * | 4/2024 | Nowell ..... F04B 53/12 |
| 12,338,813 | B2 * | 6/2025 | Thomas ..... F04B 53/08 |
| 12,352,356 | B2 * | 7/2025 | Foster ..... F16J 15/185 |
| 2006/0045782 | A1 | 3/2006 | Kretzinger et al. |
| 2007/0224061 | A1 | 9/2007 | Stanton |
| 2008/0279705 | A1 | 11/2008 | Wago et al. |
| 2011/0079302 | A1 | 4/2011 | Hawes |
| 2011/0189040 | A1 | 8/2011 | Vicars |
| 2011/0206546 | A1 | 8/2011 | Vicars |
| 2012/0187321 | A1 | 7/2012 | Small |
| 2013/0020521 | A1 | 1/2013 | Byrne |
| 2013/0045123 | A1 | 2/2013 | Roman et al. |
| 2013/0202458 | A1 | 8/2013 | Byrne |
| 2014/0127058 | A1 | 5/2014 | Buckley |
| 2014/0127062 | A1 | 5/2014 | Buckley et al. |
| 2015/0144826 | A1 | 5/2015 | Bayyouk et al. |
| 2015/0219096 | A1 | 8/2015 | Jain et al. |
| 2016/0090980 | A1 | 3/2016 | Howard et al. |
| 2016/0102537 | A1 | 4/2016 | Lopez |
| 2016/0160848 | A1 | 6/2016 | Toppings et al. |
| 2016/0281699 | A1 | 9/2016 | Gnessin |
| 2017/0002947 | A1 | 1/2017 | Bayyouk et al. |
| 2017/0089470 | A1 | 3/2017 | Filipow et al. |
| 2019/0011051 | A1 | 1/2019 | Yeung |
| 2019/0040966 | A1 | 2/2019 | Myers |
| 2019/0063427 | A1 | 2/2019 | Nowell et al. |
| 2019/0120389 | A1 | 4/2019 | Foster et al. |
| 2019/0145391 | A1 | 5/2019 | Davids |
| 2019/0368619 | A1 | 12/2019 | Barnett et al. |
| 2020/0232455 | A1 | 7/2020 | Blume |
| 2024/0068455 | A1 | 2/2024 | Nowell et al. |

FOREIGN PATENT DOCUMENTS

| | | | |
|---|---|---|---|
| GB | 190629137 | A | 12/1907 |
| GB | 408778 | A | 4/1934 |
| GB | 633661 | A | 7/1947 |
| GB | 728781 | A | 4/1955 |
| JP | 06167277 | A | 7/1993 |

* cited by examiner

FRACTURING PUMP ARRANGEMENT USING A PLUNGER WITH AN INTERNAL FLUID PASSAGE

SUMMARY

In certain embodiments, the present disclosure is directed towards a fluid end comprising a first section, a plurality of second sections, and a plurality of reciprocating plungers. The first section comprises a plurality of plunger bores formed therein. Each plunger bore joins opposed first and second threaded openings formed in the section. Each second section is configured to thread at least partially into a selected one of the first threaded openings. Each second section comprises a through bore coaxially aligned with a selected plunger bore. Each plunger is configured to extend at least partially within a selected plunger bore. Each plunger comprises a first end, an opposed second end, a blind suction bore formed on the first end, a suction fitting bore formed perpendicular to the suction bore, a sleeve installed within the suction bore, and a valve seat installed within the first end of the plunger such that the sleeve is situated intermediate the valve seat and the second end of the plunger. The number of reciprocating plungers is the same as the number of the plunger bores.

In another aspect, certain embodiments of the present disclosure are directed towards a fluid end comprising a housing, and a plunger. The housing comprises a plurality of bores formed therein. The plunger is configured to reciprocate within a selected one of the plurality of bores. The plunger comprises a first end, a second end, an exterior surface, a valve seat, a sleeve, and a valve assembly. The first end has a blind bore formed therein. The second end is opposed to the first end. The exterior surface interconnects the first and second ends. The exterior surface also has a suction fitting bore formed therein. The valve seat is installed within the first end of the plunger. The sleeve is installed within the blind bore. The valve assembly is installed at least partially within the blind bore. The valve assembly comprises a valve body, a stem, a retainer, and a spring. The valve body is configured to engage the valve seat. The stem is joined to the valve body. The retainer surrounds at least a portion of the stem. The spring is configured to bias the valve body against the valve seat. The sleeve is configured to receive a portion of the retainer. The retainer is situated intermediate the valve body and the spring.

RELATED APPLICATIONS

U.S. Pat. No. 11,578,710 (hereinafter referred to as "the '710 patent"), entitled 'Fracturing Pump with In-Line Fluid End', issued on Feb. 14, 2023, is incorporated herein by reference in its entirety.

BRIEF DESCRIPTION OF THE DRAWINGS

FIG. 11 is a rear perspective view of the dynamic section shown in FIG. 110.

FIG. 120 is a cross-sectional view of the packing sleeve shown in FIG. 119, taken along line AE-AE.

FIG. 121 is a cross-sectional view of the packing sleeve shown in FIG. 119, taken along line AF-AF.

FIG. 122 is a front perspective view of a retainer of the fluid end shown in FIG. 100.

FIG. 123 is a rear perspective view of the retainer shown in FIG. 122.

FIG. 124 is a top plan view of the retainer shown in FIG. 122.

FIG. 125 is a front elevation view of the retainer shown in FIG. 122.

FIG. 126 is a cross-sectional view of the retainer shown in FIG. 125, taken along line AG-AG.

FIG. 127 is a cross-sectional view of the retainer shown in FIG. 125, taken along line AH-AH.

FIG. 128 is a cross-sectional view of the fluid end shown in FIG. 100, taken along line AI-AI.

FIG. 129 is a cross-sectional view of the fluid end shown in FIG. 100, taken along line AJ-AJ.

FIG. 130 is a rear perspective and exploded view showing partial assembly of a static section of the fluid end shown in FIG. 100.

FIG. 131 is a rear perspective and exploded view showing the assembly of a dynamic section of the fluid end shown in FIG. 100.

Figure 100:
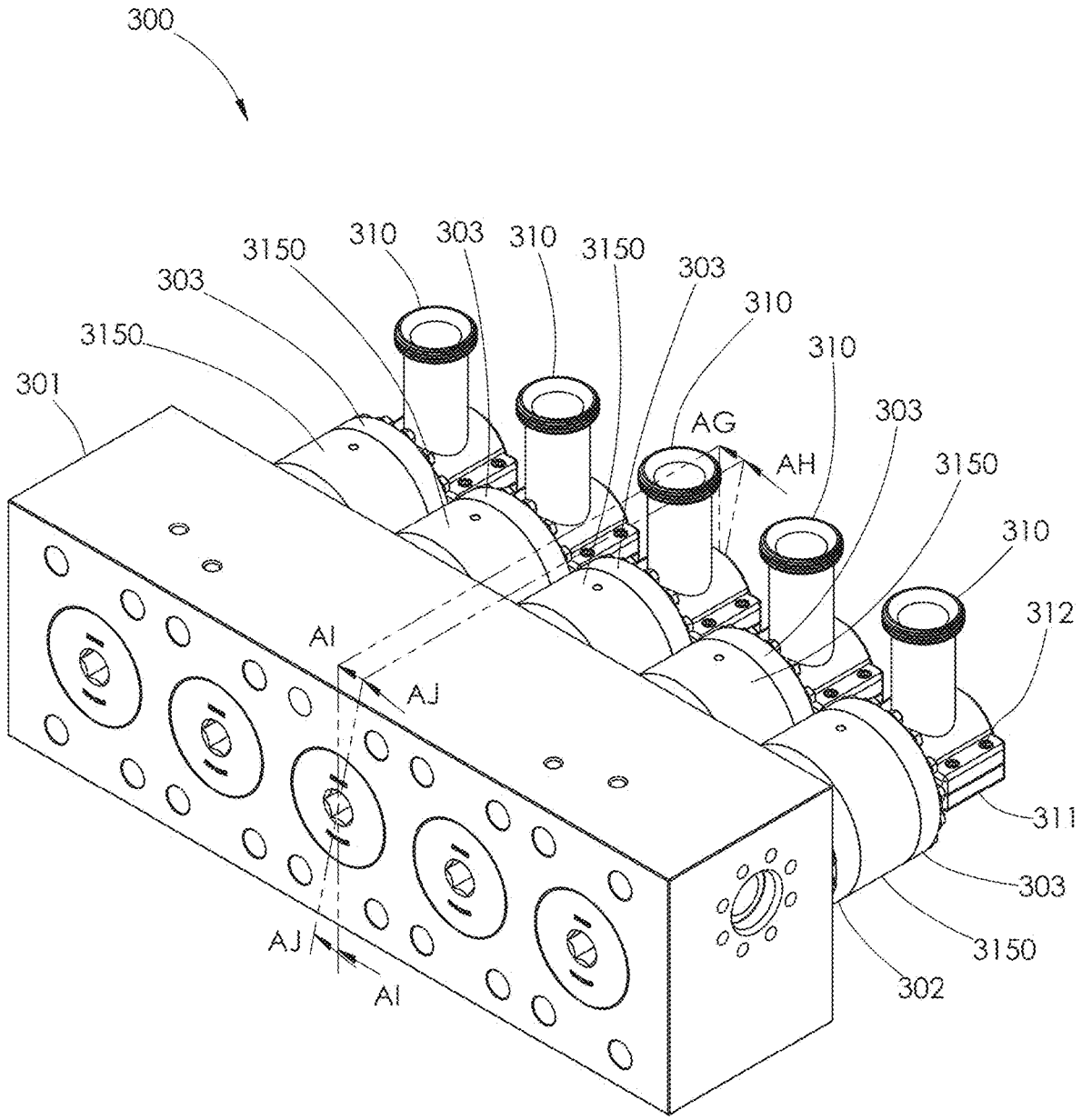
FIG. 100 is a front perspective view of another embodiment of a fluid end disclosed herein.
Figure 132:
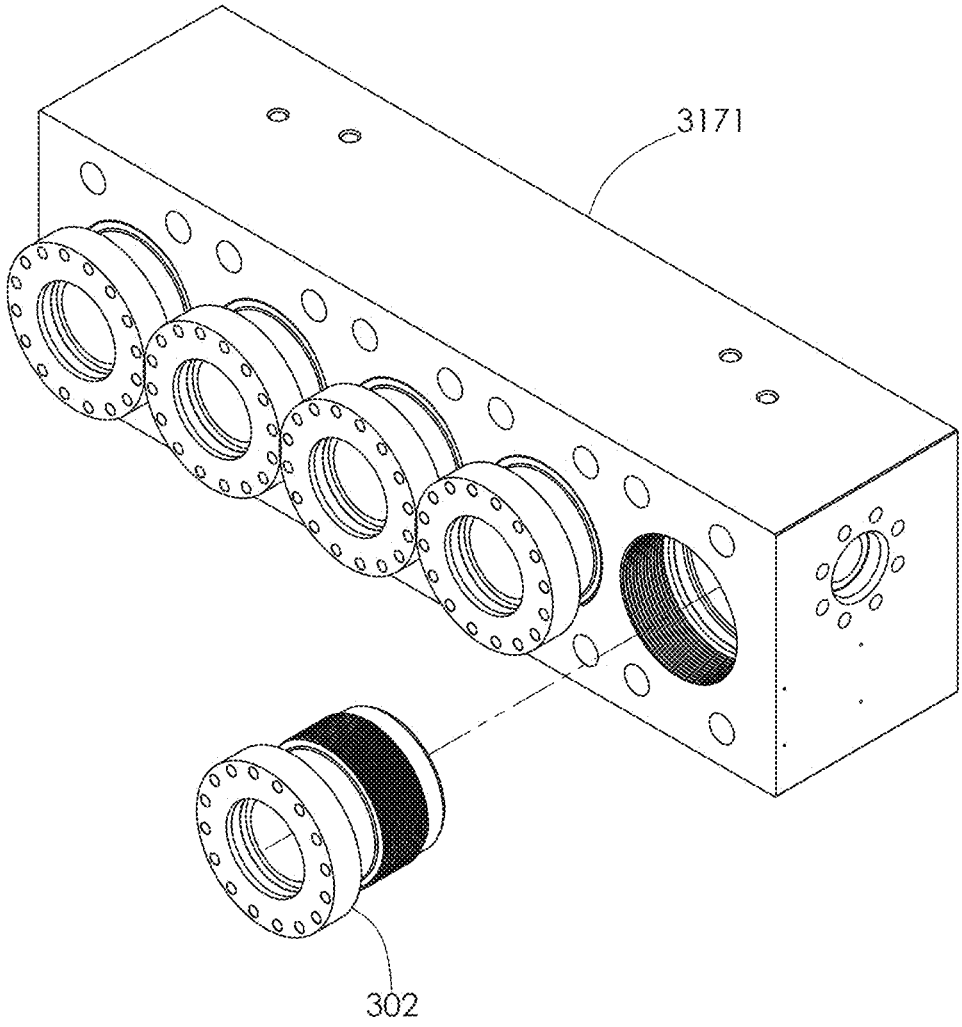

FIG. 132 is a rear perspective and exploded view showing the assembly of the dynamic section to the static section of the fluid end shown in FIG. 100.

Figure 133:
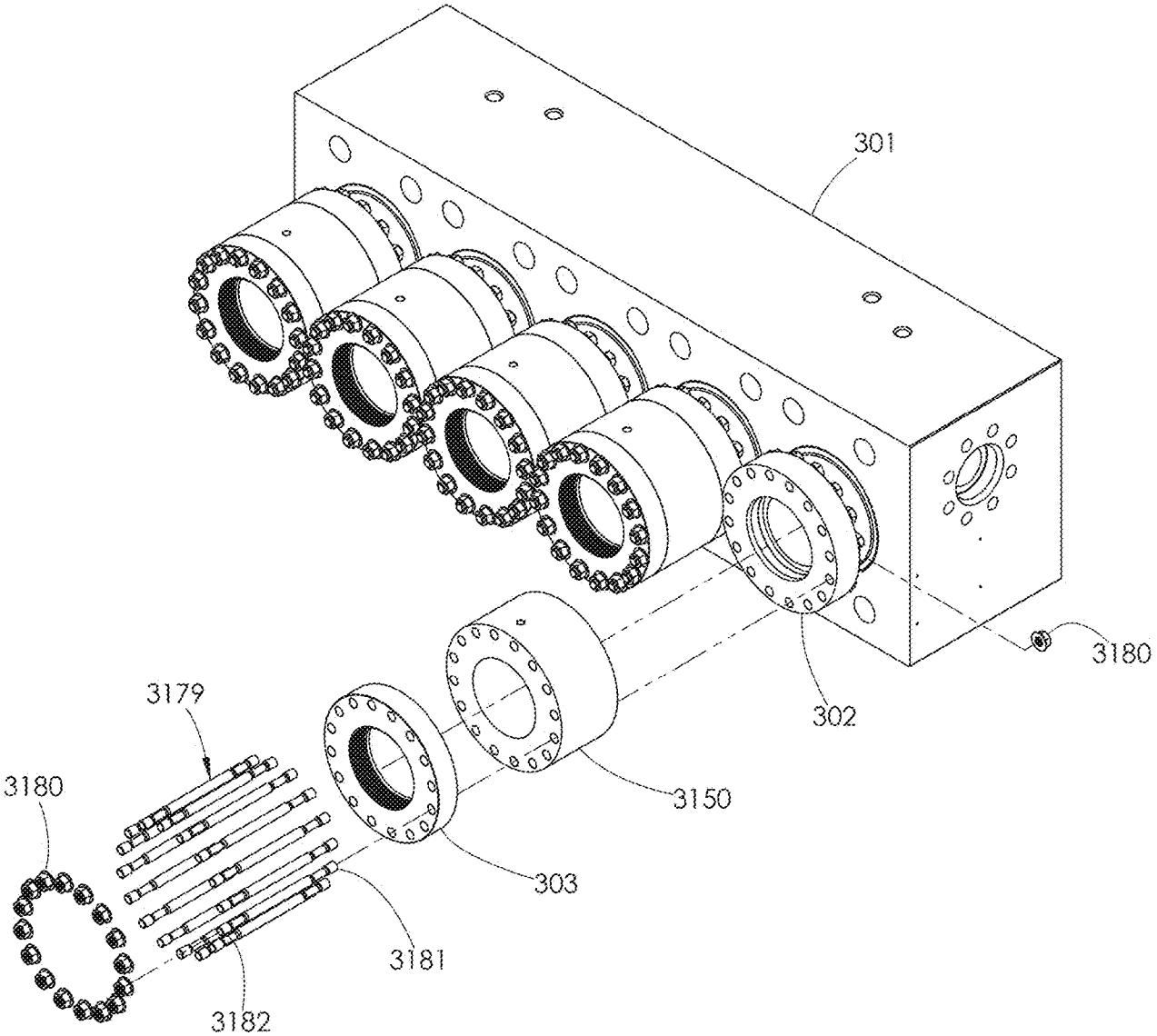

FIG. 133 is a rear perspective and exploded view showing the assembly of the packing sleeve and retainer to the dynamic section of the fluid end shown in FIG. 100.

Figure 134:
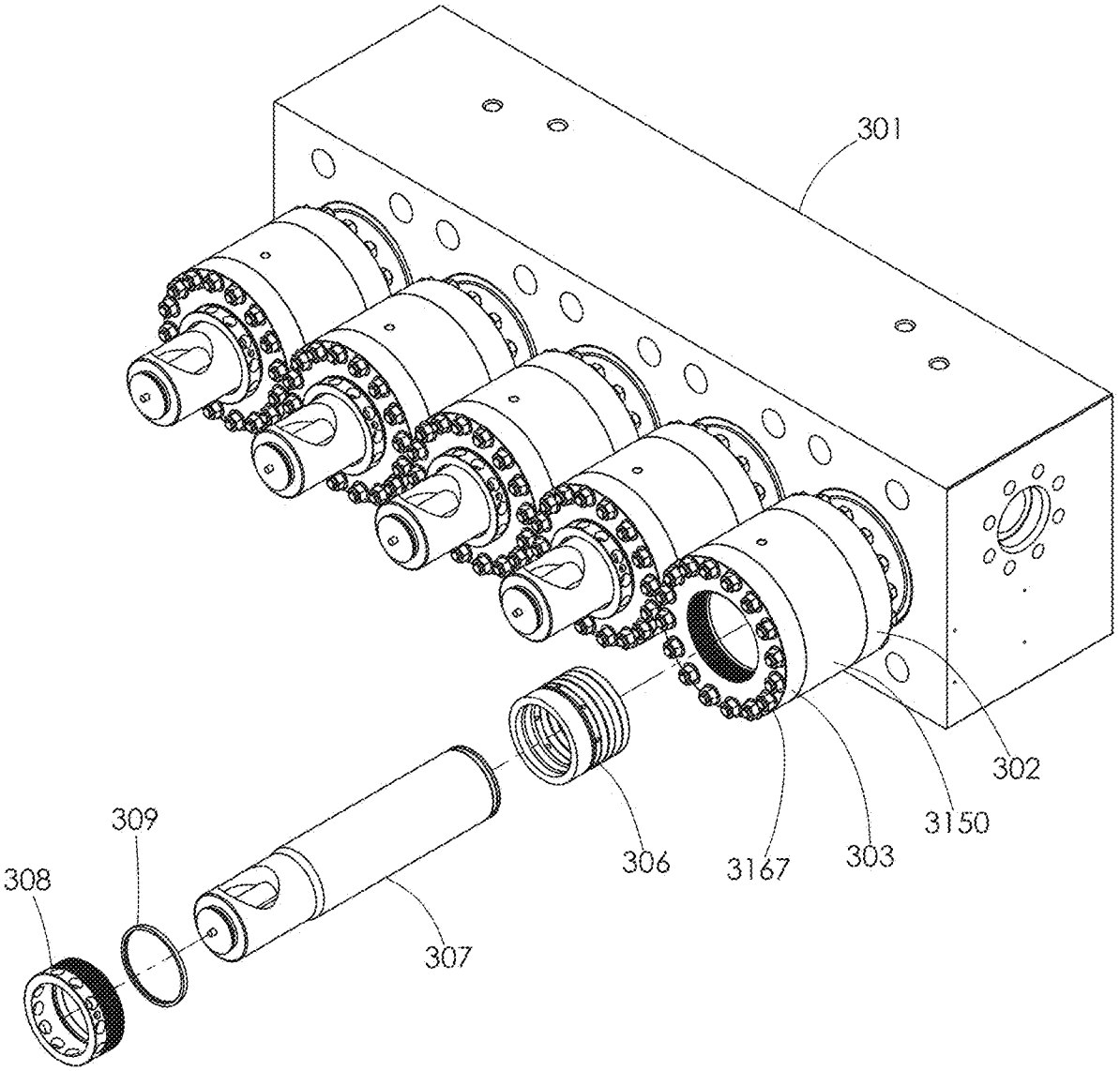

FIG. 134 is a rear perspective and exploded view showing the assembly of the packing stack, plunger assembly, packing nut seal, and packing nut of the fluid end shown in FIG. 100.

Figure 135:
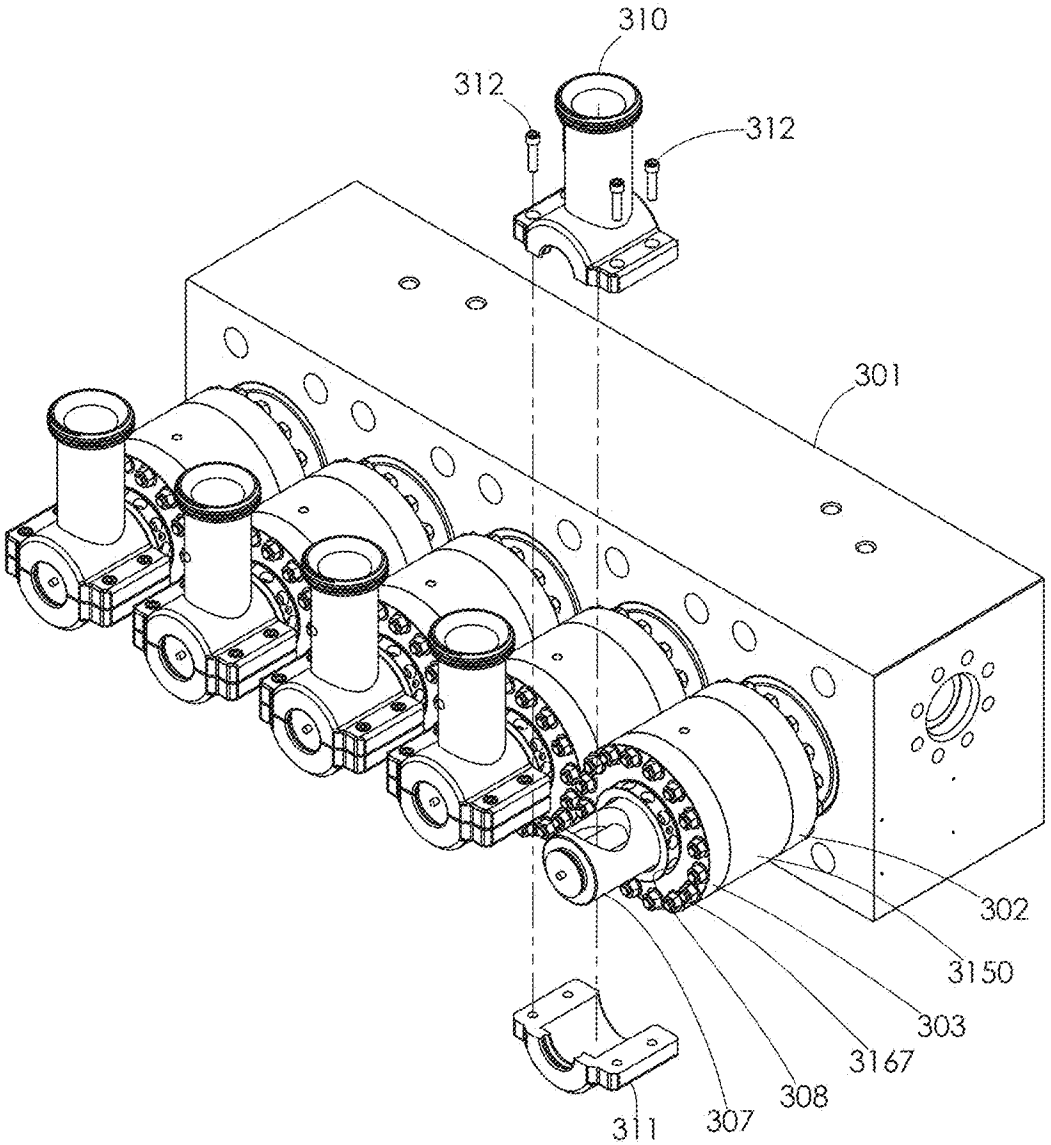

FIG. 135 is a rear perspective and exploded view showing the assembly of the top and bottom plunger suction fittings to the plunger assembly of the fluid end shown in FIG. 100.

DETAILED DESCRIPTION

Various hydraulic pumps having fluid ends are commonly used in industrial applications to deliver high volumes of highly pressurized fluids during operations such as hydraulic fracturing ("fracking"). Some of these hydraulic pumps, as well as their benefits, are described in detail in the '710 patent.

This patent application describes an apparatus that improves prior high-pressure pumps in a variety of ways. The application describes various embodiments of a fluid end, as well as various methods of assembling, maintaining, operating, and repairing the fluid end.

Looking particularly to the pump described in the '710 patent, the "in-line" nature of the fluid end pump eliminates the need for intersecting bores, thus reducing the likelihood of stress and fatigue failures while increasing fluid end operational life. While this "in-line" pump technology is presented in the '710 patent, this patent application describes further innovative improvements in features and designs to the "in-line" pump. These features are described in detail herein.

One of these improvements is the introduction of a sleeve within the fluid end's plunger, which improves installation of a valve assembly. The sleeve is sized such that its orientation and geometry enable a user to at least partially compress the spring of the valve assembly while installing the valve assembly in the plunger. Further, instead of machining this profile into the inner diameter of the bore of the plunger, the sleeve provides a removable component that can be machined separate from the plunger and removed or replaced if needed. Thus, the sleeve, among other advantages, also provides an easier manufacturing process of the improved designs disclosed herein.

Another improvement within certain embodiments disclosed herein is a split "static" section of the fluid end. The split static section is divided into two pieces, which reduces the risk of cutting or harming dynamic seals during initial installation of "dynamic" sections into the static section. During construction of the fluid end, dynamic sections are threaded into a first piece of the static section, then essentially pushed straight into dynamic seals such that the dynamic seals surround at least a portion of the dynamic sections. The two static pieces are then combined, and the dynamic sections are further torqued into the combined static section as needed. By eliminating the step of rotating the dynamic sections directly into the dynamic seals, the risk of harming the dynamic seals is reduced. The installation and construction of the static and dynamic sections are described more herein.

Other improvements discussed herein include the addition of hardened inserts in areas subject to high erosion, such as surfaces that engage seals. The addition of hardened inserts reduces wear and erosion, which in turn increases the life of the parts in which such inserts are installed in.

Yet another improvement discussed herein is the introduction of a twist-on "locking" retainer. This retainer may be replaced with a bolt-on design, as desired. Both designs offer improved efficiencies in installing, replacing, and removing components of the fluid end.

In some embodiments, a packing sleeve may be inserted into a dynamic section or piece. Such packing sleeve may not have a hardened insert within; however, it should be noted that hardened inserts formed of carbide or other hard materials may be used in the sealing area between the packing sleeve and the dynamic section, and/or the sealing area between the packing sleeve and the packing.

In general, a fluid is routed through the fluid end by passing through a suction conduit, then into a plunger's internal bore. The fluid may then pass through a valve installed at one end of the plunger and into a cavity. The plunger may then extend into the cavity such that the fluid is pressurized. Once pressurized, the fluid may then pass through another valve, and out of a discharge port or conduit. The proceeding description should be understood to be a general example and overview of how the fluid end operates, and should not be misunderstood to be limiting in any way. There may be many ways to operate the fluid end described herein.

Referring now to the figures, FIGS. 1, 2, 55 and 56 show a fluid end 100. The fluid end 100 comprises a static section 101, a plurality of dynamic sections 102, a plurality of retainers 103, a plurality of retainer seals 104, a plurality of retainer locks 105, a plurality of packing stacks 106, a plurality of plunger assemblies 107, a plurality of packing nuts 108, a plurality of packing nut seals 109, a plurality of top plunger suction fittings 110, a plurality of bottom plunger suction fittings 111, and a plurality of suction fitting connectors 112.

Referring now to FIGS. 1, 2, and 55-80, the static section 101 comprises a front static section 113, a rear static section 114, a plurality of dynamic seals 115, a plurality of static section connectors 116, a plurality of discharge valve assemblies 117, a plurality of discharge plug seals 118, and a plurality of discharge plug retainers 119. In alternative embodiments, the static section 101 may comprise a single-piece body instead of sections 113 and 114.

Figure 55:
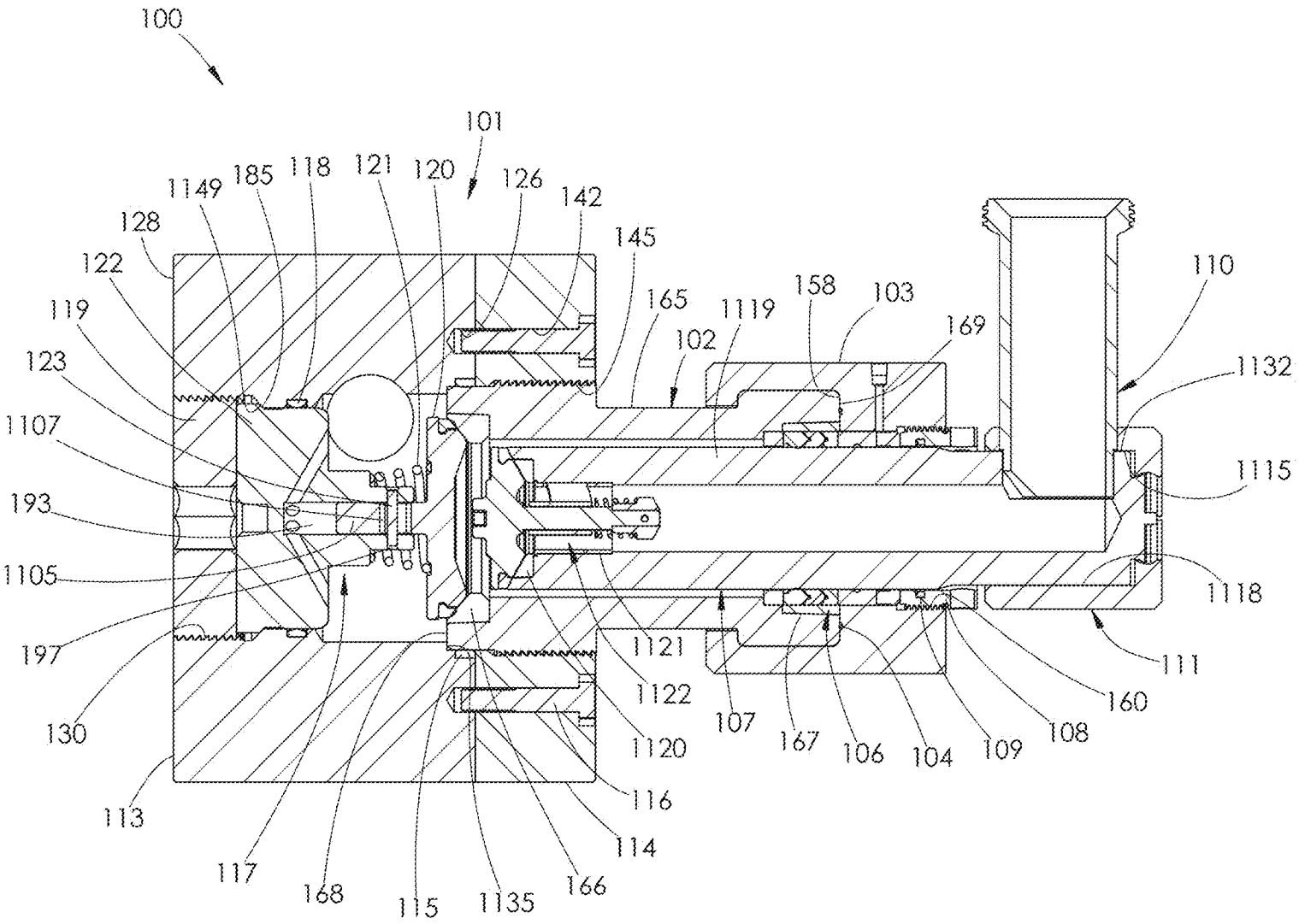
FIG. 55 is a cross-sectional view of the fluid end shown in FIG. 1, taken along line Q-Q.
Figure 56:
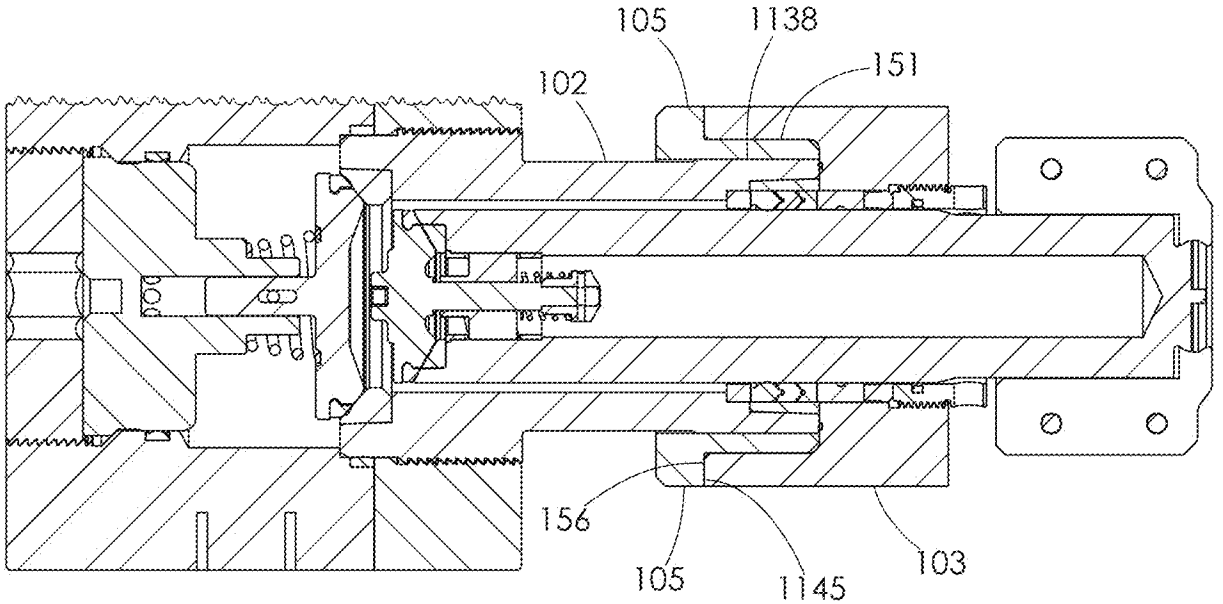
FIG. 56 is a partial cross-sectional view of the fluid end shown in FIG. 1, taken along line R-R.
Figure 57:
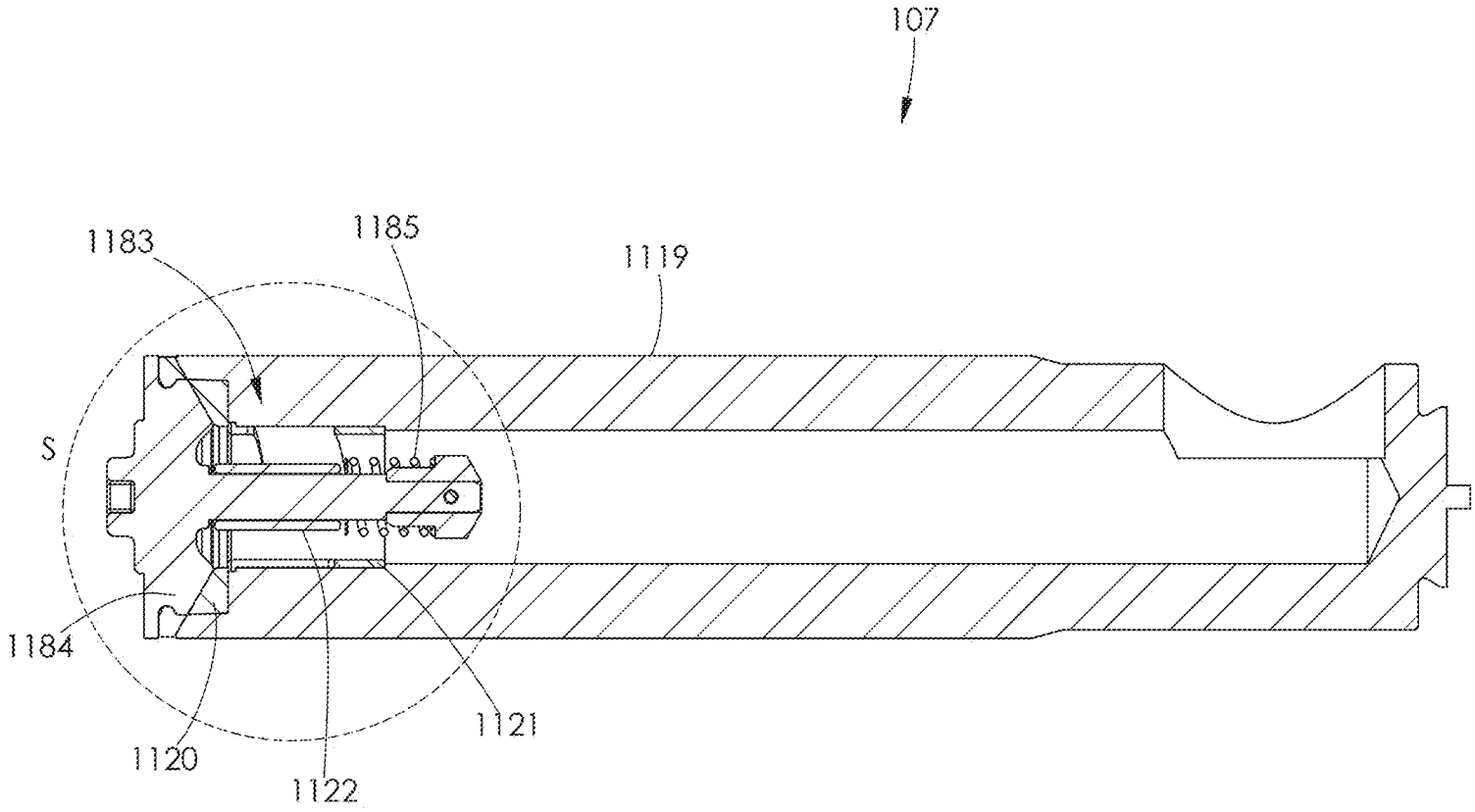
FIG. 57 is a cross-sectional view of a plunger assembly used in the fluid end shown in FIG. 1, taken along line Q-Q.
Figure 58:
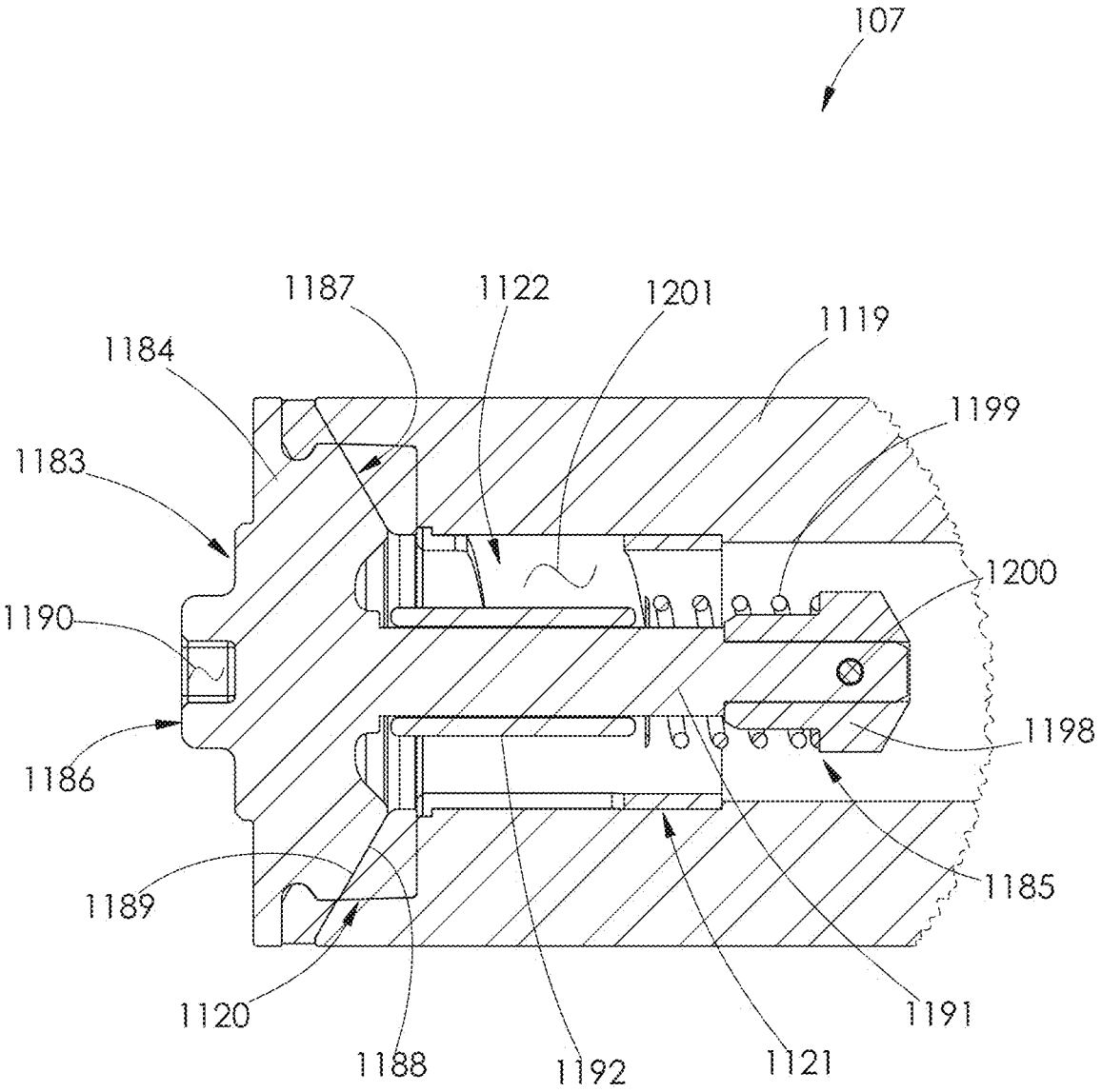
FIG. 58 is an enlarged view of area S shown in FIG. 57.
Figure 59:
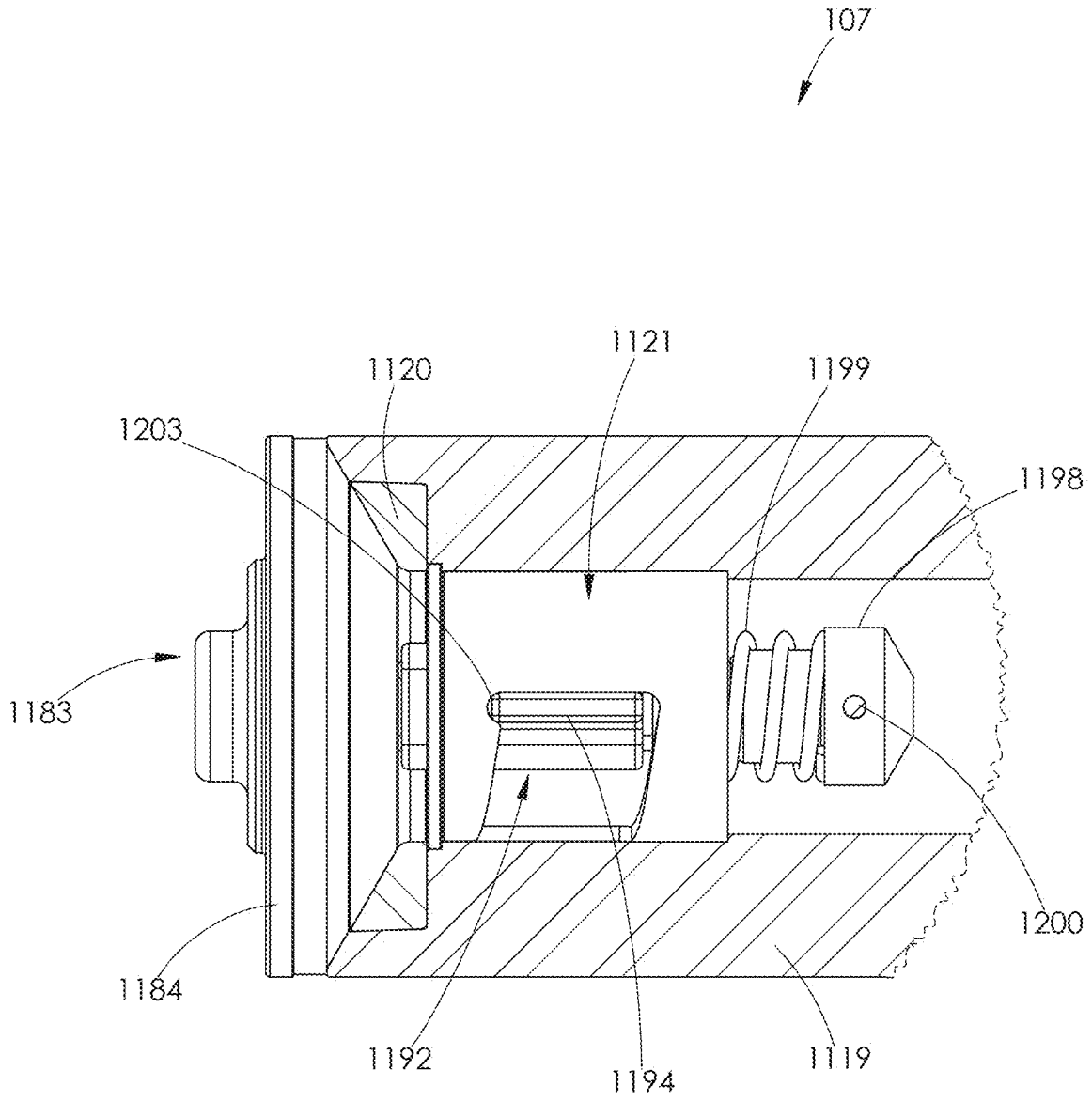
FIG. 59 is a view of FIG. 58, without the sleeve and suction valve assembly sectioned.
Figure 60:
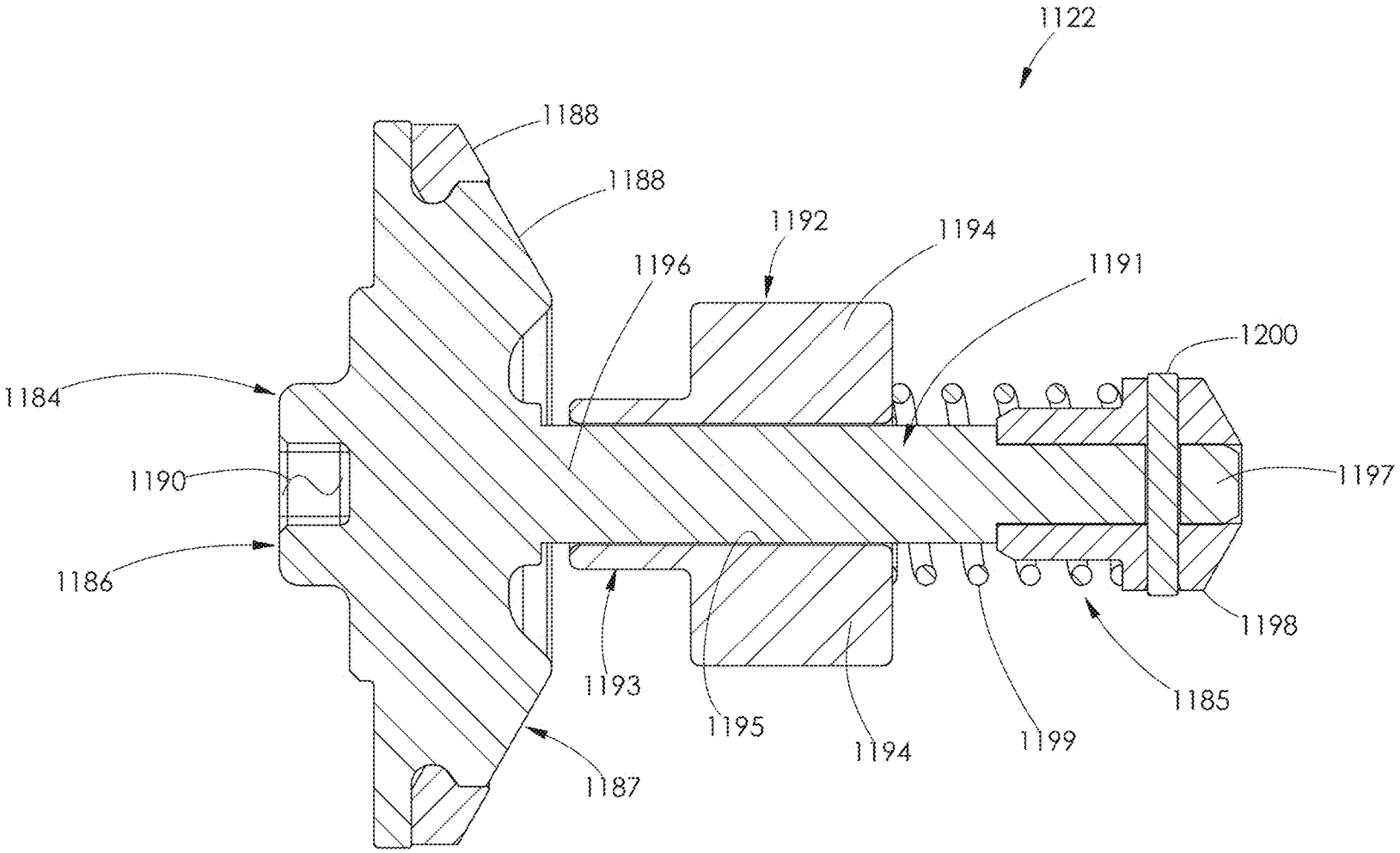
FIG. 60 is a cross-sectional view of a suction valve assembly used in the fluid shown in FIG. 1, taken along line Q-Q.
Figure 78:
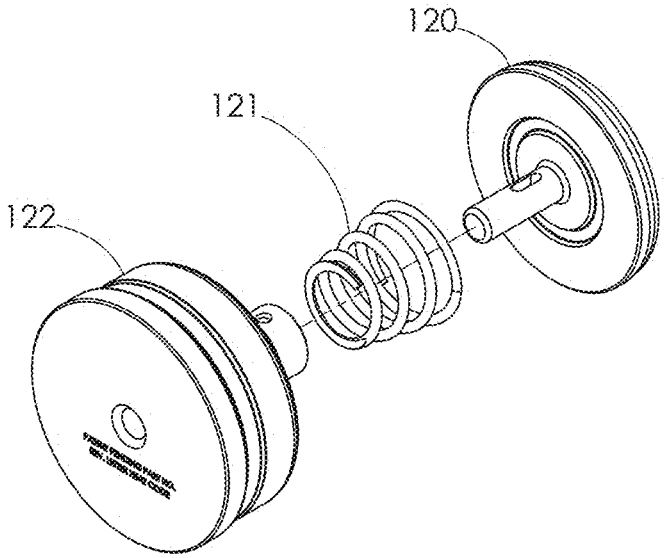
FIG. 78 is a front perspective and exploded view of the assembly of the discharge valve to the suction plug of the fluid end shown in FIG. 1.
Figure 79:
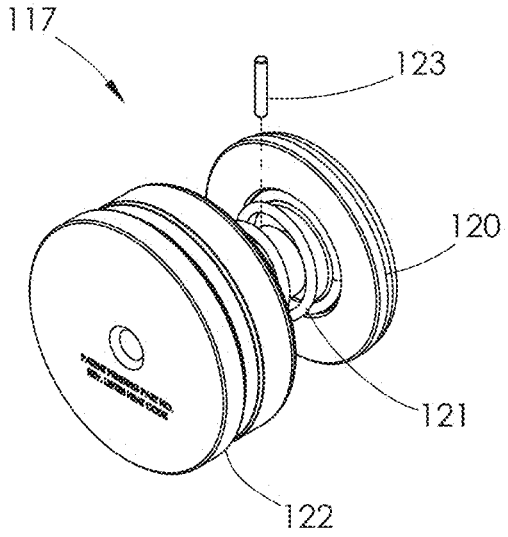
FIG. 79 is a front perspective and partially exploded view of the assembly of the retainer pin into the discharge plug and discharge valve of the fluid end shown in FIG. 1.

Referring now to FIGS. 55, 78, and 79, each discharge valve assembly 117 comprises a discharge valve 120, a spring 121, a discharge plug 122, and a dowel pin 123.

Referring now to FIGS. 3-10, the front static section 113 has the general shape of a rectangular prism comprising a plurality of stay rod through holes 124, a plurality of flow bores 125, a plurality of rear static section mounting holes 126, and a discharge bore 127. The stay rod through holes 124 are parallel to the flow bores 125 which are formed perpendicular to the front surface 128 of the front static section 113 and parallel to the longitudinal axis of the fluid end 100. The stay rod through holes 124 are spaced evenly about each flow bore 125.

Figure 1:
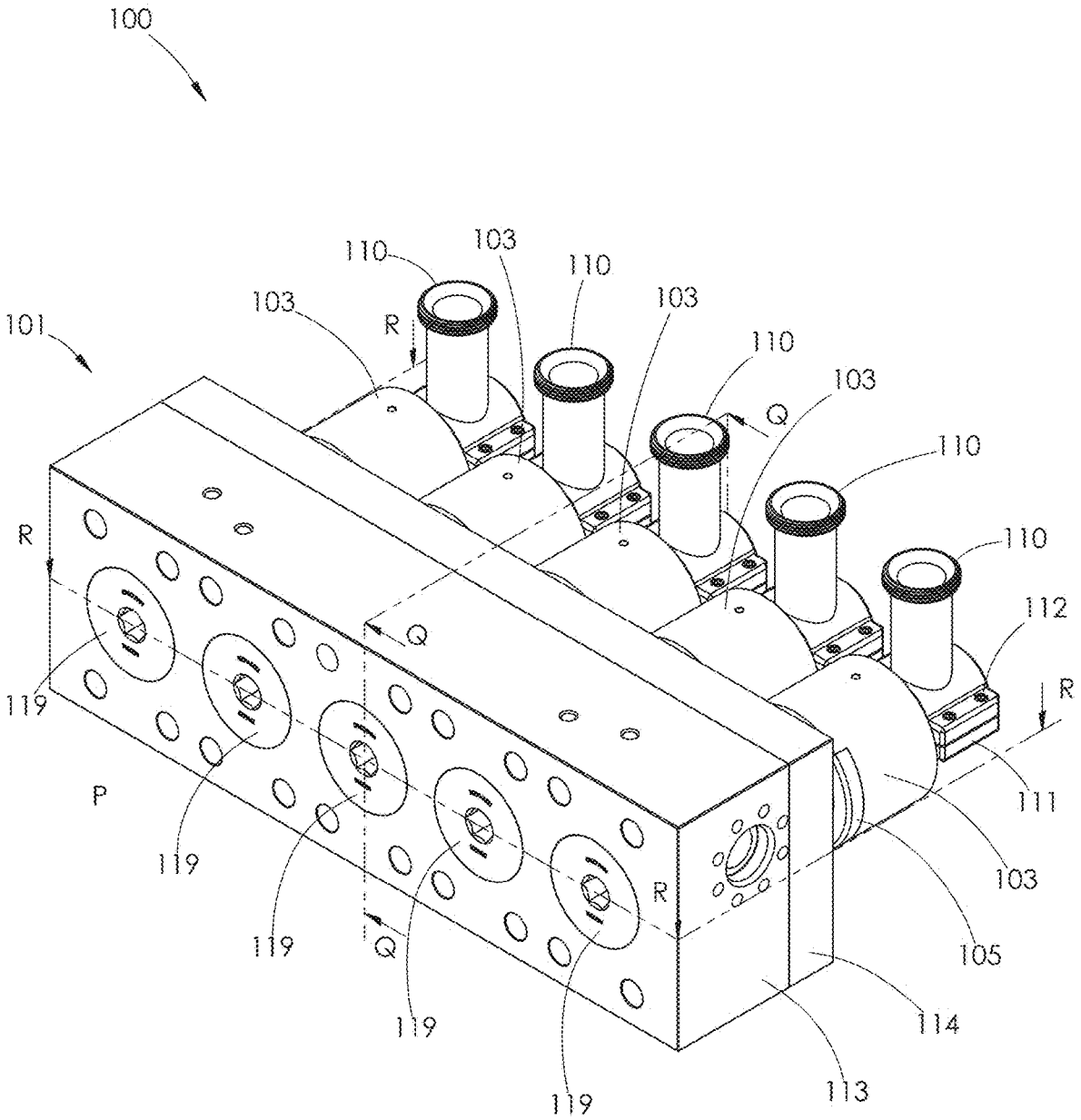
FIG. 1 is a front perspective view of one embodiment of a fluid end disclosed herein.
Figure 2:
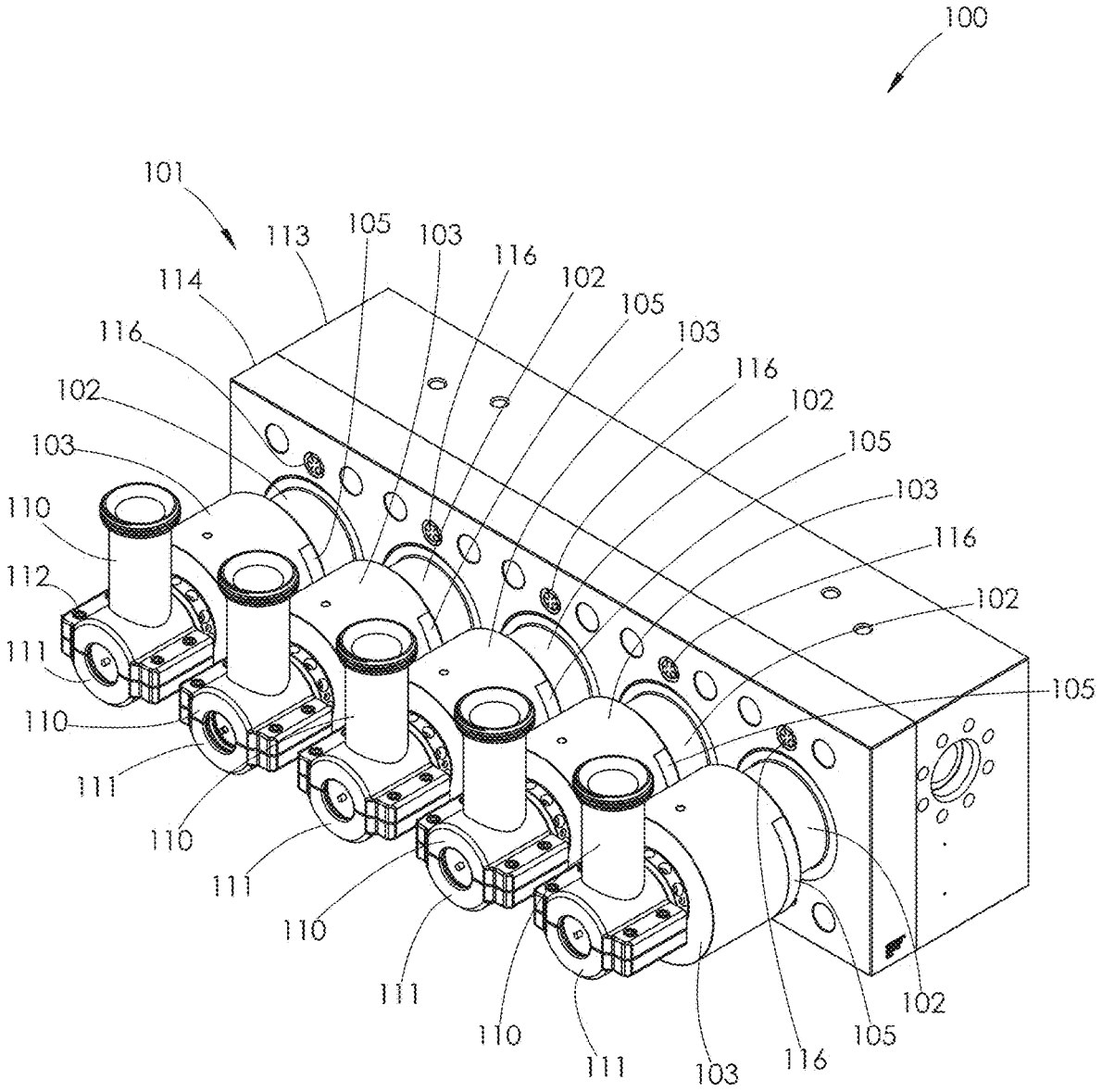
FIG. 2 is a rear perspective view of the fluid end shown in FIG. 1.
Figure 3:
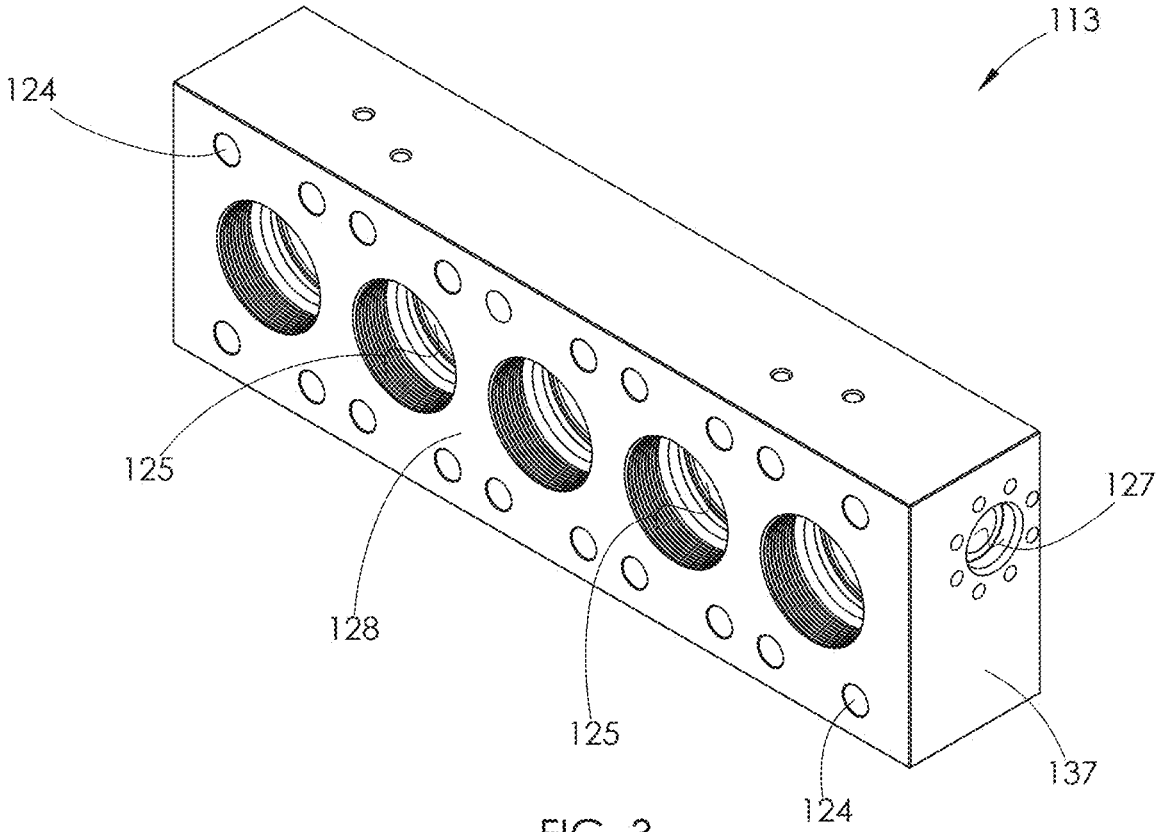
FIG. 3 is a front perspective view of a front static section of the fluid end shown in FIG. 1
Figure 4:
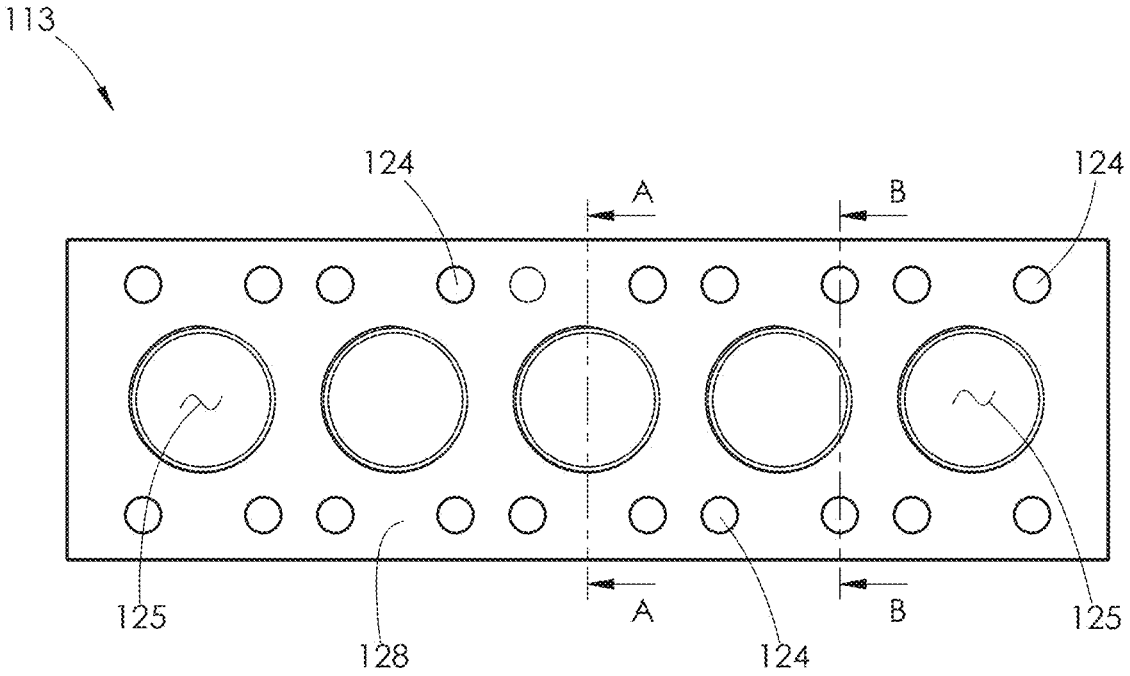
FIG. 4 is a front elevation view of the front static section shown in FIG. 3.
Figure 5:
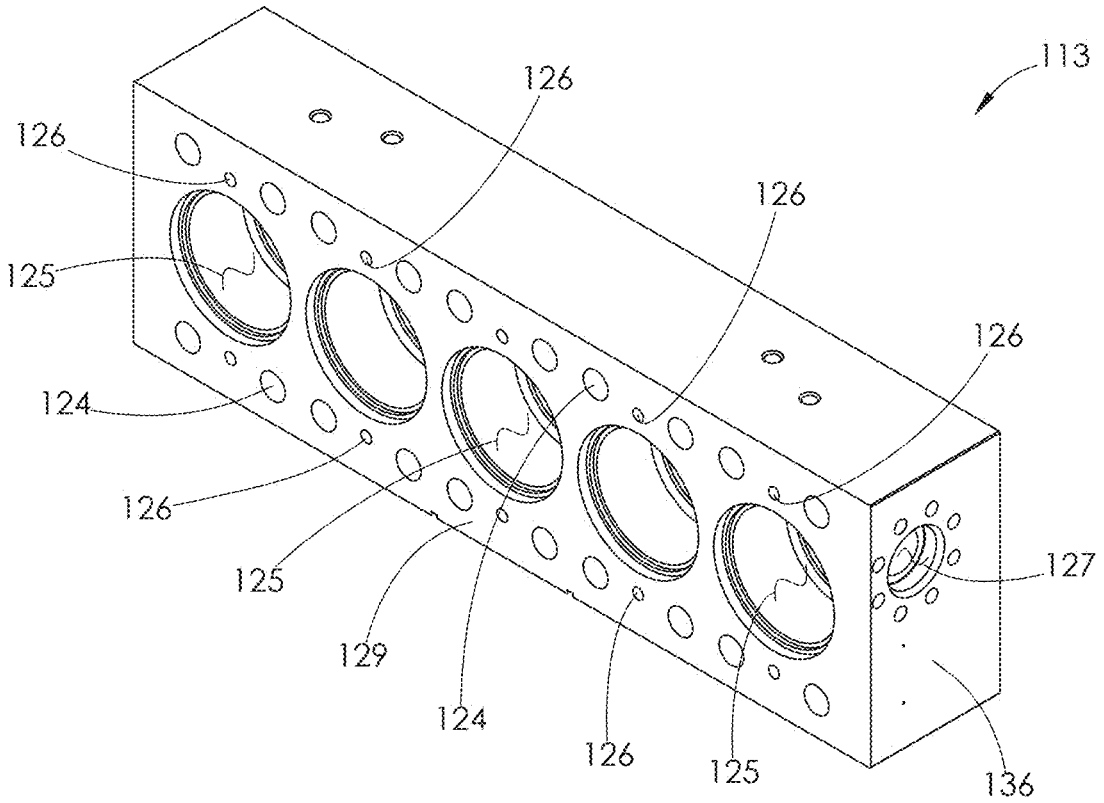
FIG. 5 is a rear perspective view of the front static section shown in FIG. 3.
Figure 6:
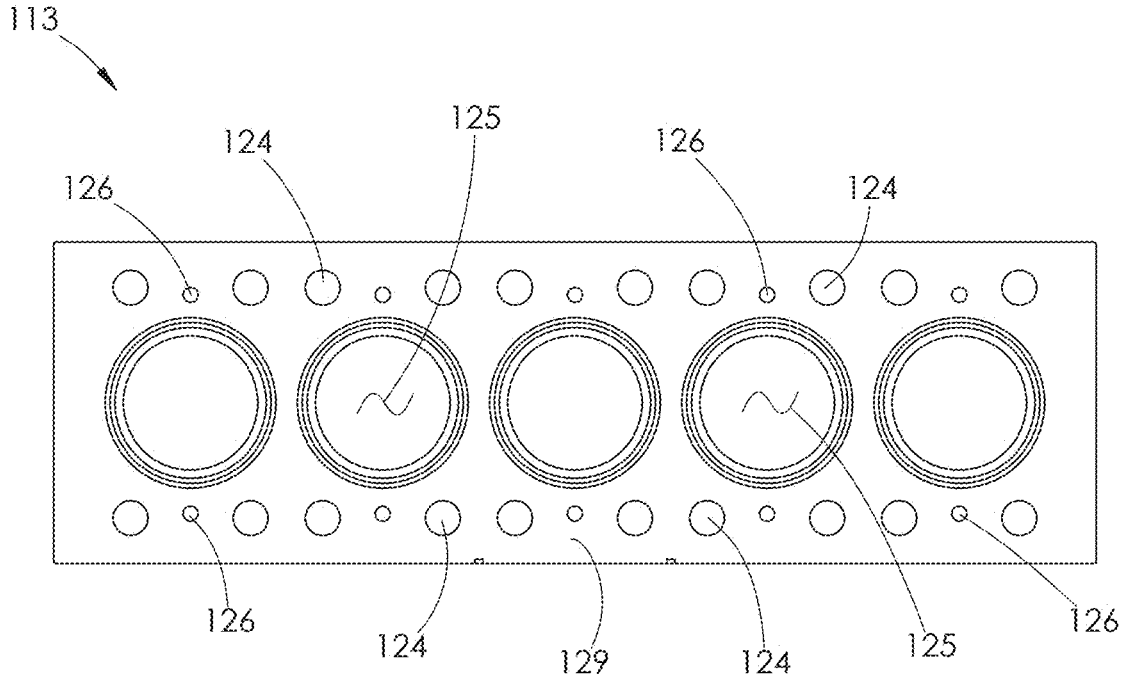
FIG. 6 is a rear elevation view of the front static section shown in FIG. 3.
Figure 7:
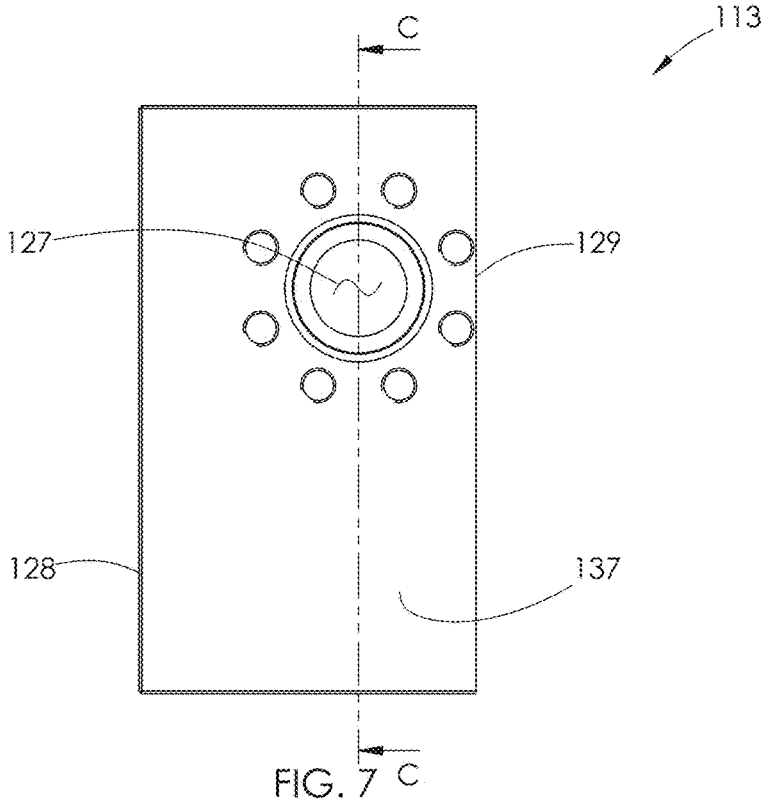
FIG. 7 is a right-side elevation view of the front static section shown in FIG. 3.
Figure 8:
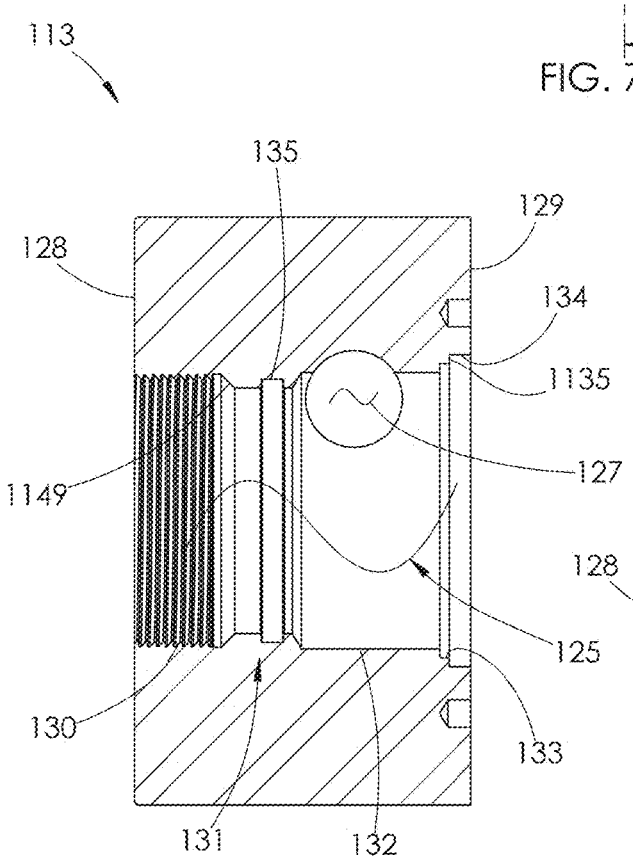
FIG. 8 is a cross-sectional view of the front static section shown in FIG. 4, taken along line A-A.
Figure 9:
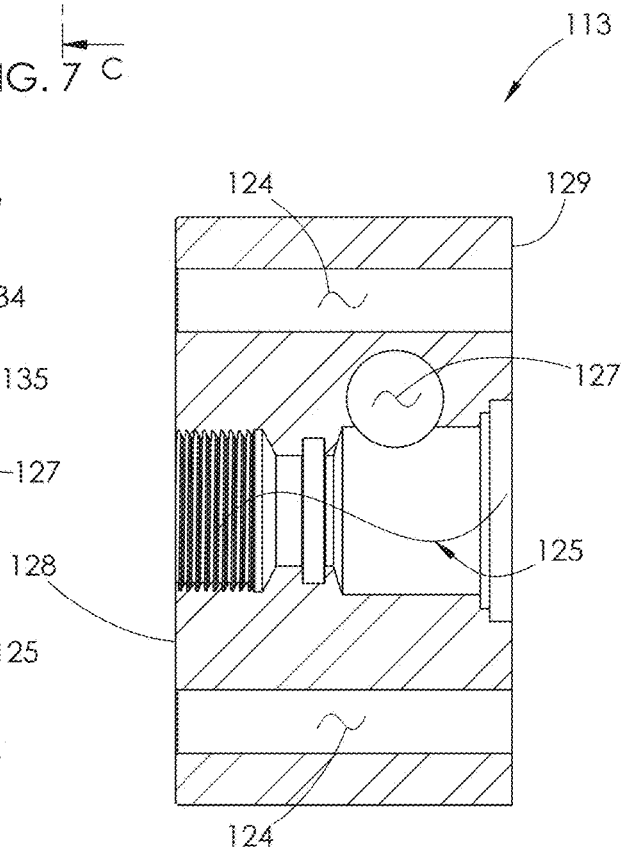
FIG. 9 is a cross-sectional view of the front static section shown in FIG. 4, taken along line B-B.

Referring now to FIG. 8, each flow bore 125 connects the front 128 and rear 129 surfaces of the front static section 113. Beginning at the front surface 128 and continuing along the bore axis to the rear surface 129, each flow bore 125 comprises a threaded section 130, a discharge plug section 131, a chamber section 132, a dynamic section counterbore 133, and a dynamic seal counterbore 134. The discharge plug section 131 comprises a discharge plug seal groove 135.

Figure 10:
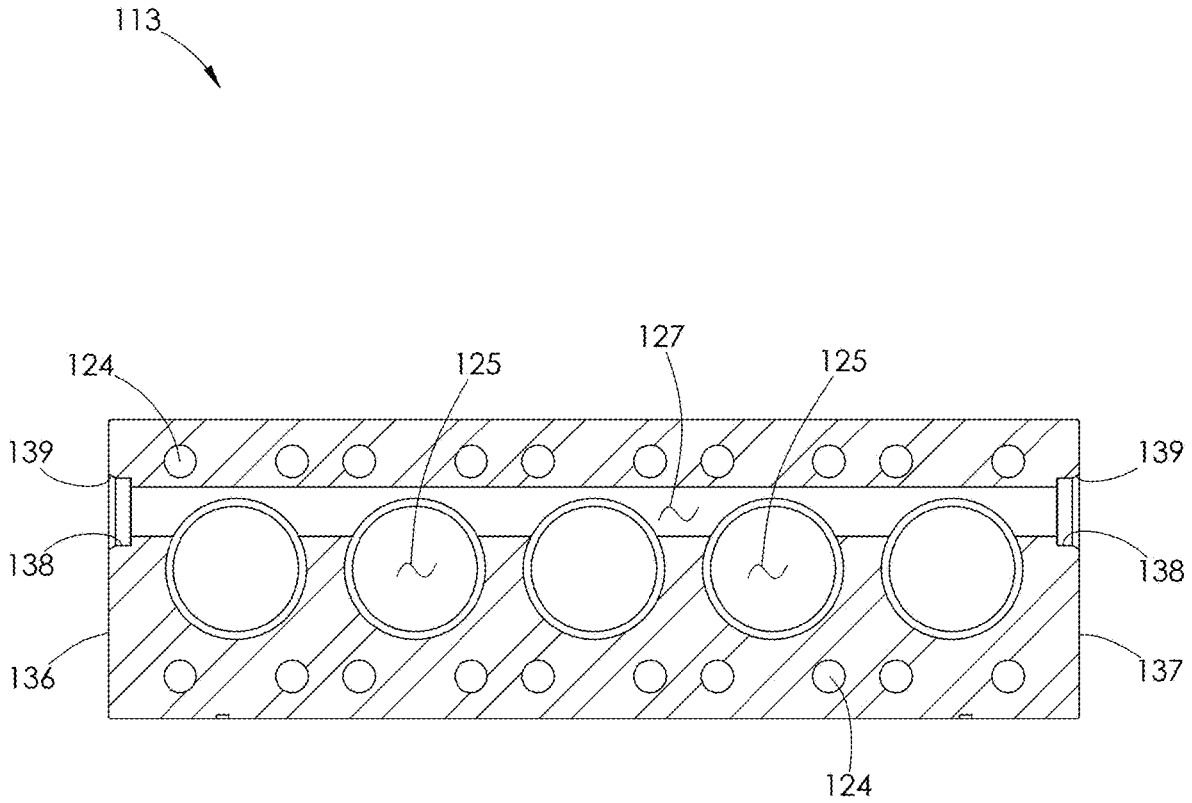
FIG. 10 is a cross-sectional view of the front static section shown in FIG. 7, taken along line C-C.
Figure 11:
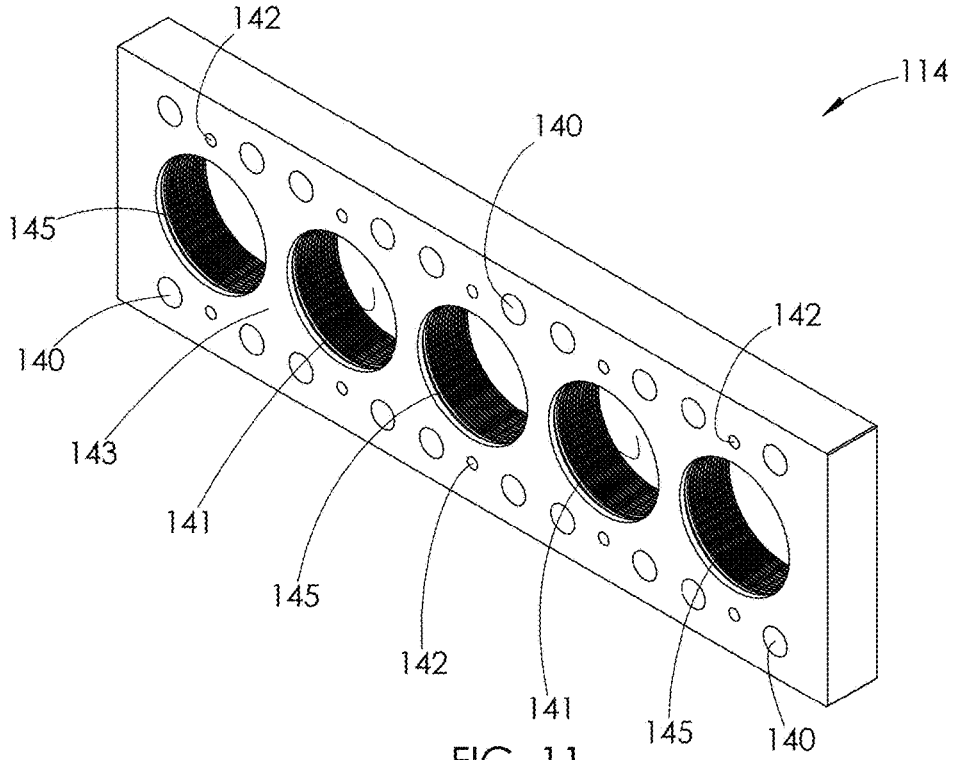
FIG. 11 is a front perspective view of a rear static section of the fluid end shown in FIG. 1.
Figure 12:
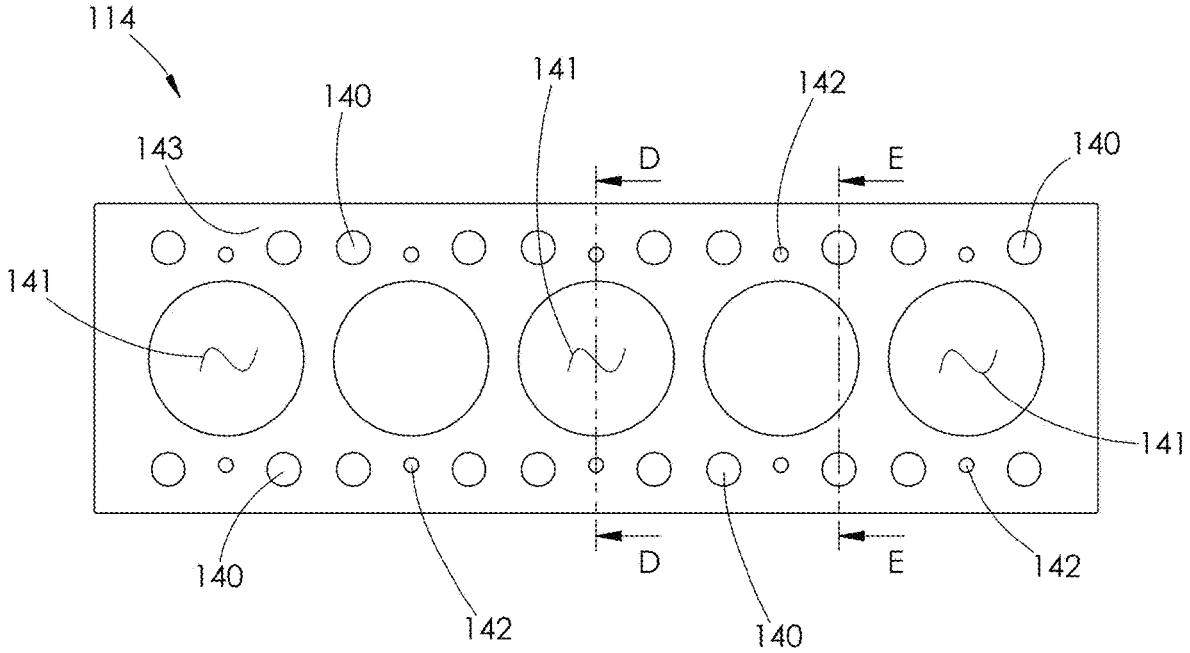
FIG. 12 is a front elevation view of the rear static section shown in FIG. 11.
Figure 13:
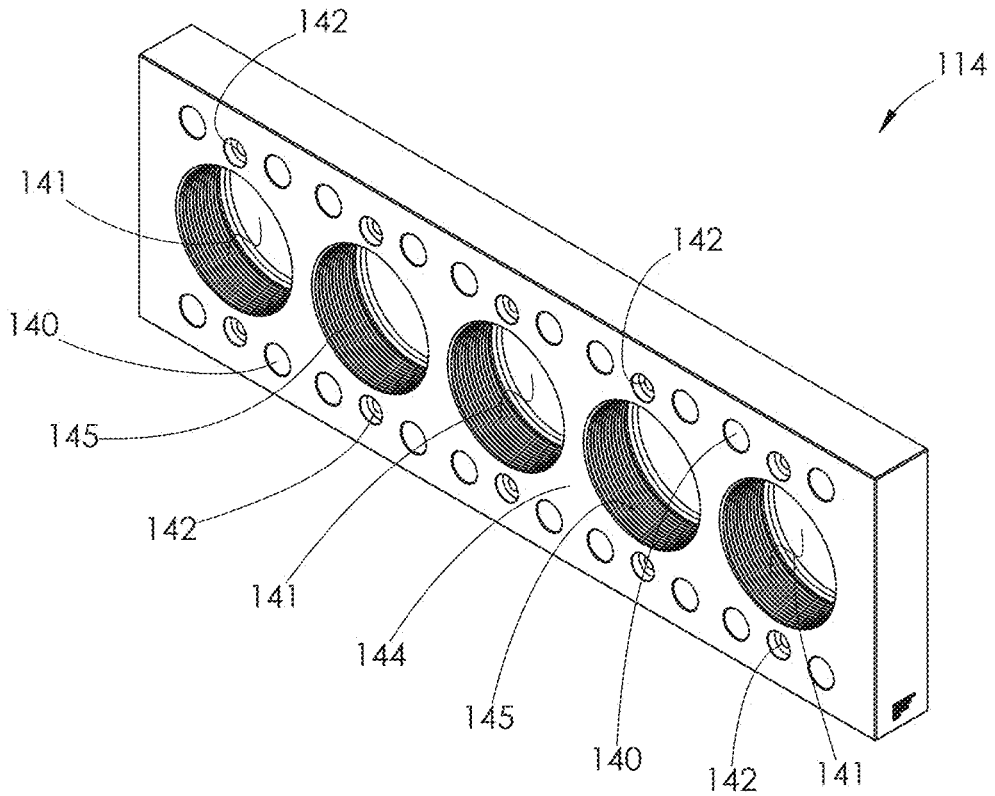
FIG. 13 is a rear perspective view of the rear static section shown in FIG. 11.
Figure 14:
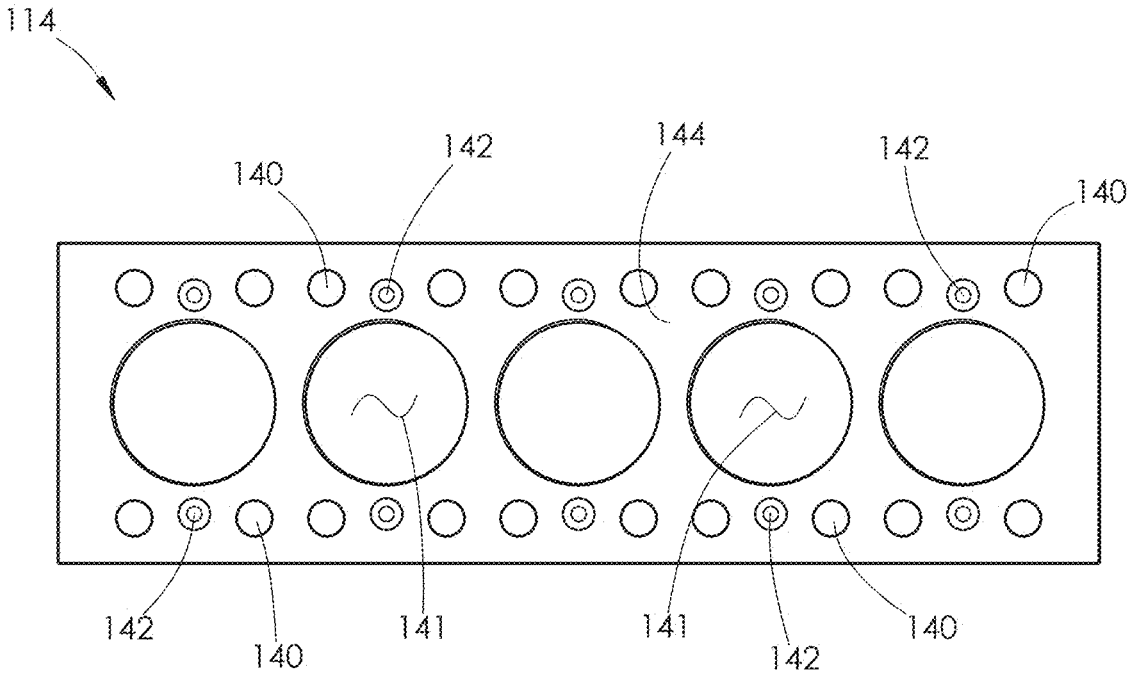
FIG. 14 is a rear elevation view of the rear static section shown in FIG. 11.
Figure 15:
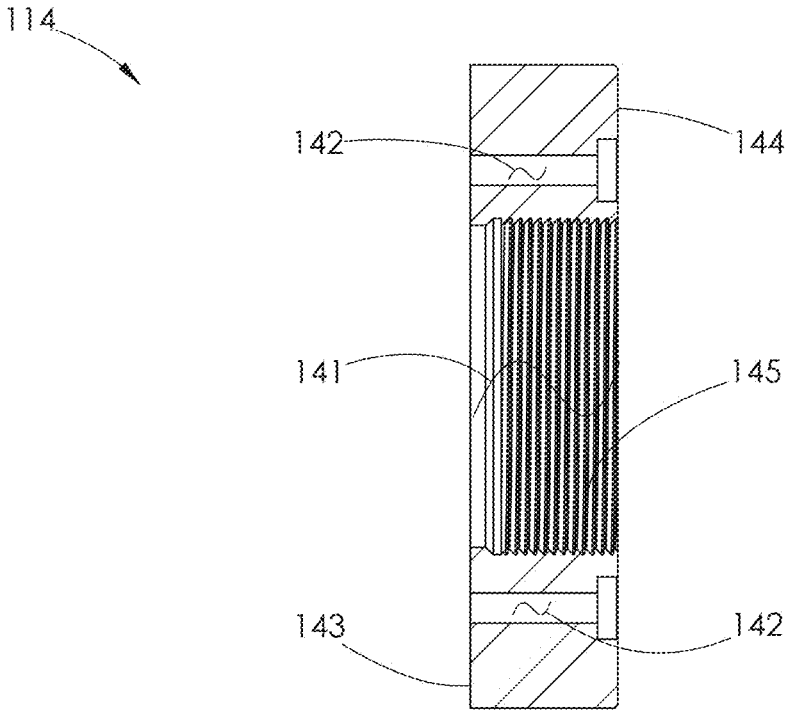
FIG. 15 is a cross-sectional view of the rear static section shown in FIG. 12, taken along line D-D.
Figure 16:
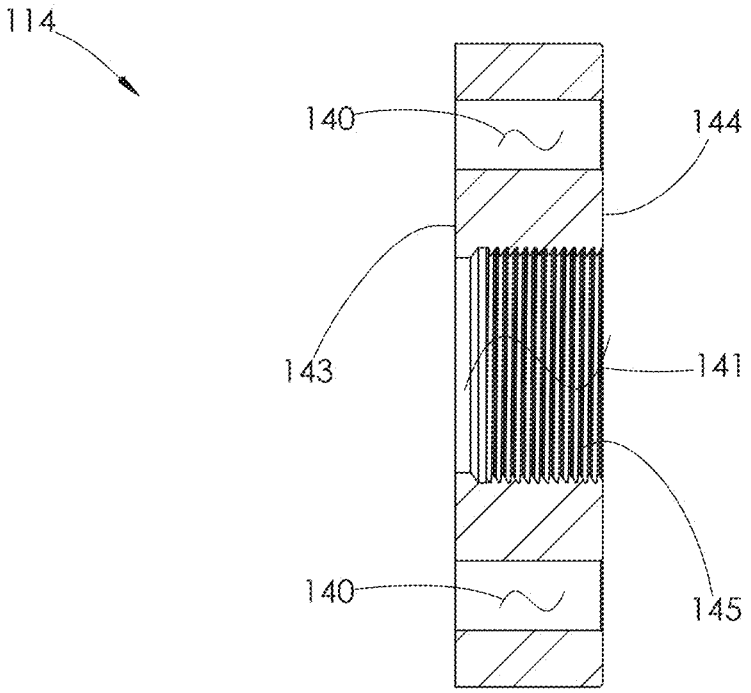
FIG. 16 is a cross-sectional view of the rear static section shown in FIG. 12, taken along line E-E.
Figure 17:
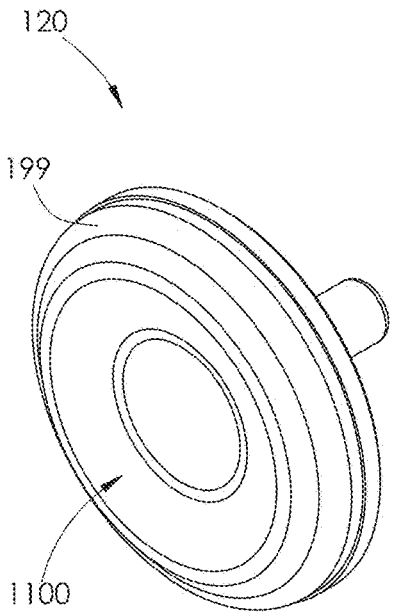
FIG. 17 is a front perspective view of a discharge valve of the fluid end shown in FIG. 1.
Figure 18:
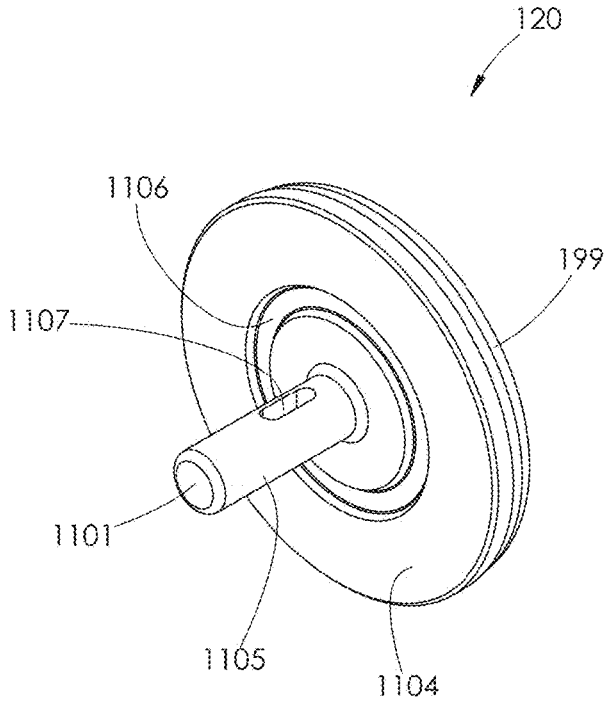
FIG. 18 is a rear perspective view of the discharge valve shown in FIG. 17.
Figure 19:
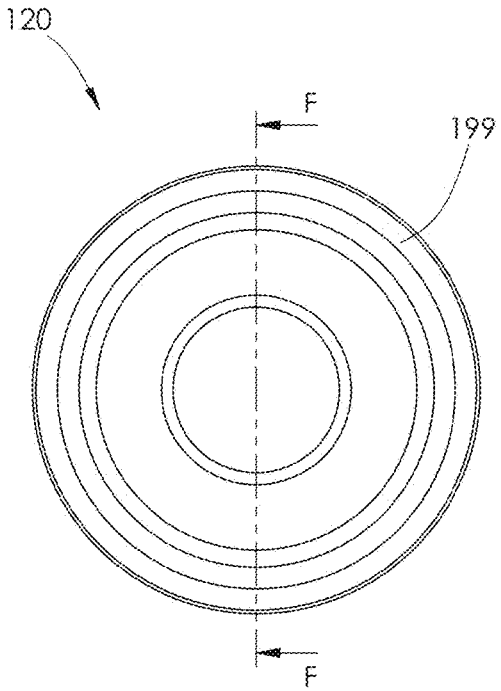
FIG. 19 is a front elevation view of the discharge valve shown in FIG. 17.
Figure 20:
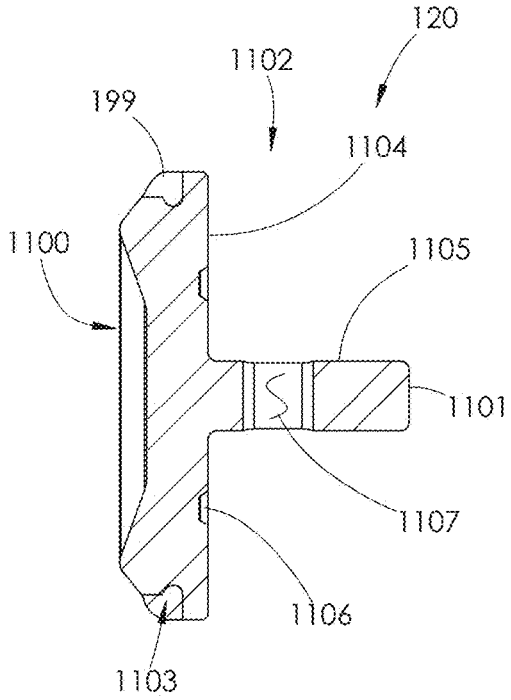
FIG. 20 is a cross-sectional view of the discharge valve shown in FIG. 19, taken along line F-F.
Figure 21:
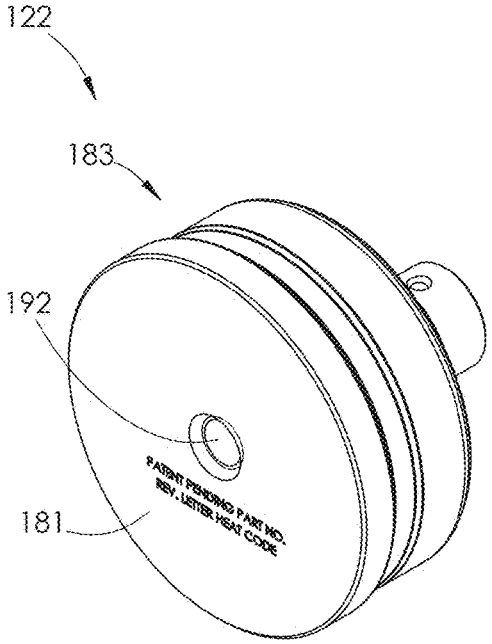
FIG. 21 is a front perspective view of a suction plug of the fluid end shown in FIG. 1.
Figure 22:
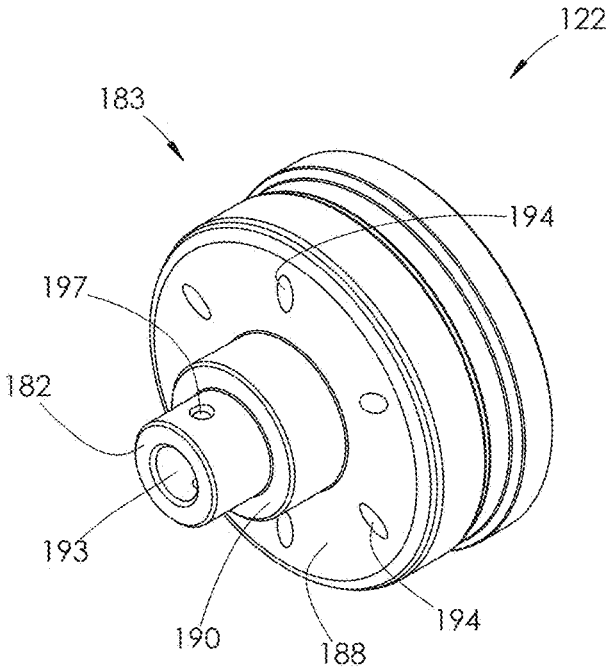
FIG. 22 is a rear perspective view of the suction plug shown in FIG. 21.
Figure 23:
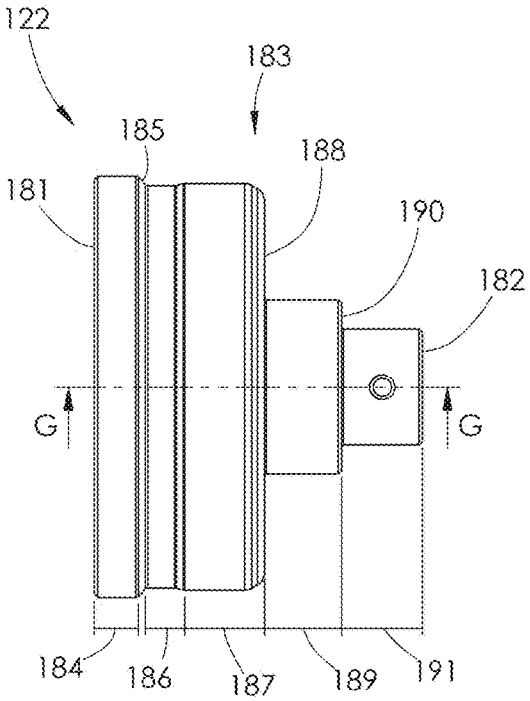
FIG. 23 is a top plan view of the suction plug shown in FIG. 21.
Figure 24:
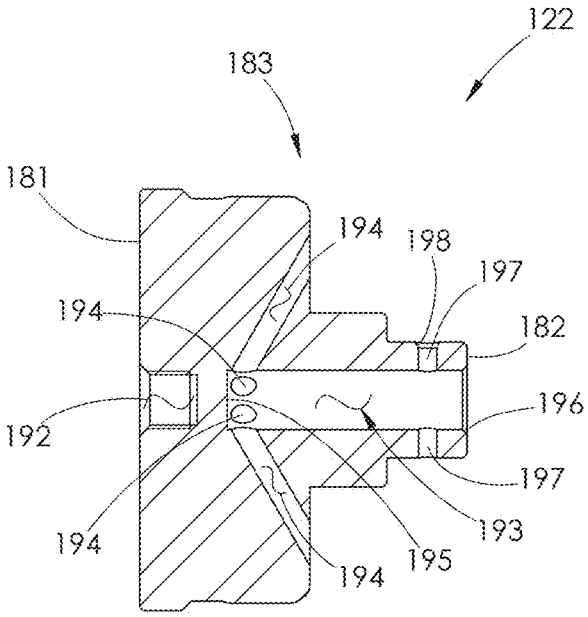
FIG. 24 is a cross-sectional view of the suction plug shown in FIG. 23, taken along line G-G.
Figure 25:
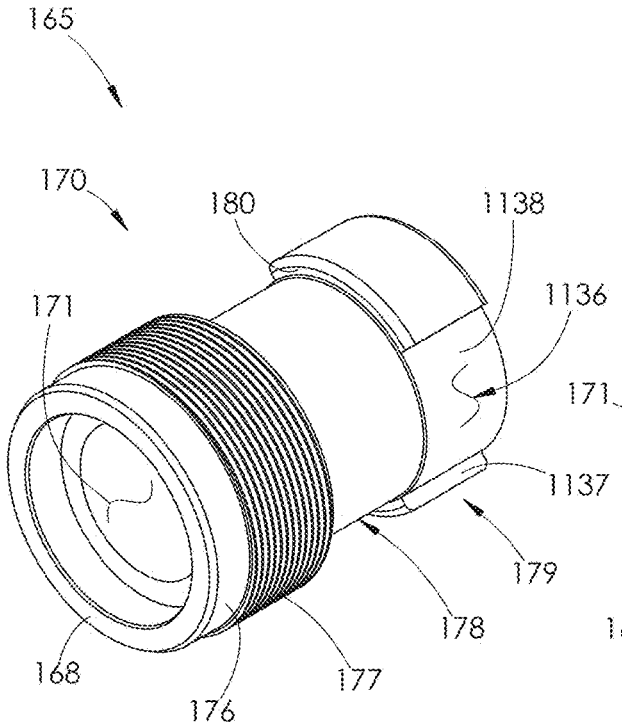
FIG. 25 is a front perspective view of a dynamic section of the fluid end shown in FIG. 1.
Figure 26:
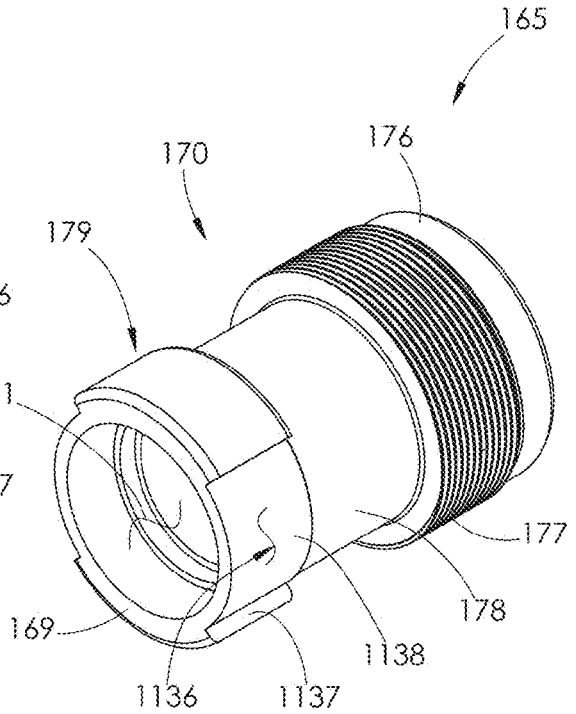
FIG. 26 is a rear perspective view of the dynamic section shown in FIG. 25.
Figure 27:
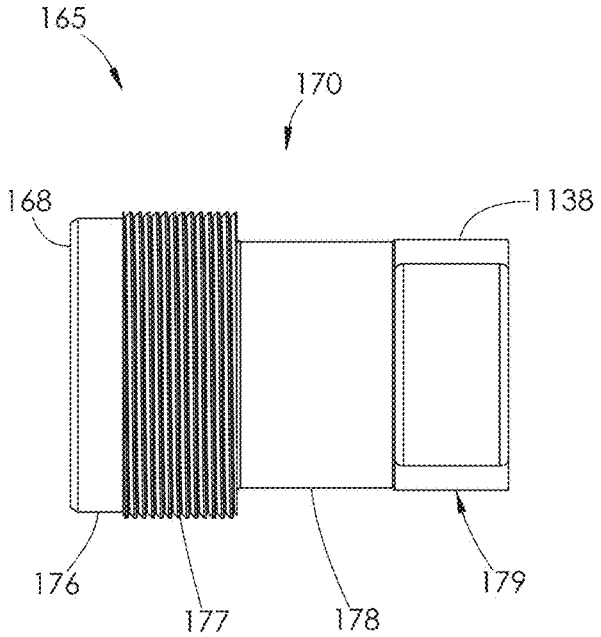
FIG. 27 is a top plan view of the dynamic section shown in FIG. 25.
Figure 28:
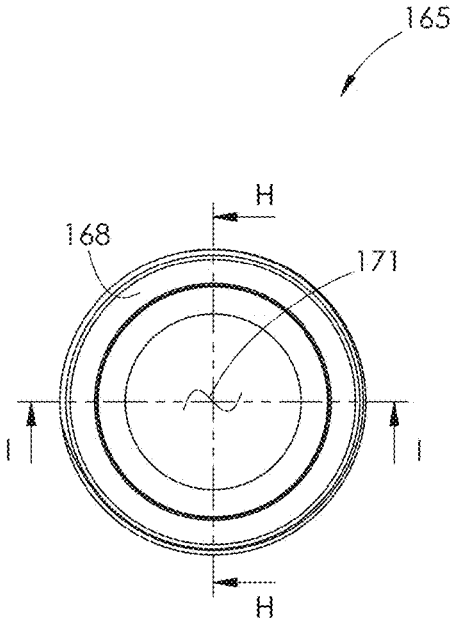
FIG. 28 is a front elevation view of the dynamic section shown in FIG. 25.

Referring now to FIGS. 8 and 10, the discharge bore 127 connects the left 136 and right 137 side surfaces of the front static section 113. The discharge bore 127 also partially intersects each of the plurality of flow bores 125, specifically in the chamber section 132 of each flow bore 125. The discharge bore 127 further comprises a counterbore 138 and countersink 139 at the intersection of the discharge bore 127 and each side surface 136 and 137 to facilitate the connection of discharge fittings (not shown).

Referring now to FIGS. 11-16, the rear static section 114 has the general shape of a rectangular prism comprising a plurality of stay rod through holes 140, a plurality of dynamic section mounting bores 141, and a plurality of rear static section mounting holes 142. When the static section 101 is assembled, the locations of the stay rod through holes 140 align with the stay rod through holes 124 of the front static section 113 on a one-to-one basis. The bore axes of the stay rod through holes 140 are also collinear with the bore axes of each corresponding stay rod through hole 124 on a one-to-one basis.

The dynamic section mounting bores 141 are through bores connecting the front 143 and rear 144 surfaces of the rear static section 114. Each dynamic section mounting bore 141 has an internal thread 145 configured to receive a dynamic section 102. When the static section 101 is assembled, the locations of the dynamic section mounting bores 141 align with the flow bores 125 of the front static section 113 on a one-to-one basis. The bore axes of the dynamic section mounting bores 141 are also collinear with the bore axes of the flow bores 125 on a one-to-one basis.

The rear static section mounting holes 142 are through bores connecting the front 143 and rear 144 surfaces of the rear static section 114. Each rear static section mounting hole 142 has a counterbore opening to the rear surface 144 of the rear static section 114. When the static section 101 is assembled, the locations of the rear static section mounting holes 142 align with the rear static section mounting holes 126 of the front static section 113 on a one-to-one basis. The bore axes of the rear static section mounting holes 142 are also collinear with the bore axes of the rear static section mounting holes 126 of the front static section 113.

Figure 35:
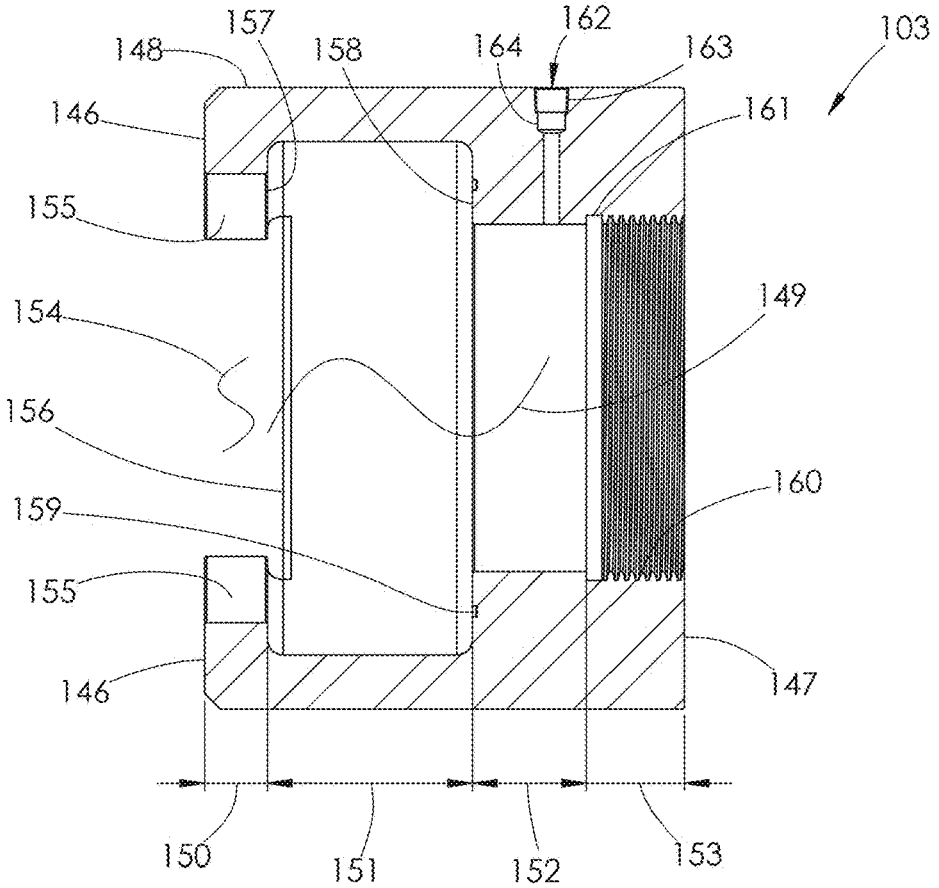
FIG. 35 is a cross-sectional view of the retainer shown in FIG. 34, taken along line J-J.
Figure 36:
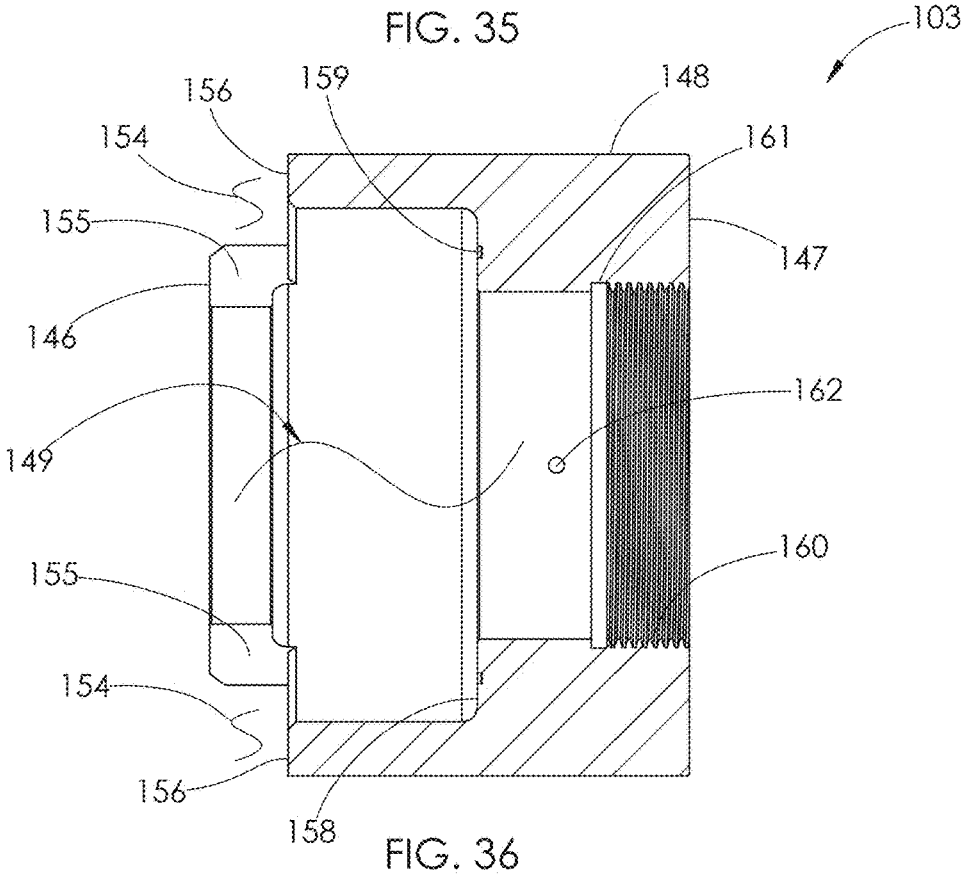
FIG. 36 is a cross-sectional view of the retainer shown in FIG. 34, taken along line K-K.
Figure 37:
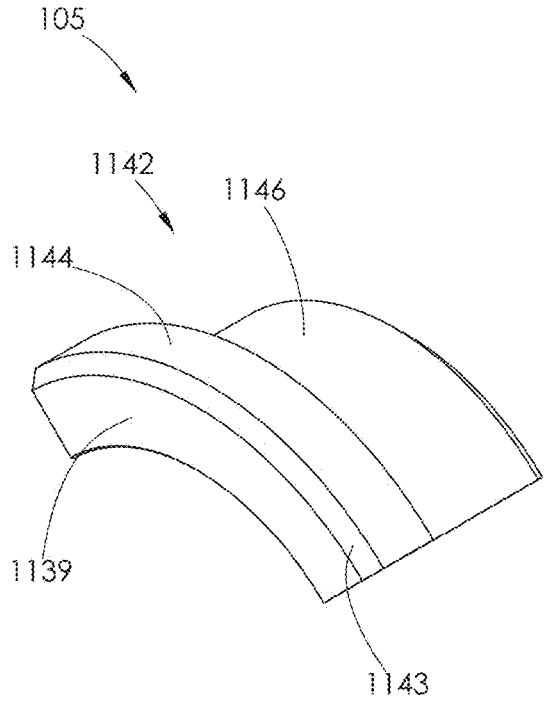
FIG. 37 is a front perspective view of a retainer lock of the fluid end shown in FIG. 1.
Figure 38:
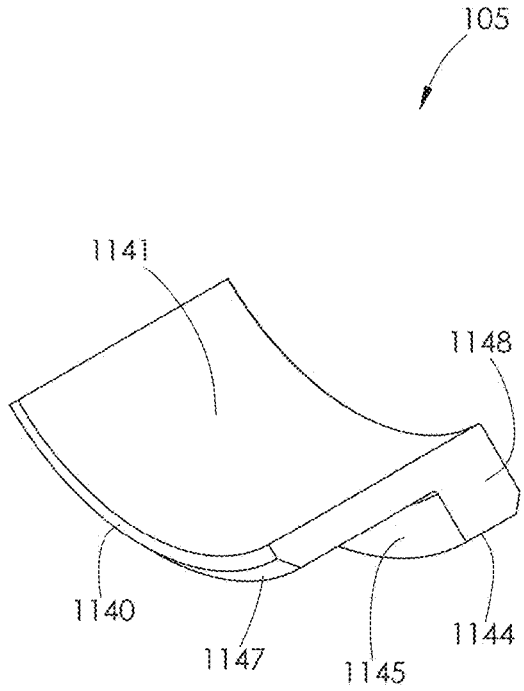
FIG. 38 is a bottom rear perspective view of the retainer lock shown in FIG. 37.
Figure 39:
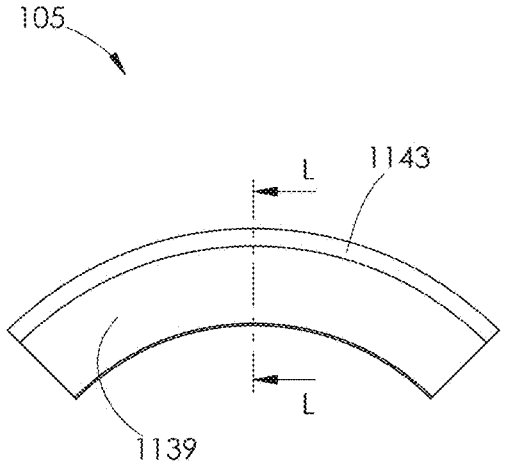
FIG. 39 is a front elevation view of the retainer lock shown in FIG. 37.
Figure 40:
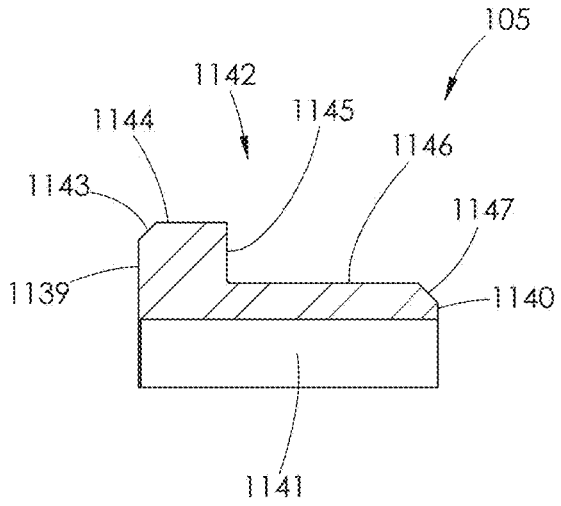
FIG. 40 is a cross-sectional view of the retainer lock shown in FIG. 39, taken along line L-L.
Figure 41:
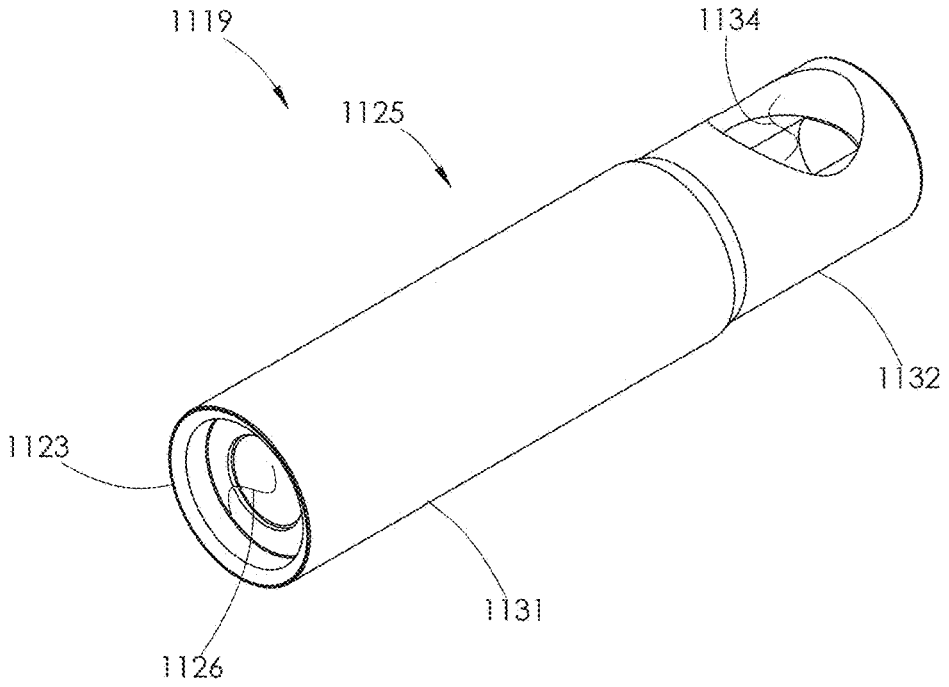
FIG. 41 is a front perspective view of a plunger of the fluid end shown in FIG. 1.
Figure 42:
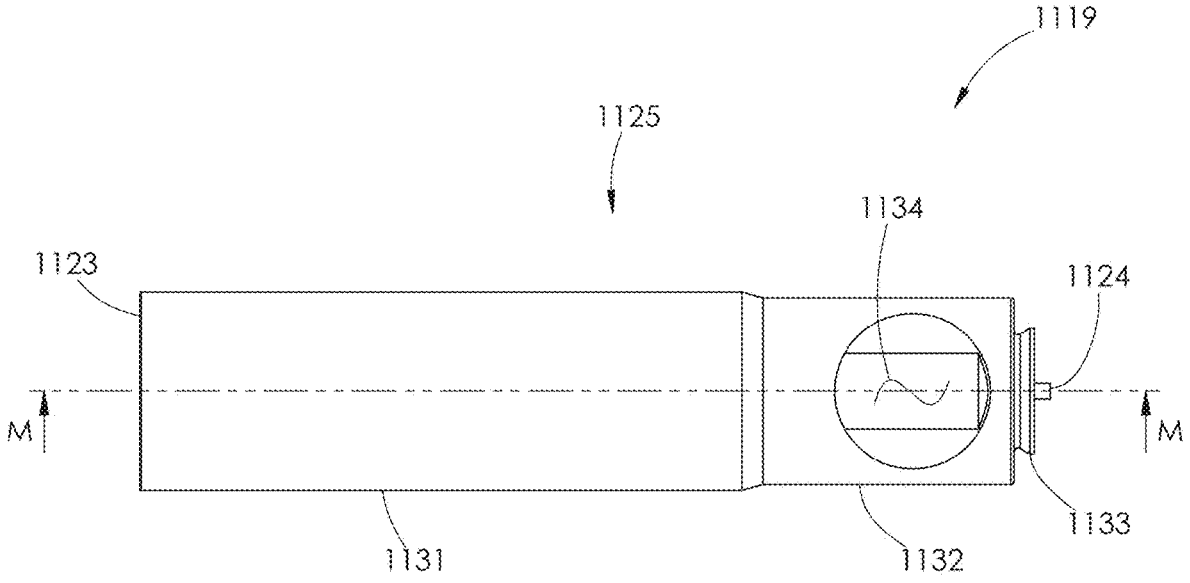
FIG. 42 is a top plan view of the plunger shown in FIG. 41.
Figure 43:
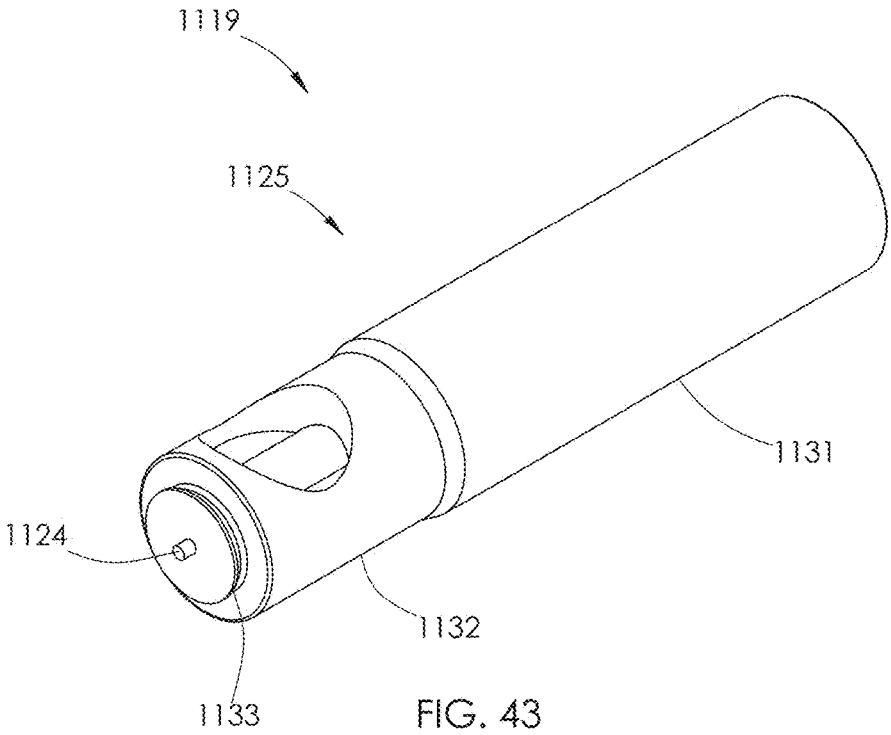
FIG. 43 is a rear perspective view of the plunger shown in FIG. 41.
Figure 44:
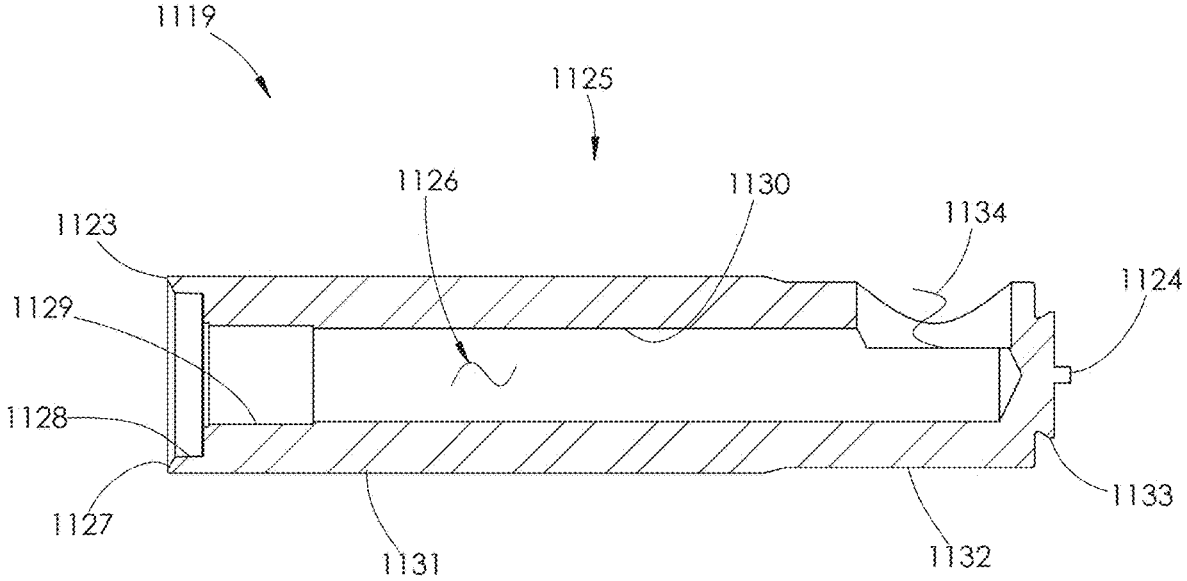
FIG. 44 is a cross-sectional view of the plunger shown in FIG. 42, taken along line M-M.
Figure 45:
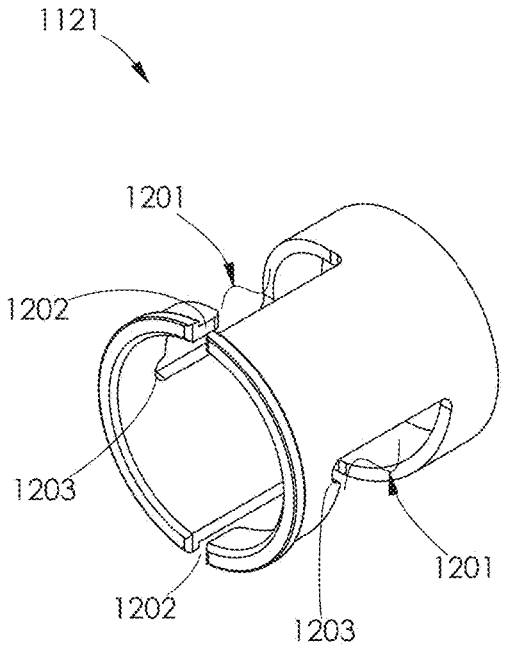
FIG. 45 is a front perspective view of a sleeve of the fluid end shown in FIG. 1.
Figure 46:
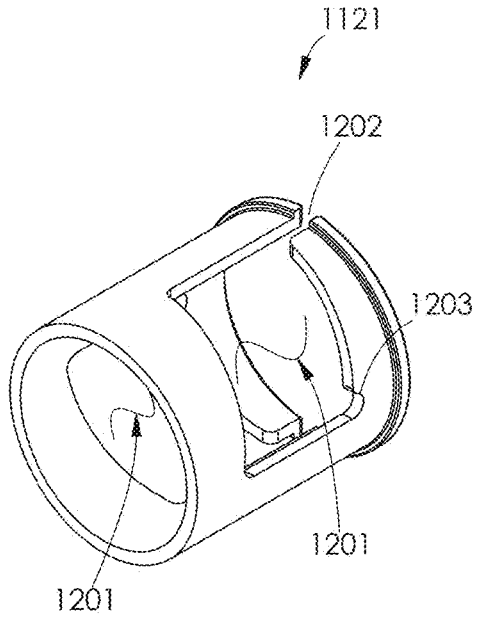
FIG. 46 is a rear perspective view of the sleeve shown in FIG. 45.
Figure 47:
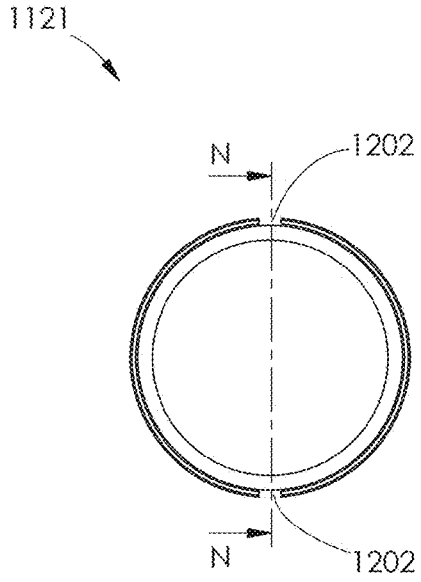
FIG. 47 is a front elevation view of the sleeve shown in FIG. 45.
Figure 48:
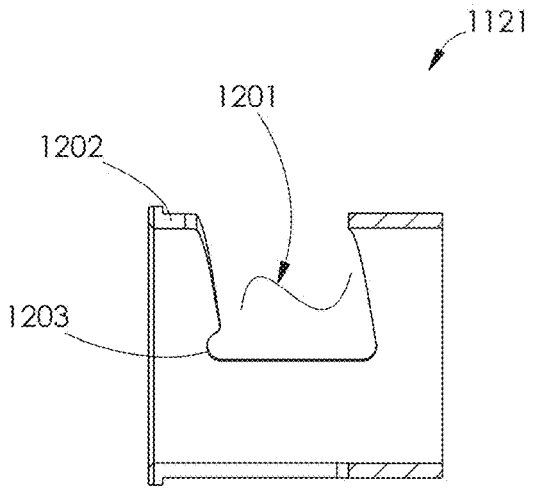
FIG. 48 is a cross-sectional view of the sleeve shown in FIG. 47, taken along line N-N.

Referring now to FIGS. 31-36, the retainer 103 has a generally cylindrical shape comprising opposed front 146 and rear 147 surfaces connected by an intermediate outer surface 148. The retainer 103 further comprises a through bore 149 that also connects the front 146 and rear 147 surfaces. The bore axis of the through bore 149 is collinear with the longitudinal axis of the retainer 103. Beginning at the front surface 146 and continuing along the bore axis to the rear surface 147, each through bore 149 comprises a retainer flange section 150, dynamic flange section 151, a packing section 152, and a packing nut section 153, as shown in FIG. 35.

The retainer flange section 150 comprises a plurality of cutouts 154. In this embodiment there are two cutouts 154, however there may be more if desired. Since the diameter of the retainer flange section 150 of the through bore 149 is smaller than that of the dynamic flange section 151, the cutouts 154 only modify the retainer flange section 150. Radially, each cutout 154 removes the entire portion of the retainer 103 from the through bore 149 radially outward to the intermediate outer surface 148, leaving a radial wall 155 at the radial limits of each cutout 154, that is two for each cutout 154. Longitudinally, the cutout 154 begins at the front surface 146, continues through the entire length of the retainer flange section 150 and ends within the dynamic flange section 151, leaving a cutout surface 156 at the longitudinal limit of each cutout 154.

The dynamic flange section 151 of the through bore 149 has a larger diameter than each adjacent section, thus creating a front shoulder 157 and rear shoulder 158. The rear shoulder 158 further comprises a seal groove 159.

The packing nut section 153 comprises an internal thread 160 originating at the rear surface 147 of the retainer 103. The packing nut section 153 further comprises a thread relief 161 adjacent the packing section 152 and the internal thread 160.

The retainer 103 further comprises a lubrication port 162 connecting the intermediate outer surface 148 to the packing section 152 of the through bore 149. The lubrication port 162 may have internal threads 163 and/or a counterbore 164 configured to accept a lubrication fitting (not shown) as needed.

Figure 29:
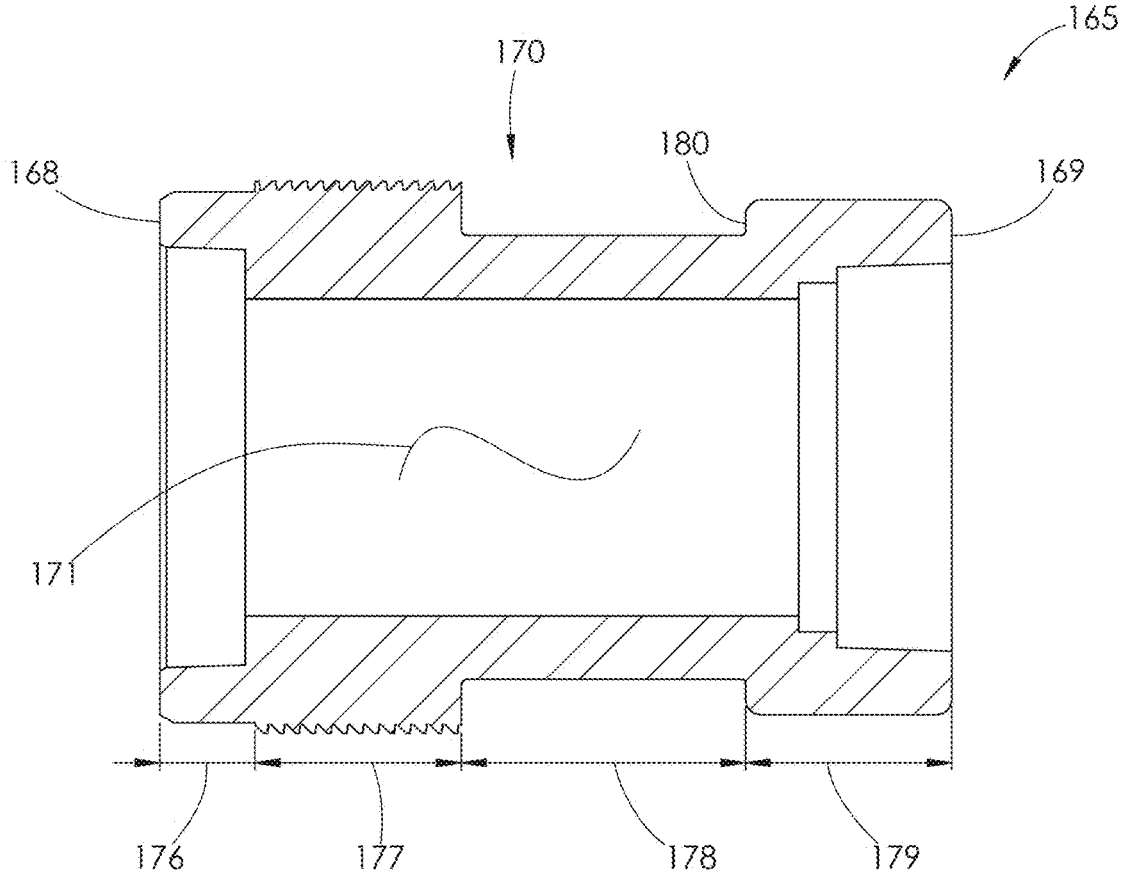
FIG. 29 is a cross-sectional view of the dynamic section shown in FIG. 28, taken along line H-H.
Figure 30:
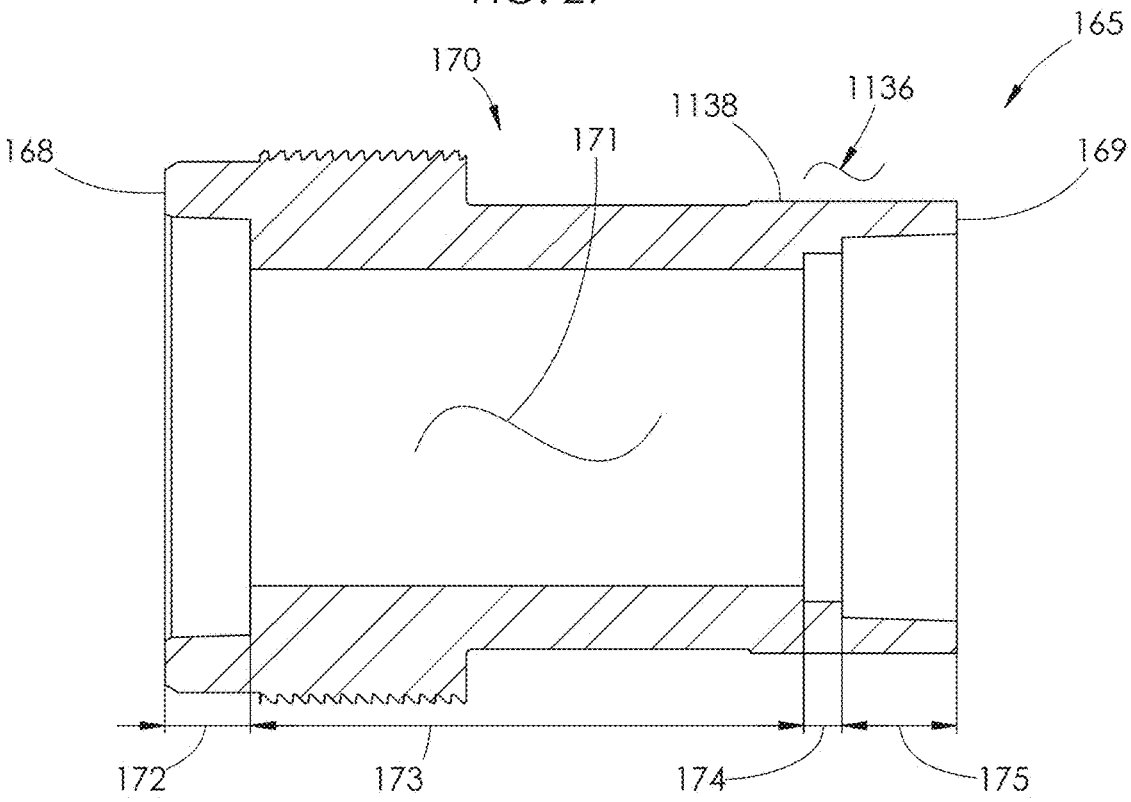
FIG. 30 is a cross-sectional view of the dynamic section shown in FIG. 28, taken along line I-I.
Figure 31:
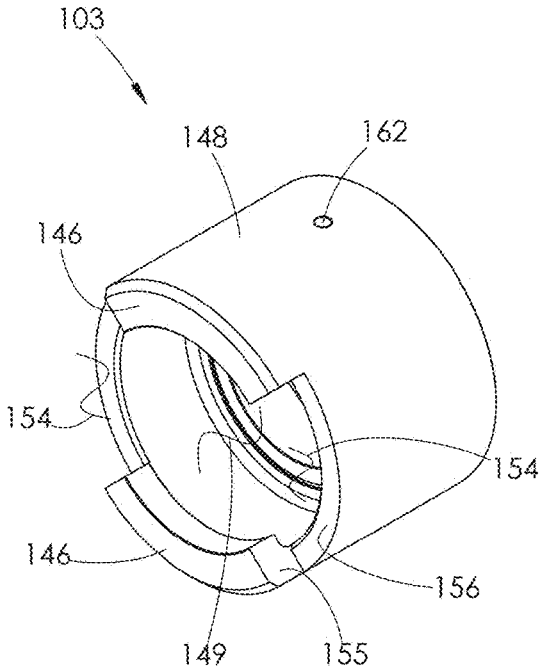
FIG. 31 is a front perspective view of a retainer of the fluid end shown in FIG. 1.
Figure 32:
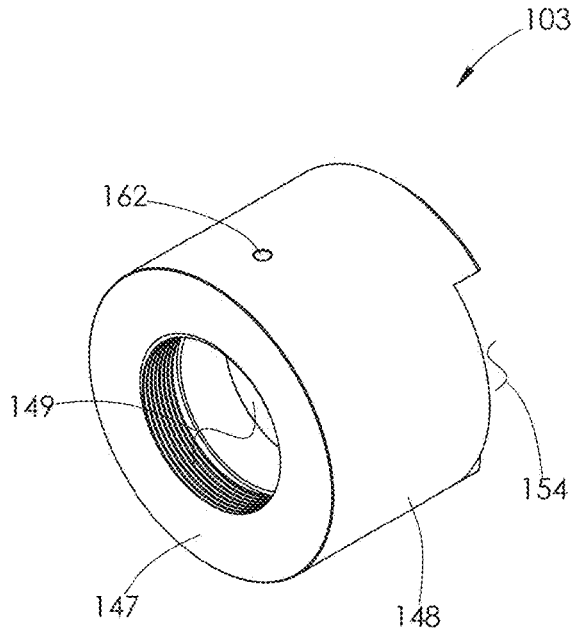
FIG. 32 is a rear perspective view of the retainer shown in FIG. 31.
Figure 33:
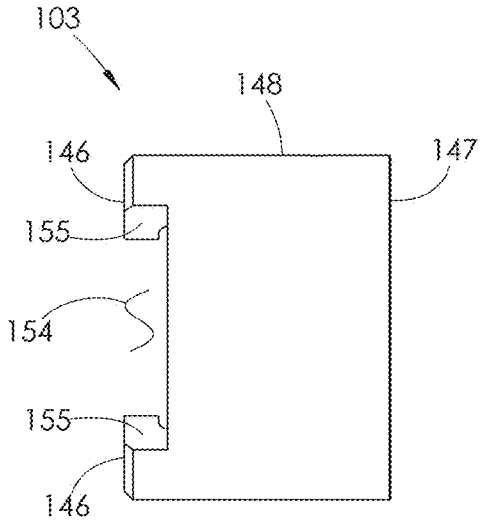
FIG. 33 is a right-side elevation view of the retainer shown in FIG. 31.
Figure 34:
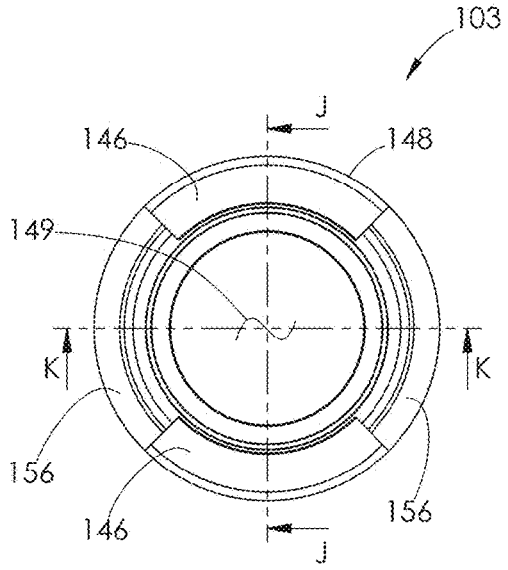
FIG. 34 is a front elevation view of the retainer shown in FIG. 31.
Figure 62:
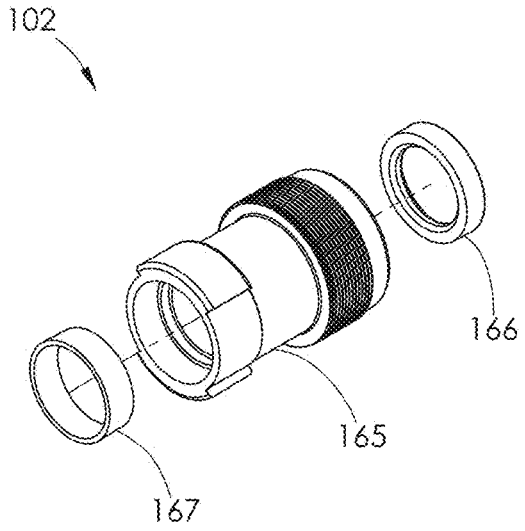
FIG. 62 is a rear perspective and exploded view showing the assembly of the dynamic section of the fluid end shown in FIG. 1.

Referring now to FIGS. 55 and 62, each dynamic section 102 comprises a dynamic section body 165, a discharge valve seat 166, and a wear sleeve 167. Referring now to FIGS. 25-30 the dynamic section body 165 has a generally cylindrical shape comprising opposed front 168 and rear 169 surfaces connected by an intermediate outer surface 170. The dynamic section body 165 further comprises a through bore 171 that also connects the front 168 and rear 169 surfaces. The bore axis of the through bore 171 is collinear with the longitudinal axis of the dynamic section body 165. Beginning at the front surface 168 and continuing along the bore axis to the rear surface 169, each through bore 171 comprises a discharge valve seat section 172, a plunger section 173, a packing section 174, and a wear sleeve section 175, as shown in FIG. 30. The wear sleeve section 175 may not be present if no wear sleeve 167 is used. If no wear sleeve section 175 is present, the packing section 174 will extend to the rear surface 169.

The intermediate outer surface 170 also has areas with different features. Beginning at the front surface 168 and continuing to the rear surface 169, each intermediate outer surface 170 comprises a dynamic seal section 176, an external thread 177, a retainer flange relief section 178, and a dynamic flange section 179. The retainer flange relief section 178 has a smaller diameter than dynamic flange section 179, thus forming a rear shoulder 180 as part of the retainer flange relief section 178, as shown in FIG. 29.

The dynamic flange section 179 comprises a plurality of cutouts 1136. In this embodiment, there are two cutouts 1136 to match the number of cutouts 154 in the retainer 103. Since the diameter of the dynamic flange section 179 is larger than that of the retainer flange relief section 178, the cutouts 1136 only modify the dynamic flange section 179. Radially, each cutout 1136 removes only a portion of the dynamic flange section 179 from the intermediate outer surface 170 down, that is radially, toward the longitudinal axis of the dynamic section body 165, but not all the way through to the through bore 171. The cutouts 1136 thus form a radial wall 1137 at the radial limits of each cutout 1136, that is two for each cutout 1136. Longitudinally, the cutout 1136 begins at the rear surface 169 and continues through the entire length of the dynamic flange section 179. The radial depth of the cutouts 1136 is such that the rear shoulder 180 height is reduced, but the rear shoulder 180 is not eliminated. The cutouts 1136 also form a cutout surface 1138 that is the radial base of the cutout 1136 with a diameter smaller than the diameter of the dynamic flange section 179.

Referring now to FIGS. 37-40, the retainer lock 105 has the general shape of a quarter cylindrical section and comprises opposed front 1139 and rear surfaces 1140 connected by intermediate inner 1141 and outer 1142 surfaces. Beginning at the front surface 1139 and continuing along the longitudinal axis of the retainer lock 105 to the rear surface 1140, the intermediate outer surface 1142 comprises a front chamfer 1143, a retainer section 1144, a limit shoulder 1145, a dynamic section 1146, and a rear chamfer 1147. The diameter of the retainer section 1144 is the same as the diameter of the intermediate outer surface 148 of the retainer 103. The diameter of the dynamic section 1146 is the same as the diameter of the dynamic flange section 179 of the intermediate outer surface 170 of the dynamic section body 165. The diameter of the intermediate inner surface 1141 is the same, or nearly the same, as the cutout surface 1138 of the cutout 1136 in the dynamic flange section 179 of the intermediate outer surface 170 of the dynamic section body 165. The retainer lock 105 further comprises a plurality of radial walls 1148. An alternative embodiment of the retainer lock may include a threaded hole and fastener, or other apparatus, to lock the retainer lock in position after assembly.

Referring now to FIGS. 21-24, the discharge plug 122 has a generally cylindrical shape comprising opposed front 181 and rear 182 surfaces connected by an intermediate outer surface 183. Beginning at the front surface 181 and continuing along the longitudinal axis to the rear surface 182, the intermediate outer surface 183 comprises outer limit section 184, a stop bevel 185, an assembly clearance section 186, a sealing section 187, a relief bore shoulder 188, a flow clearance section 189, a spring shoulder 190 and a spring section 191.

The discharge plug 122 further comprises a threaded tool bore 192 centered on the front surface 181.

The discharge plug 122 further comprises a blind valve stem bore 193 centered on and originating from the rear surface 182 and extending along the longitudinal axis to a depth coinciding with the approximate longitudinal position of the assembly clearance section 186 on the intermediate outer surface 183. The valve stem bore 193 may have a countersink 196 to facilitate assembly of the discharge valve 120 if desired.

The discharge plug 122 further comprises a plurality of relief bores 194 connecting the relief bore shoulder 188 to the valve stem bore 193. The relief bores 194 help alleviate accumulation and build-up of particulates and proppants within the valve stem bore 193. In this embodiment, there are six relief bores 194 spaced evenly circumferentially, but there may be more or less spaced intermittently if desired. Each relief bore 194 is angled from the longitudinal axis of the discharge plug 122 such that the relief bore 194 intersects the valve stem bore 193 adjacent the base 195 of the valve stem bore 193. The angle of the relief bore 194 may be adjusted as necessary depending on the spatial relationship between the relief bore shoulder 188 and the base 195 of the valve stem bore 193.

The discharge plug 122 further comprises a dowel pin bore 197. The dowel pin bore 197 is perpendicular to and intersects the longitudinal axis of the discharge plug 122. The dowel pin bore 197 is longitudinally positioned such that it intersects the intermediate outer surface 183 in the spring section 191. The dowel pin bore 197 also intersects the valve stem bore 193. The dowel pin bore 197 may have a countersink 198 to facilitate the insertion of the dowel pin 123.

Referring now to FIGS. 17-20, the discharge valve 120 comprises a valve insert 199 and opposed front 1100 and rear 1101 surfaces connected by an intermediate outer surface 1102. Beginning at the front surface 1100 and continuing along the longitudinal axis of the discharge valve 120 to the rear surface 1101, the intermediate outer surface 1102 comprises an insert profile 1103, a spring shoulder 1104, and a stem section 1105. The spring shoulder 1104 comprises a spring groove 1106. The discharge valve 120 further comprises a dowel slot 1107. The dowel slot 1107 aids in installation and alignment, as discussed herein. The dowel slot 1107 is perpendicular to and intersects the longitudinal axis of the discharge valve 120. The dowel slot 1107 extends completely through the discharge valve 120. The dowel slot 1107 is located longitudinally on the stem section 1105. In this embodiment, the longitudinal location of the dowel slot 1107 is proximate the spring shoulder 1104 but may be located anywhere along the stem section 1105 as long as the entire dowel slot 1107 is contained within the stem section 1105.

Figure 49:
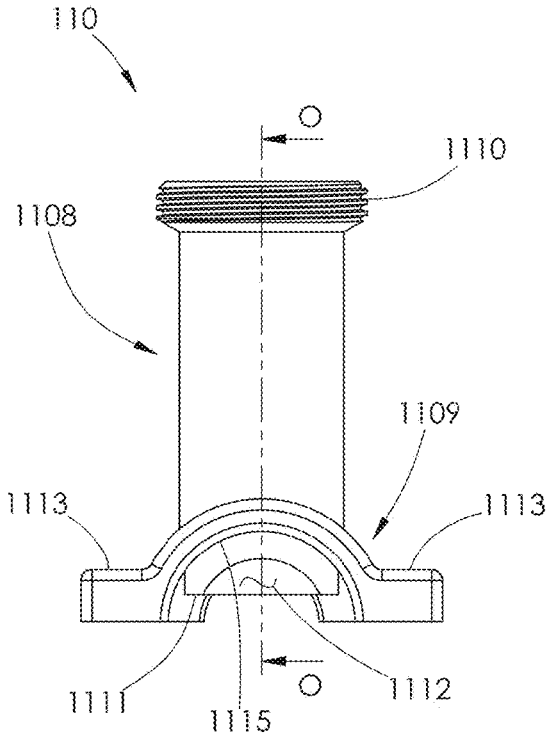
FIG. 49 is a front elevation view of a top plunger suction fitting of the fluid end shown in FIG. 1.
Figure 50:
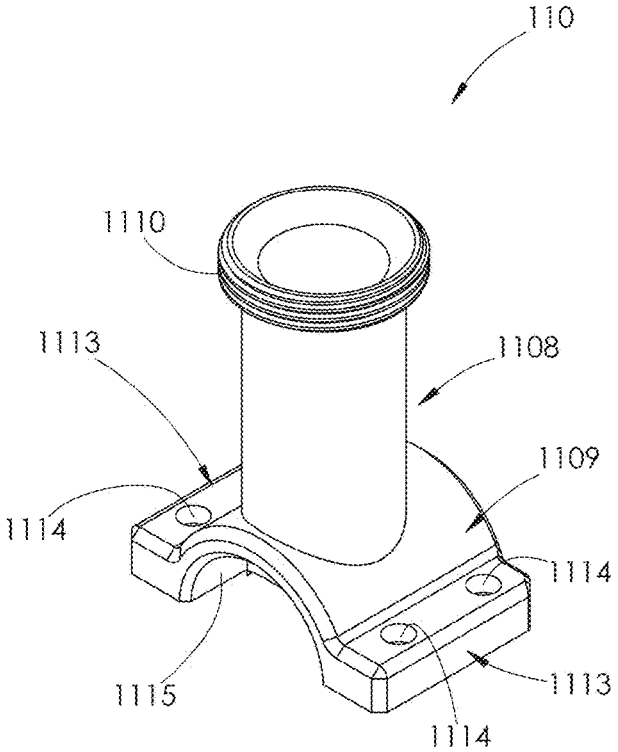
FIG. 50 is a front perspective view of the top plunger suction fitting shown in FIG. 49.
Figure 51:
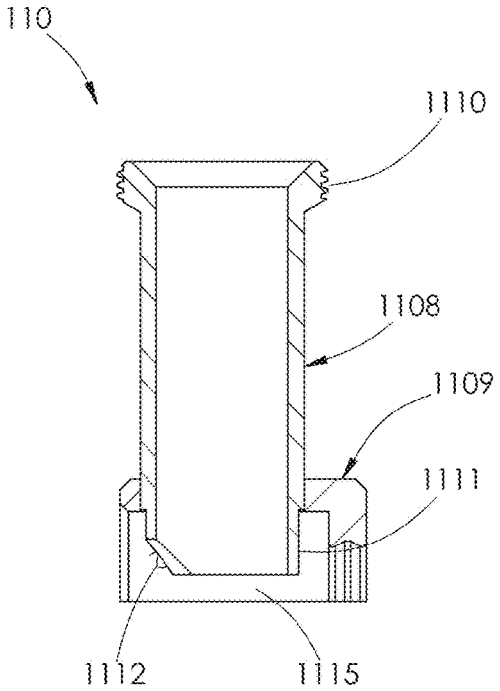
FIG. 51 is a cross-sectional view of the top plunger suction fitting shown in FIG. 49, taken along line O-O.

Referring now to FIGS. 49-51, the top plunger suction fitting no comprises a riser section 1108 and a clamp section 1109. The riser section 1108 comprises an external thread 1110 and an insert section 1111. The insert section 1111 has a flow relief notch 1112. The clamp section 1109 comprises a plurality of attachment flanges 1113 with a plurality of fastener through holes 1114 and in internal profile 1115 that is complementary to the plunger assembly 107.

Figure 52:
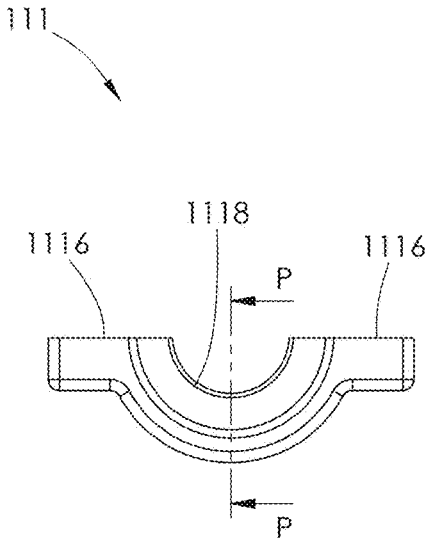
FIG. 52 is a front elevation view of a bottom plunger suction fitting of the fluid end shown in FIG. 1.
Figure 53:
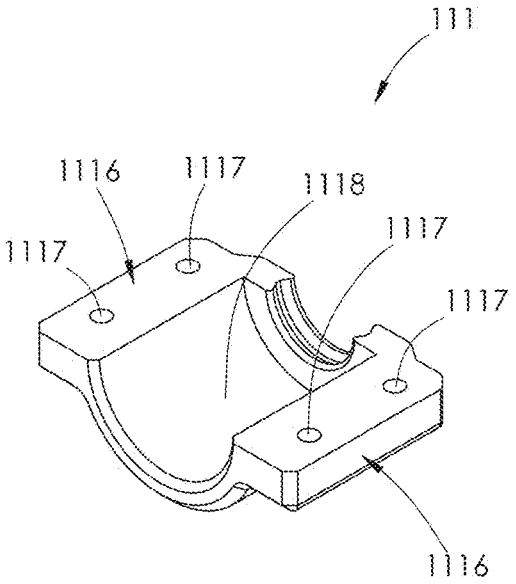
FIG. 53 is a front perspective view of the bottom plunger suction fitting shown in FIG. 52.
Figure 54:
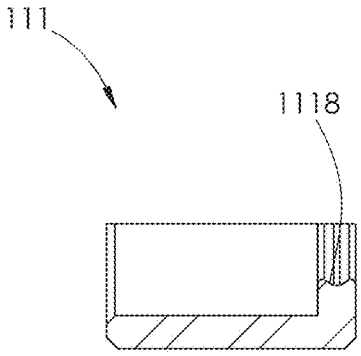
FIG. 54 is a cross-sectional view of the bottom plunger suction fitting shown in FIG. 52, taken along line P-P.

Referring now to FIGS. 52-54, the bottom plunger suction fitting 111 comprises a plurality of attachment flanges 1116 with a plurality of threaded fastener through holes 1117. The bottom plunger suction fitting 111 also comprises an internal profile 1118 that is identical to the internal profile 1115 of the top plunger suction fitting 110.

Turning now to FIGS. 57-60 and 72-74, the plunger assembly 107 and its internal components are shown in greater detail. The plunger assembly 107 comprises a plunger body, or plunger 1119, a suction valve seat 1120, a sleeve 1121, and a suction valve assembly 1183.

The suction valve assembly 1183 comprises a valve body 1184, a valve retention system 1122, and a valve return system 1185. The suction valve seat 1120 may be formed of a hardened material such as tungsten carbide. Such material resists wear and erosion, significantly extending the life of the suction valve seat 1120.

Referring now to FIGS. 41-44 the plunger 1119 is generally cylindrically shaped and comprises opposed front 1123 and rear 1124 surfaces connected by an intermediate outer surface 1125. The plunger 1119 further comprises a suction bore 1126. The suction bore 1126 is a blind bore that originates on the front surface 1123 and terminates proximate the rear surface 1124. Beginning at the front surface 1123 and continuing along the bore axis to the rear surface 1124 of the plunger 1119, the suction bore 1126 comprises a suction valve seat countersink 1127, a suction valve seat counterbore 1128, a sleeve counterbore 1129, and a flow bore section 1130. Beginning at the front surface 1123 and continuing along the longitudinal axis of the plunger 1119 to the rear surface 1124, the intermediate outer surface 1125 comprises a packing section 1131, a suction fitting section 1132, and a pony rod clamp section 1133. The plunger 1119 further comprises a suction fitting bore 1134. The suction fitting bore 1134 is perpendicular to the longitudinal axis of the plunger 1119. The suction fitting bore 1134 originates from the intermediate outer surface 1125 and terminates once it intersects the flow bore section 1130 of the suction bore 1126.

The valve body 1184 has opposed front and rear surfaces 1186 and 1187. A sealing surface 1188 is formed at the rear surface 1187 of the valve body 1184 that corresponds with a tapered front surface 1189 of the suction valve seat 1120. A socket connection 1190 is formed on the front surface 1186 of the valve body 1184.

The valve retention system 1122 comprises an elongate stem 1191 installed within a retainer 1192. The retainer 1192 comprises a central support 1193 joined to two tabs 1194. The central support 1193 has a length that allows the central support 1193 to engage the rear surface 1187 of the valve body 1184. The stem 1191 has a square cross-section that corresponds to a central passage 1195 formed in the central support 1193 also having a square cross-section. The stem 1191 is thus installed within the central passage 1195. The square cross-sections prevent the stem 1191 from rotating when the valve assembly 1183 is installed within the plunger 1119. A first end 1196 of the stem 1191 is attached to the valve body 1184, while an opposed second end 1197 of the stem 1191 is attached to a valve return system 1185.

The valve return system 1185 comprises a spring stop 1198, a spring 1199, and a retainer pin 1200. The spring 1199 is disposed around the second end 1197 of the stem 1191 and the spring stop 1198 is attached to the second end 1197 of the stem 1191 via the retainer pin 1200. The spring 1199 is thus situated on the stem 1191 between the spring stop 1198 and the central support 1193 of the retainer 1192. When the suction valve assembly 1183 is assembled, the retainer 1192 rotates with the stem 1191, but is free to move longitudinally along the stem 1191. The valve body 1184 and the stem 1191 may be formed as a single, integrally formed piece, as shown in the Figures.

The valve retention system 1122 is held within the plunger 1119 using the sleeve 1121. The sleeve 1121 is sized to fit within the plunger 1119 rearward of the suction valve seat 1120, in the sleeve counterbore 1129. The sleeve 1121 may be press-fit or interference fit within the plunger 1119. Preferably, the sleeve 1121 is lightly press-fit into the plunger 1119 and is held in place by the tightly press-fitted suction valve seat 1120. The sleeve 1121 is tubular with opposed end surfaces and comprises opposed openings 1201 formed in the walls of the sleeve 1121. Each opening 1201 includes an installation slot 1202 and a relief notch 1203, as shown in FIGS. 45-48.

To install the valve retention system 1122 within the plunger 1119, the valve retention system 1122 is inserted into the plunger 1119 and the sleeve 1121 such that each tab 1194 passes through a corresponding one of the installation slots 1202. Once a tab 1194 is within the corresponding opening 1201, the valve retention system 1122 is rotated relative to the sleeve 1121 until each tab 1194 is forced into one of the corresponding one of the relief notches 1203. The valve retention system 1122 may be turned or rotated using a tool (not shown) installed within the socket connection 1190 formed in the valve body 1184.

The valve retention system 1122 is configured such that the spring 1199 of the valve return system 1185 is always at least partially compressed between the retainer 1192 and the spring stop 1198 of the valve return system 1185. When the valve retention system 1122 is installed within the sleeve 1121, the spring 1199 is further compressed as the tabs 1194 rotate within the corresponding openings 1201. Once the tabs 1194 are forced into the corresponding relief notches 1203, the spring 1199 is still compressed and exerts a force against the bottom of the retainer 1192, thereby holding the tabs 1194 within the corresponding relief notches 1203 and retaining the suction valve assembly 1183 within the sleeve 1121 and the plunger 1119. During operation, the stem 1191 and valve body 1184 move relative to the retainer 1192, the sleeve 1121, and the plunger 1119.

Figure 61:
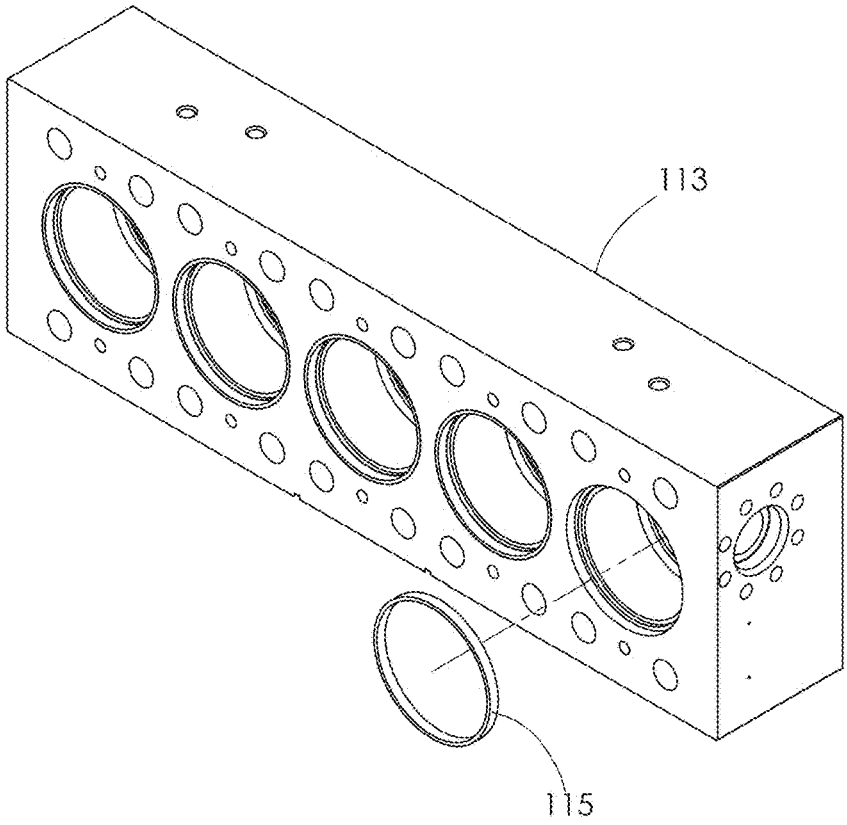
FIG. 61 is a rear perspective and exploded view showing partial assembly of a front static section of the fluid end shown in FIG. 1.
Figure 63:
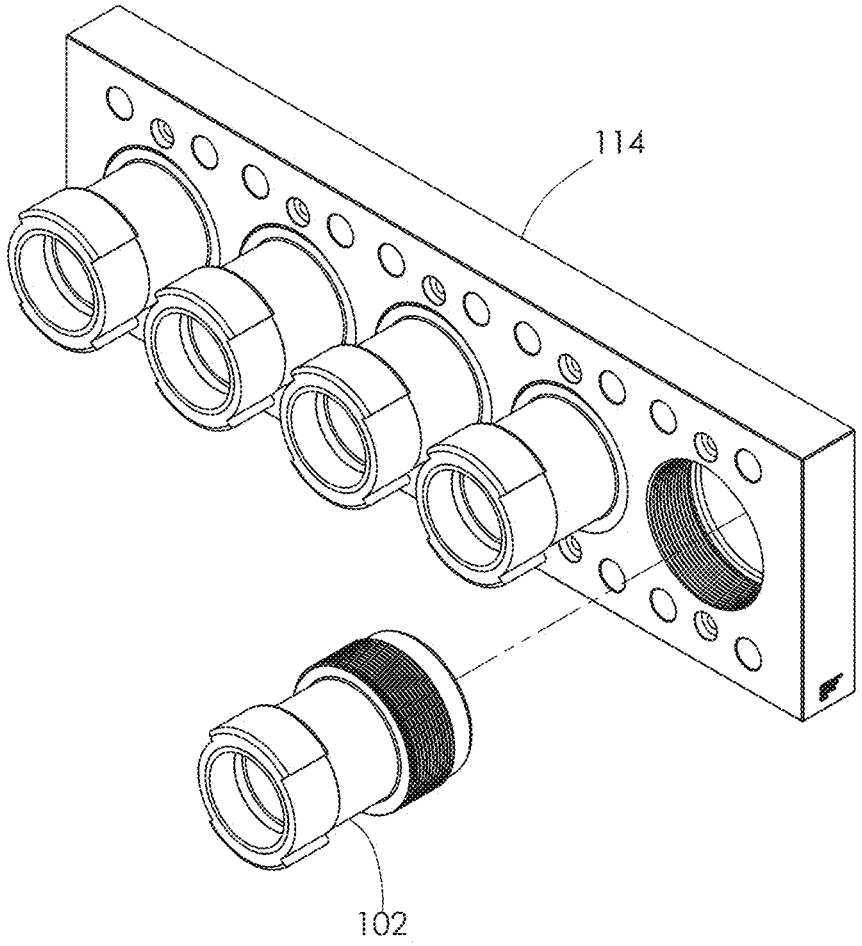
FIG. 63 is a rear perspective and exploded view showing the assembly of the dynamic section to the rear static section of the fluid end shown in FIG. 1.

Referring now to FIGS. 55-80, the assembly of the fluid end 100 will be discussed. First, the dynamic seals 115 are installed in the dynamic seal counterbores 134 of the flow bores 125 of the front static section 113 of the static section 101, as shown in FIGS. 55 and 61. Second, the dynamic sections 102 are assembled by pressing the discharge valve seats 166 into the discharge valve seat sections 172 of the through bores 171 of each dynamic section body 165 and pressing the wear sleeve 167 into the wear sleeve sections 175 of the through bores 171, as shown in FIGS. 29 and 62. Third, each dynamic section 102 is threaded into an internal thread 145 of a dynamic section mounting bore 141 of the rear static section 114 until the dynamic seal sections 176 protrude from the front surface 143 enough to fully engage the dynamic seals 115, as shown in FIGS. 29, 55 and 63.

Figure 64:
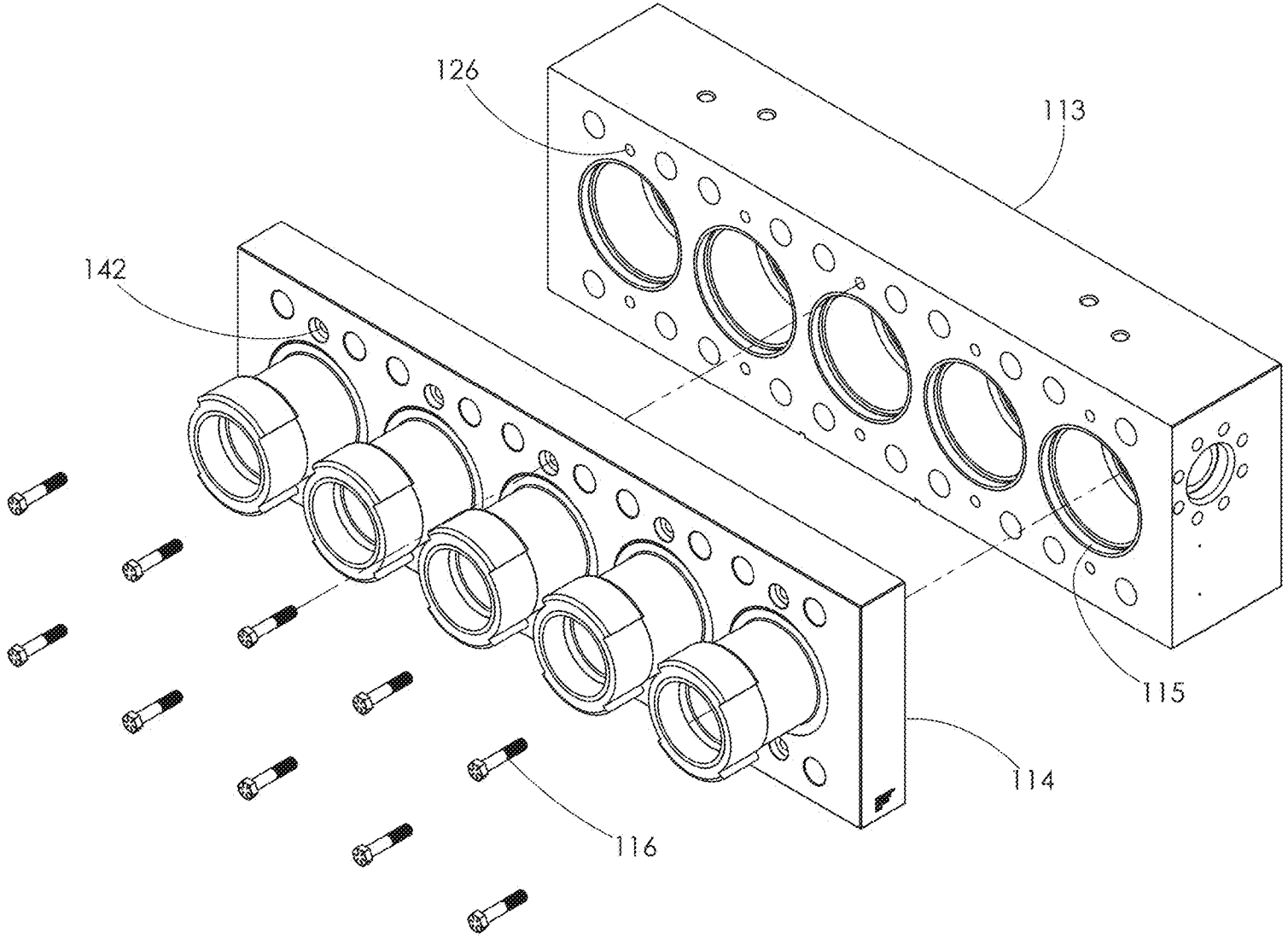
FIG. 64 is a rear perspective and exploded view showing the assembly of the rear static section to the partially assembled front static section of the fluid end shown in FIG. 1.

Fourth, the protruding dynamic seal sections 176 are aligned with the dynamic seals 115 already installed in the front static section 113, and the front surface 143 of the rear static section 114 is abutted to the rear surface 129 of the front static section 113 while simultaneously inserting the dynamic seal sections 176 into the dynamic seals 115, as shown in FIGS. 55 and 64. Fifth, the static section connectors 116 are inserted into the rear static section mounting holes 142 of the rear static section 114 and threaded into the rear static section mounting holes 126 of the front static section 113, then torqued to specification, as shown in FIGS. 55 and 64. Sixth, each dynamic section 102 is threaded further into the internal thread 145 of the dynamic section mounting bore 141 it is already installed in until the front surface 168 of the dynamic section body 165 abuts the base 1135 of the dynamic seal counterbore 134, as shown in FIG. 55. Seventh, the retainer seals 104 are inserted into the seal grooves 159 in the rear shoulders 158 of the dynamic flange sections 151 of the through bores 149 of each retainer 103, as shown in FIGS. 35, 55 and 65.

Figure 65:
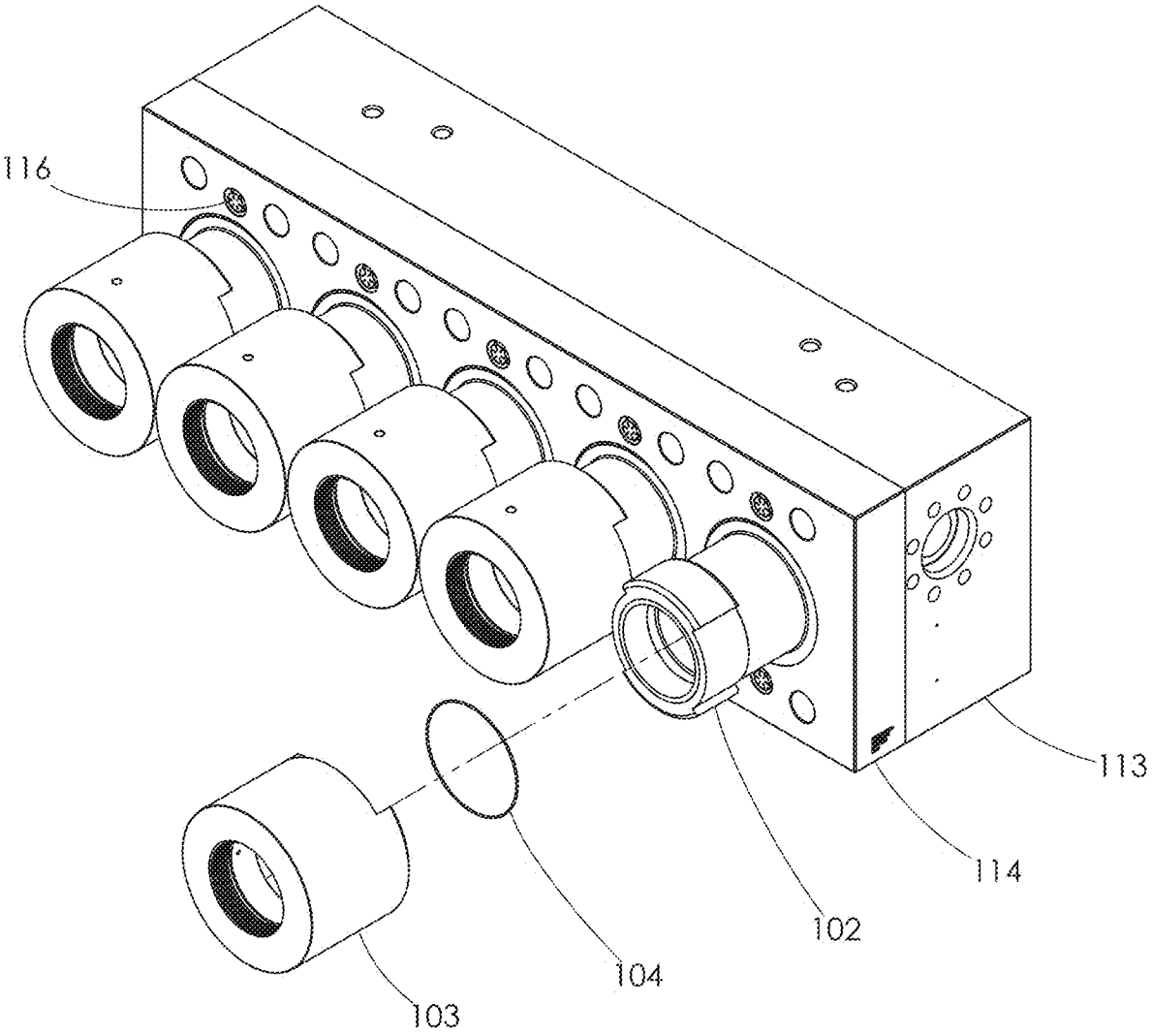
FIG. 65 is a rear perspective and exploded view showing the assembly of the retainer to the dynamic section of the fluid end shown in FIG. 1.
Figure 66:
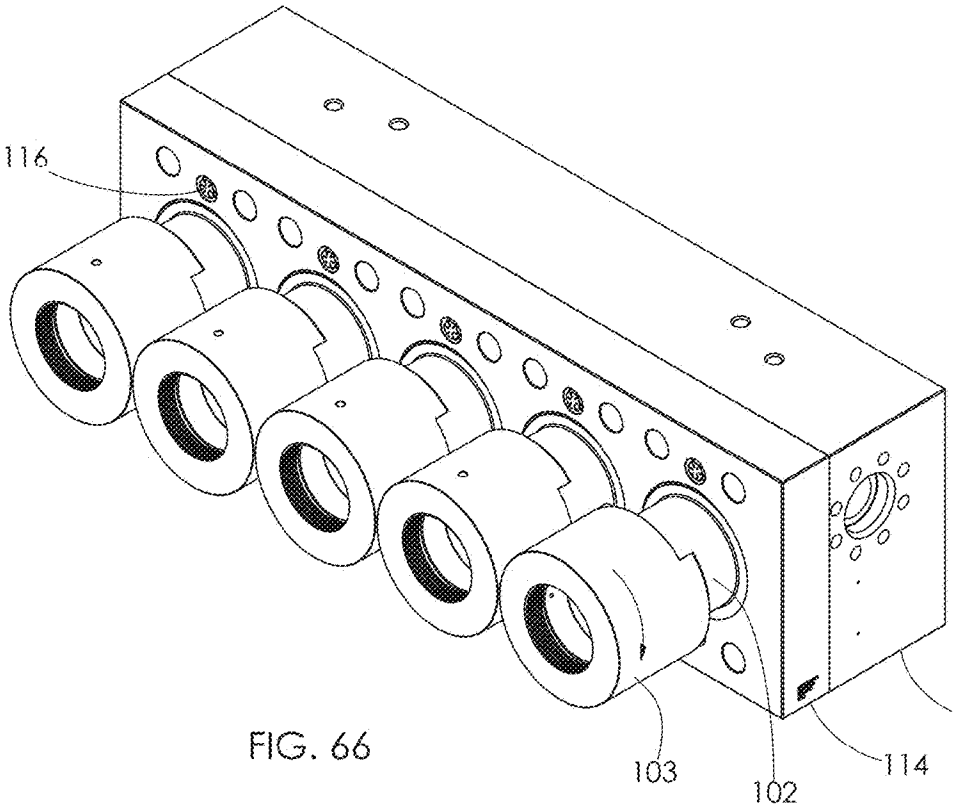
FIG. 66 is a rear perspective view showing the retainer initially installed on the dynamic section of the fluid end shown in FIG. 1.
Figure 68:
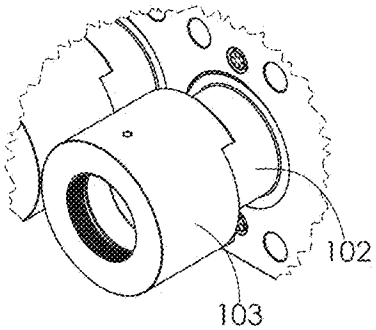
FIG. 68 is a rear perspective cutout view showing the retainer in the fully rotated position on the dynamic section of the fluid end shown in FIG. 1.
Figure 67:
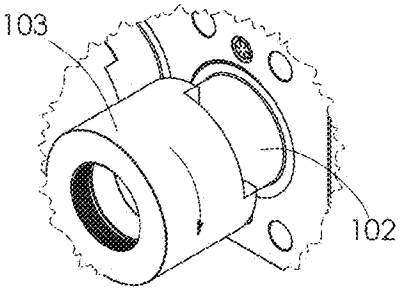
FIG. 67 is a rear perspective cutout view showing the retainer partially rotated about the dynamic section of the fluid end shown in FIG. 1.

Eighth, the front surface 146 of a retainer 103 and the rear surface 169 of a dynamic section body 165 are oriented to face each other and the through bores 149 and 171 are aligned to be concentric, as shown in FIG. 65. Ninth, the retainer 103 is oriented rotationally such that the cutouts 154 of the retainer 103 align with the non-cutout sections of the dynamic section 102 and the cutouts 1136 of the dynamic section 102 align with the non-cutout sections of the retainer 103, as shown in FIG. 65. Tenth, the retainer 103 is advanced longitudinally over the dynamic section 102 until the rear shoulder 158 of the dynamic flange section 151 abuts the rear surface 169 of the dynamic section body 165, as shown in FIGS. 35, 29, 55 and 66. Eleventh, the retainer 103 is rotated about its longitudinal axis until the radial walls 155 of the retainer 103 align radially with the radial walls 1137 of the dynamic section 102, as shown in FIGS. 66-68.

Figure 69:
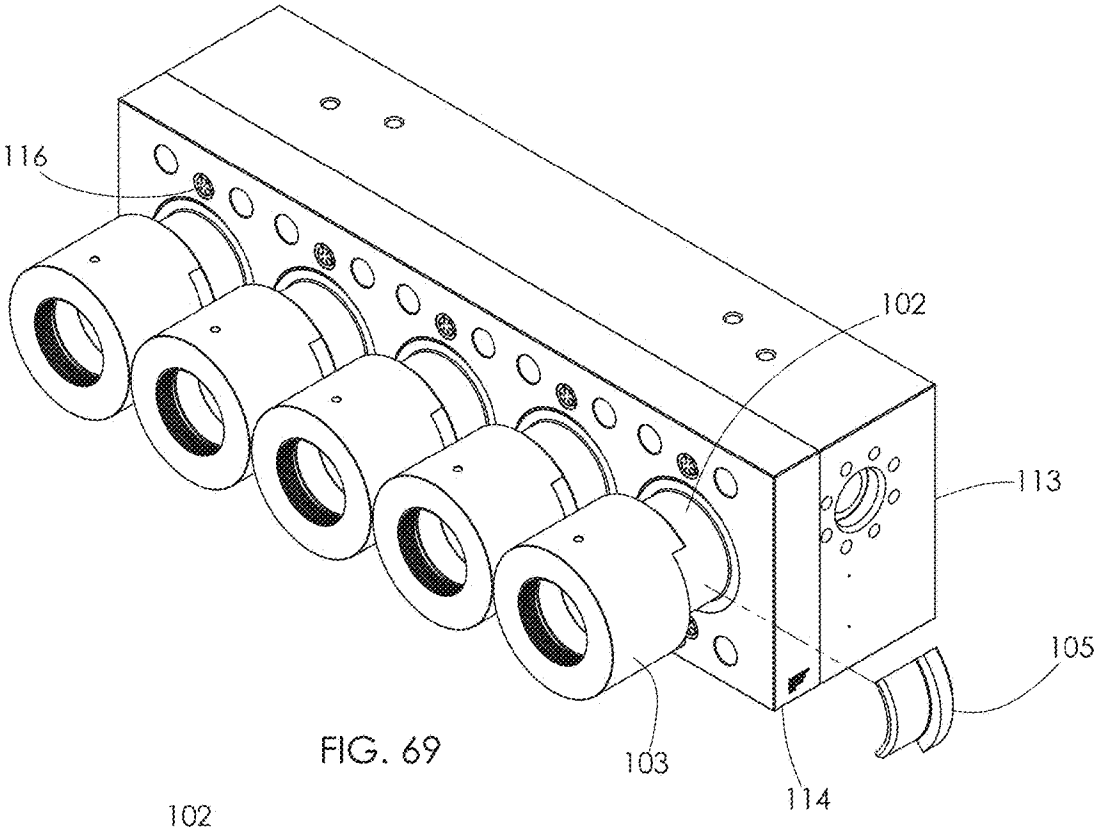
FIG. 69 is a rear perspective and partially exploded view showing the assembly of the retainer lock of the fluid end shown in FIG. 1.
Figure 71:
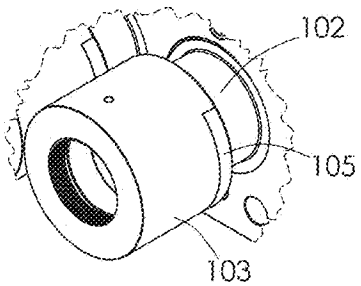
FIG. 71 is a rear perspective view showing the retainer lock installed within the retainer of the fluid end shown in FIG. 1.
Figure 70:
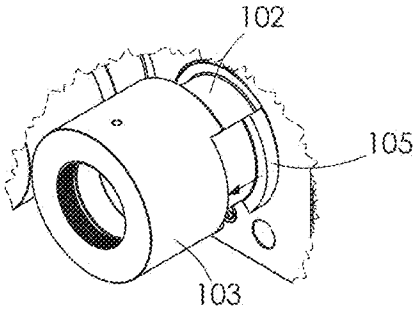
FIG. 70 is a rear perspective and partially exploded view showing the retainer lock prior to insertion in the retainer of the fluid end shown in FIG. 1.
Figure 72:
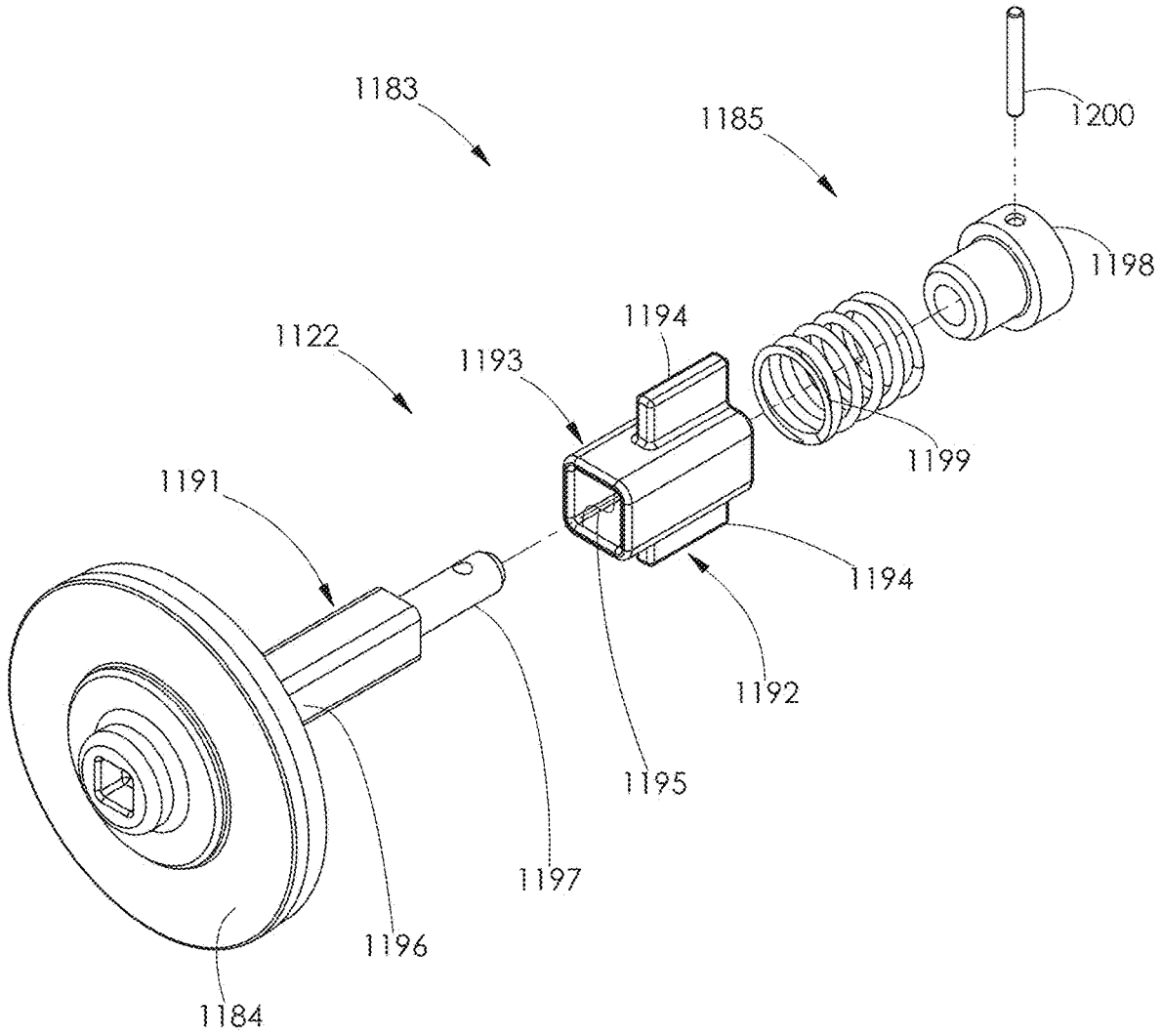
FIG. 72 is a front perspective and exploded view showing the suction valve assembly of the fluid end shown in FIG. 1.
Figure 73:
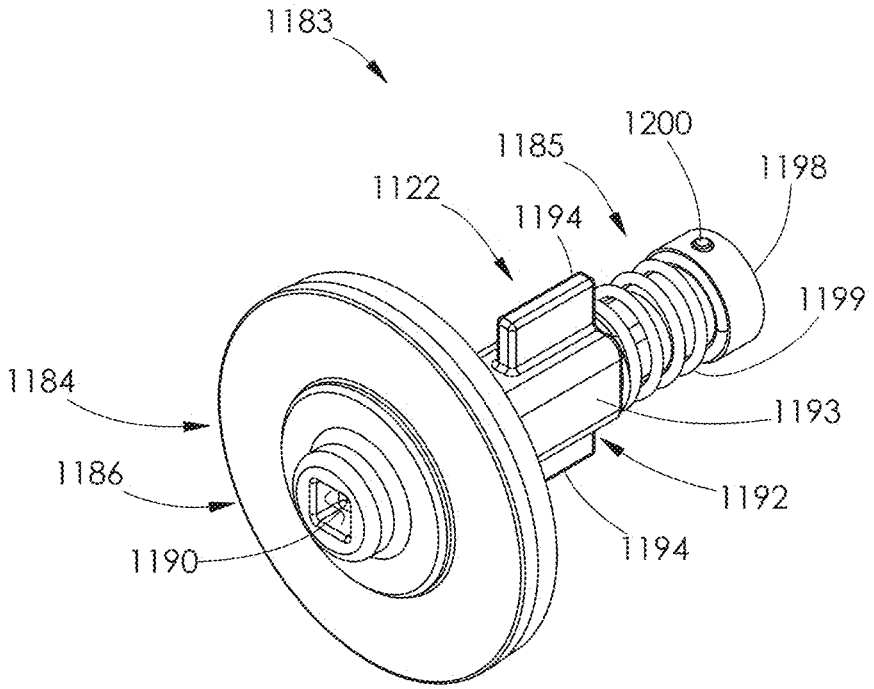
FIG. 73 is a front perspective view of a suction valve assembly of the fluid end shown in FIG. 1.
Figure 74:
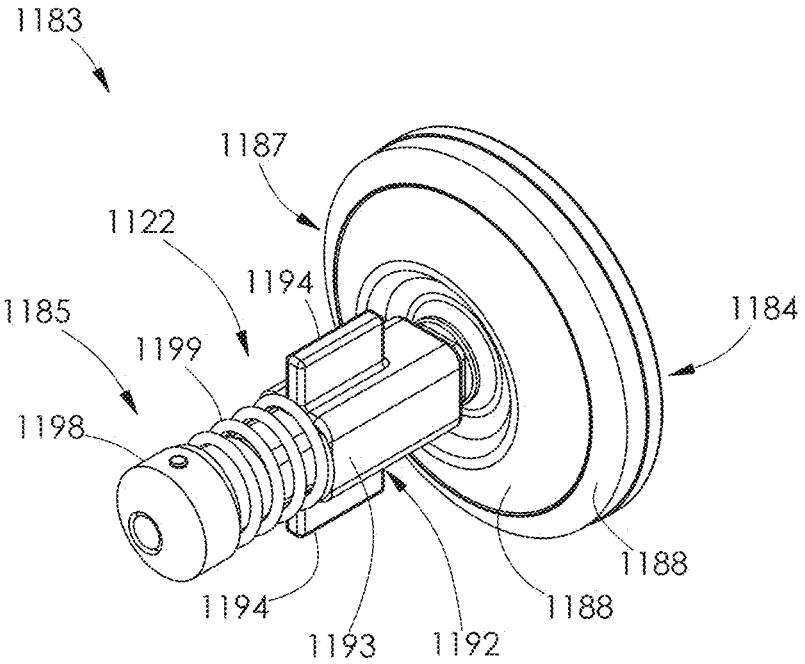
FIG. 74 is a rear perspective view of the suction valve assembly shown in FIG. 73.
Figure 75:
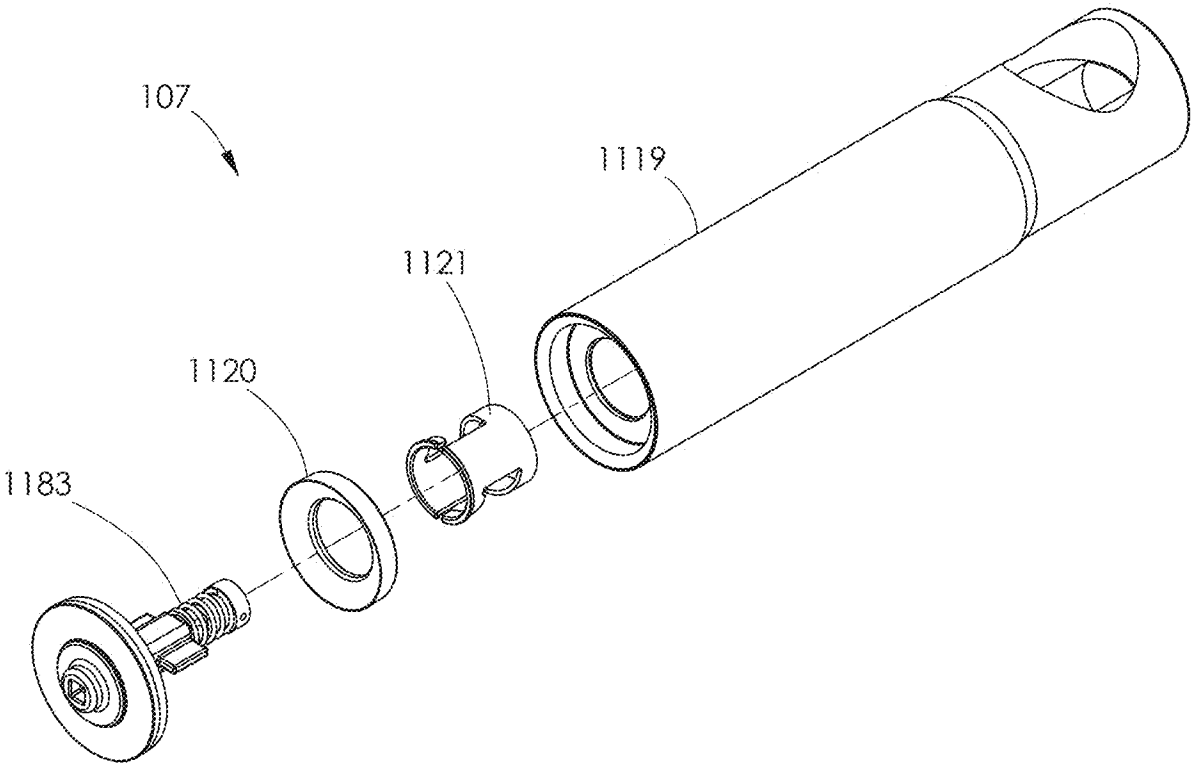
FIG. 75 is a front perspective and exploded view of a plunger assembly of the fluid end shown in FIG. 1.

Twelfth, a retainer lock 105 is oriented and positioned such that the front surface 1139 faces and nearly abuts the rear surface 144 of the rear static section 114, as shown in FIGS. 69-70. Thirteenth, the retainer lock 105 is positioned such that the intermediate inner surface 1141 abuts the retainer flange relief section 178 of the dynamic section 102 and the radial walls 1137 are radially aligned with the radial walls 155 of a single cutout 154 of the retainer 103, as shown in FIG. 70. Fourteenth, the retainer lock 105 is inserted into the annular space between the dynamic flange section 151 of the through bore 149 of the retainer 103 and the cutout surface 1138 of the dynamic section 102 until the limit shoulder 1145 abuts the cutout surface 156 of the retainer 103, as shown in FIGS. 30, 35, 36, 55, 70, and 71. Fifteenth, steps twelve through fourteen are repeated for a second retainer lock 105. The second retainer lock 105 is inserted in a second annular space formed between the dynamic section 102 and the retainer 103.

Figure 76:
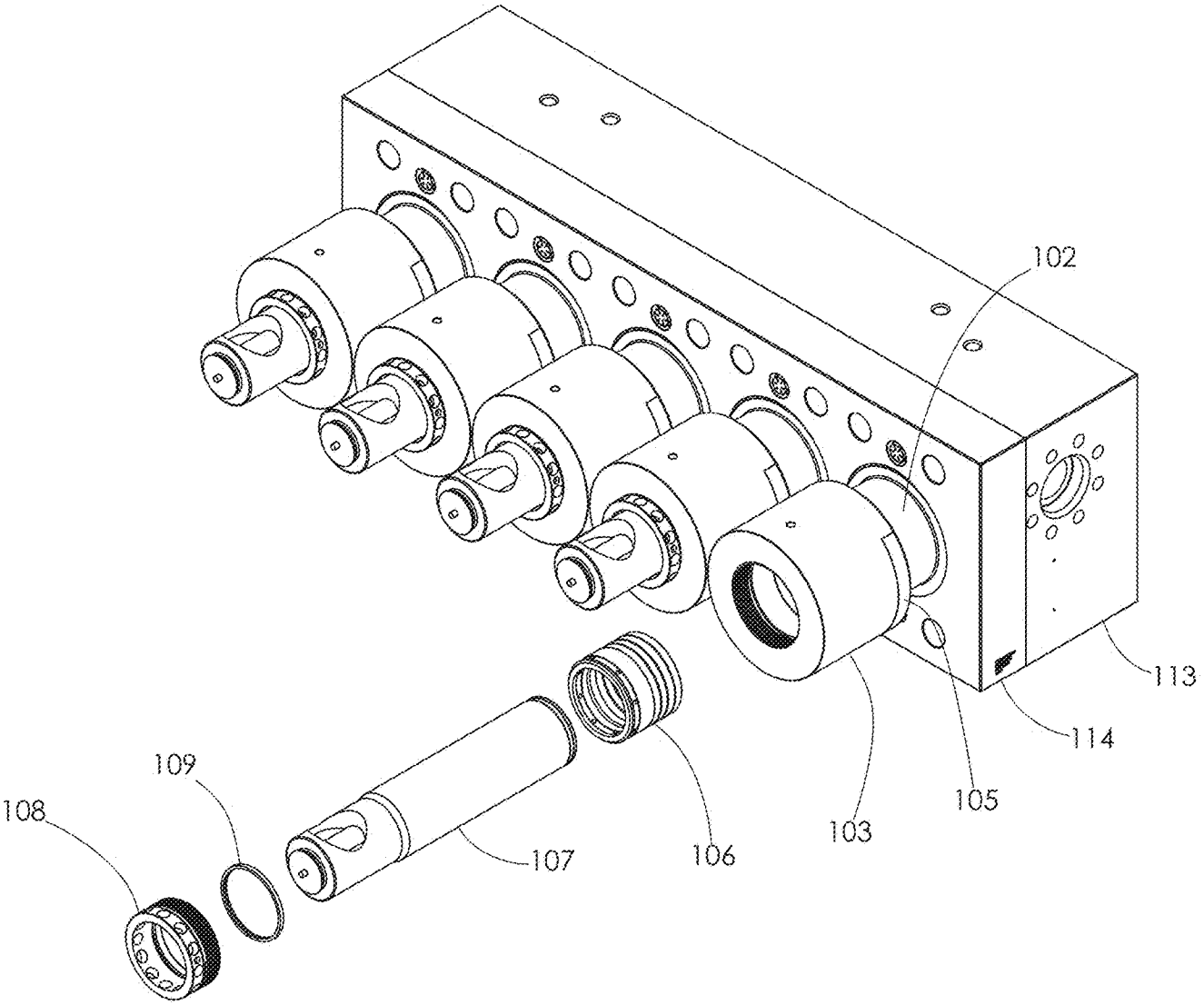
FIG. 76 is a rear perspective and exploded view showing the assembly of the packing stack, plunger assembly, packing nut seal, and packing nut of the fluid end shown in FIG. 1.

Sixteenth, the packing stack 106 is inserted into the now aligned through bores 149, 171 of the retainer 103 and dynamic section 102, as shown in FIGS. 35, 29, 55 and 76. Seventeenth, the plunger assembly 107 is inserted in the through bores 149 and 171 into the packing stack 106, as shown in FIGS. 35, 29, 55 and 76. Eighteenth, the packing nut seal 109 is inserted into the packing nut 108, as shown in FIGS. 55 and 76. Nineteenth, the packing nut 108 and installed packing nut seal 109 are threaded into the internal thread 160 of the packing nut section 153 of the retainer 103 while simultaneously advancing over the plunger assembly 107 and torqued until the desired compressive load is achieved on the packing stack 106, as shown in FIGS. 35, 55 and 76.

Figure 77:
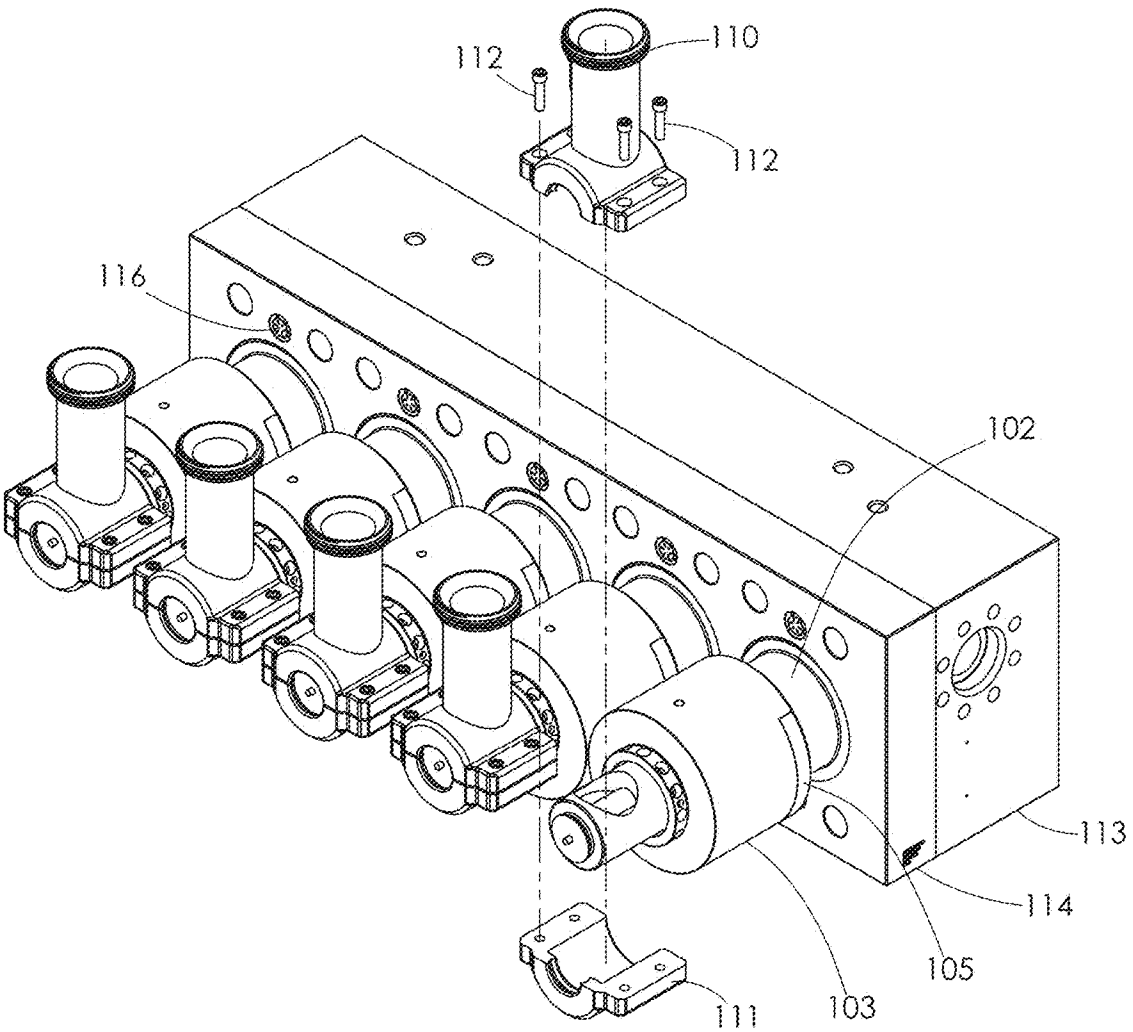
FIG. 77 is a rear perspective and exploded view showing the assembly of the top and bottom plunger suction fittings to the plunger assembly of the fluid end shown in FIG. 1.

Twentieth, the insert section 1111 of the riser section 1108 of the top plunger suction fitting 110 is inserted into the suction fitting bore 1134 of the plunger 1119 with the flow relief notch 1112 oriented toward the front of the plunger 1119 until the internal profile 1115 of the clamp section 1109 abuts the suction fitting section 1132 of the intermediate outer surface 1125 of the plunger 1119, as shown in FIGS. 51, 44, 55 and 77. Twenty-first, the bottom plunger suction fitting in is oriented such that the attachment flanges 1116 abut, or nearly abut, the attachment flanges 1113 of the top plunger suction fitting 110 and the threaded fastener through holes 1117 are aligned with the fastener through holes 1114 of the top plunger suction fitting 110, as shown in FIG. 77.

Twenty-second, the internal profile 1118 of the bottom plunger suction fitting in is abutted to the suction fitting section 1132 of the intermediate outer surface 1125 of the plunger 1119, as shown in FIGS. 53, 44, 55 and 77. Twenty-third, the suction fitting connectors 112 are inserted in the fastener through holes 1114 of the top plunger suction fitting 110 and threaded into the threaded fastener through holes 1117 of the bottom plunger suction fitting in, then torqued to specification, as shown in FIG. 77. Twenty-fourth, the stem section 1105 of a discharge valve 120 is inserted in a spring 121, then further into the valve stem bore 193 of the discharge plug 122 until the dowel slot 1107 is aligned with the dowel pin bore 197, as shown in FIGS. 55, 78, and 79.

Figure 80:
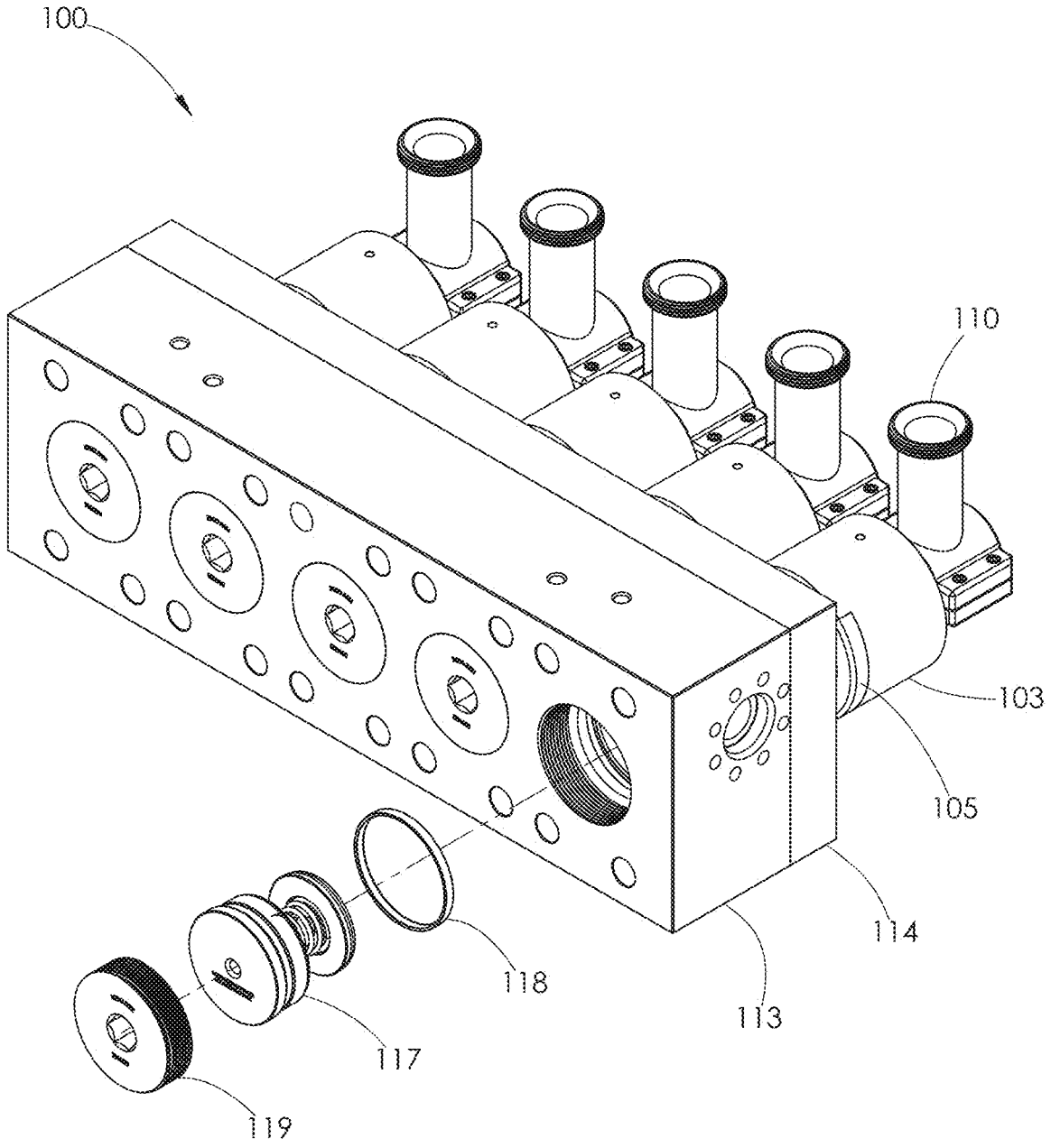
FIG. 80 is a front perspective and exploded view showing the assembly of the discharge plug seal, discharge valve assembly, and discharge plug retainer of the fluid end shown in FIG. 1.
Figure 81:
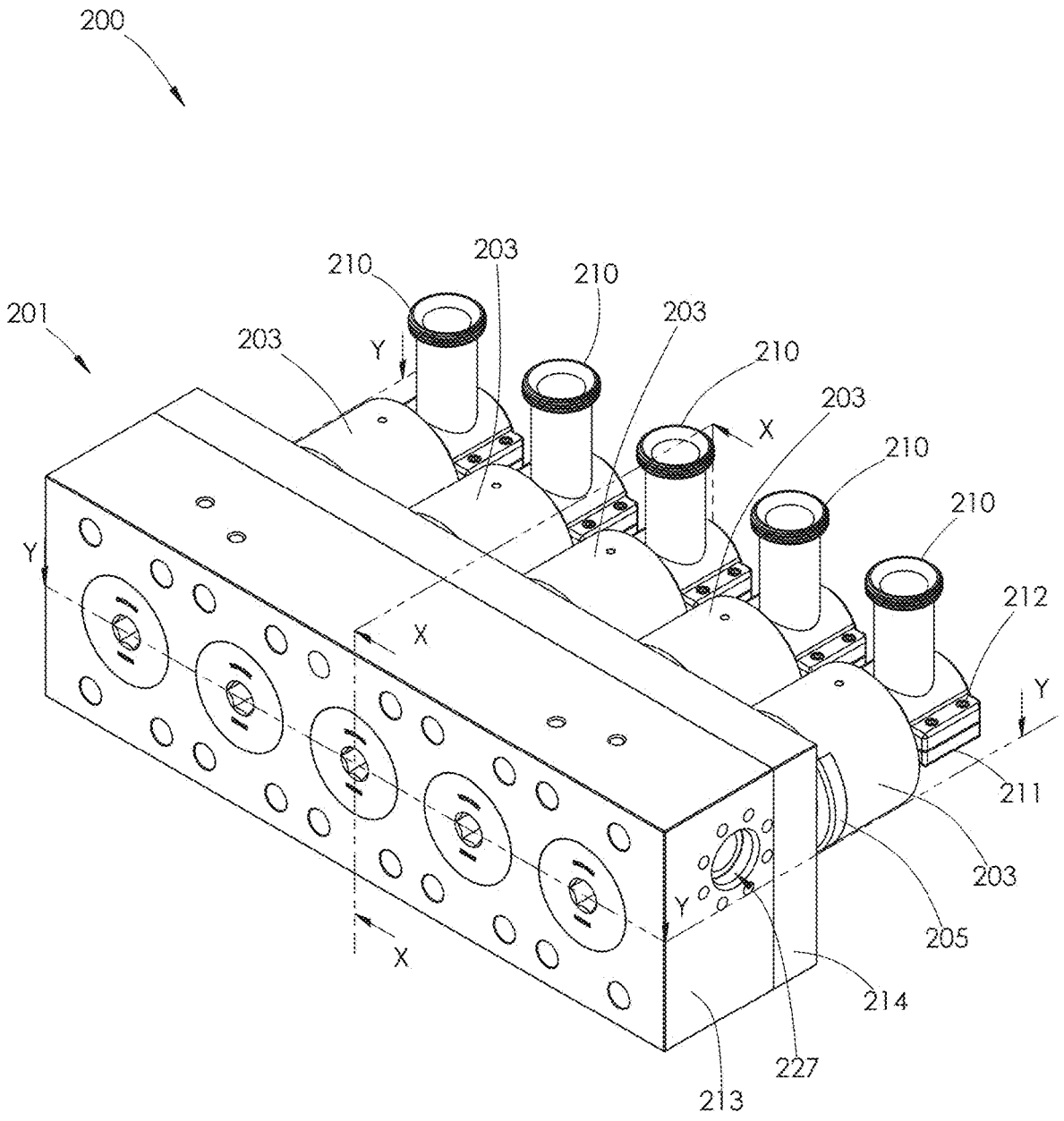
FIG. 81 is a front perspective view of another embodiment of a fluid end disclosed herein.
Figure 82:
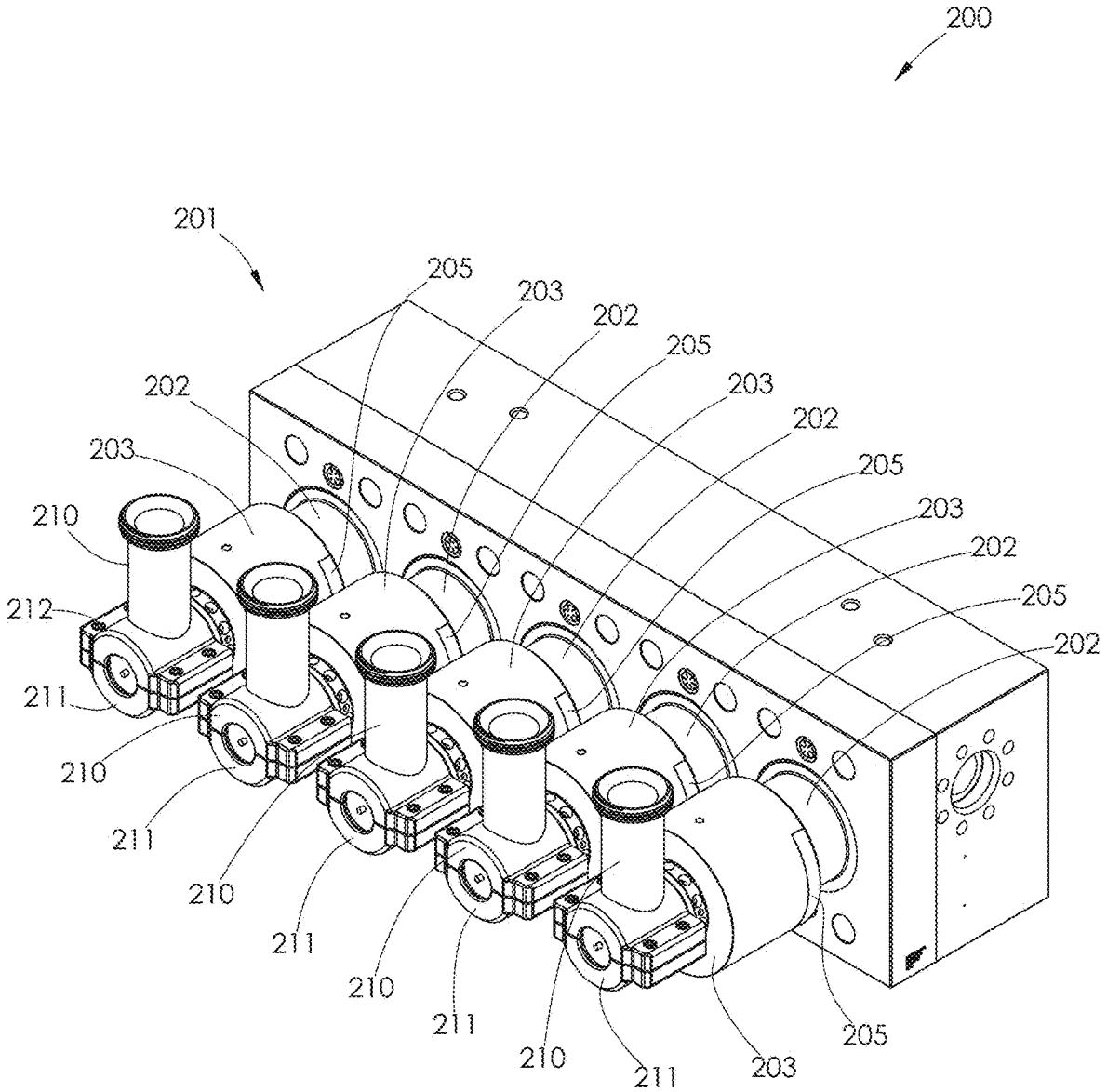
FIG. 82 is a rear perspective view of the fluid end shown in FIG. 81.

Twenty-fifth, the dowel pin 123 is inserted into the dowel pin bore 197 through the dowel slot 1107, as shown in FIGS. 55 and 79, thus completing the assembly of the discharge valve assembly 117. The dowel pin 123 prevents the discharge valve 120 from sliding completely out of the discharge plug 122. Twenty-sixth, the discharge plug seal 118 is inserted into the discharge plug seal groove 135 of the flow bore 125 of the static section 101, as shown in FIGS. 8, 55 and 80. Twenty-seventh, the discharge valve assembly 117 is inserted, discharge valve 120 first, into the flow bore 125 from the front surface 128 of the front static section 113, until the stop bevel 185 of discharge plug 122 abuts the stop bevel 1149 of the flow bore 125, as shown in FIGS. 8, 23, 55 and 80. Twenty-eighth, and lastly, the discharge plug retainer 119 is threaded into the threaded section 130 of the flow bore 125 of the front static section 113 and torqued to specification, as shown in FIGS. 8, 55 and 80.

Assembly steps eight through twenty-eight may be repeated for each flow bore 125, preferably in the same manner. The assembly of the fluid end 100 is now complete and may be mounted to a power end using stay rods similar to those in the '710 patent. After mounting to a power end, suction conduits (not shown) may be attached to the external threads 1110 of the riser sections 1108 of the top plunger fittings 110, and discharge conduits (not shown) may be attached to discharge fittings (not shown) installed in the discharge bore 127.

During assembly, the two-piece static section 101 eliminates the need rotate the dynamic section 102 as it is being inserted into the dynamic seal 115 longitudinally, that is by threading. Instead, the dynamic section 102 may be inserted into the dynamic seal 115 only along the longitudinal axis, thus reducing the chances of cutting a dynamic seal 115. If desired, the advantages given by the two-piece static section 101 may be forfeited by using a one-piece static section. Use of a one-piece static section will not negate the advantages provided by the other novel features described herein.

The use of inverse cutouts 154 and 1136 in the retainer 103 and dynamic section 102 greatly reduce assembly and disassembly time which is particularly helpful during field maintenance.

In operation, stress concentrations due to the presence of intersecting bores have been eliminated along with the intersecting bores. This increases the life of the fluid end 100.

Referring now to FIGS. 81, 82, 95, and 96, another embodiment of a fluid end 200 is shown. The fluid end 200 is similar to fluid end 100, but uses packing sleeves 2150, and no wear sleeves 167. The fluid end 200 comprises a static section 201, a plurality of dynamic sections 202, a plurality of packing sleeves 2150, a plurality of retainers 203, a plurality of retainer seals 204, a plurality of retainer locks 205, a plurality of packing stacks 206, a plurality of plunger assemblies 207, a plurality of packing nuts 208, a plurality of packing nut seals 209, a plurality of top plunger suction fittings 210, a plurality of bottom plunger suction fittings 211, and a plurality of suction fitting connectors 212. Because many of the components of fluid end 200 are similar to that of fluid end 100, details may be spared in the description of fluid end 200. An artisan will understand to refer to the description of fluid end 100 if needed.

Figure 95:
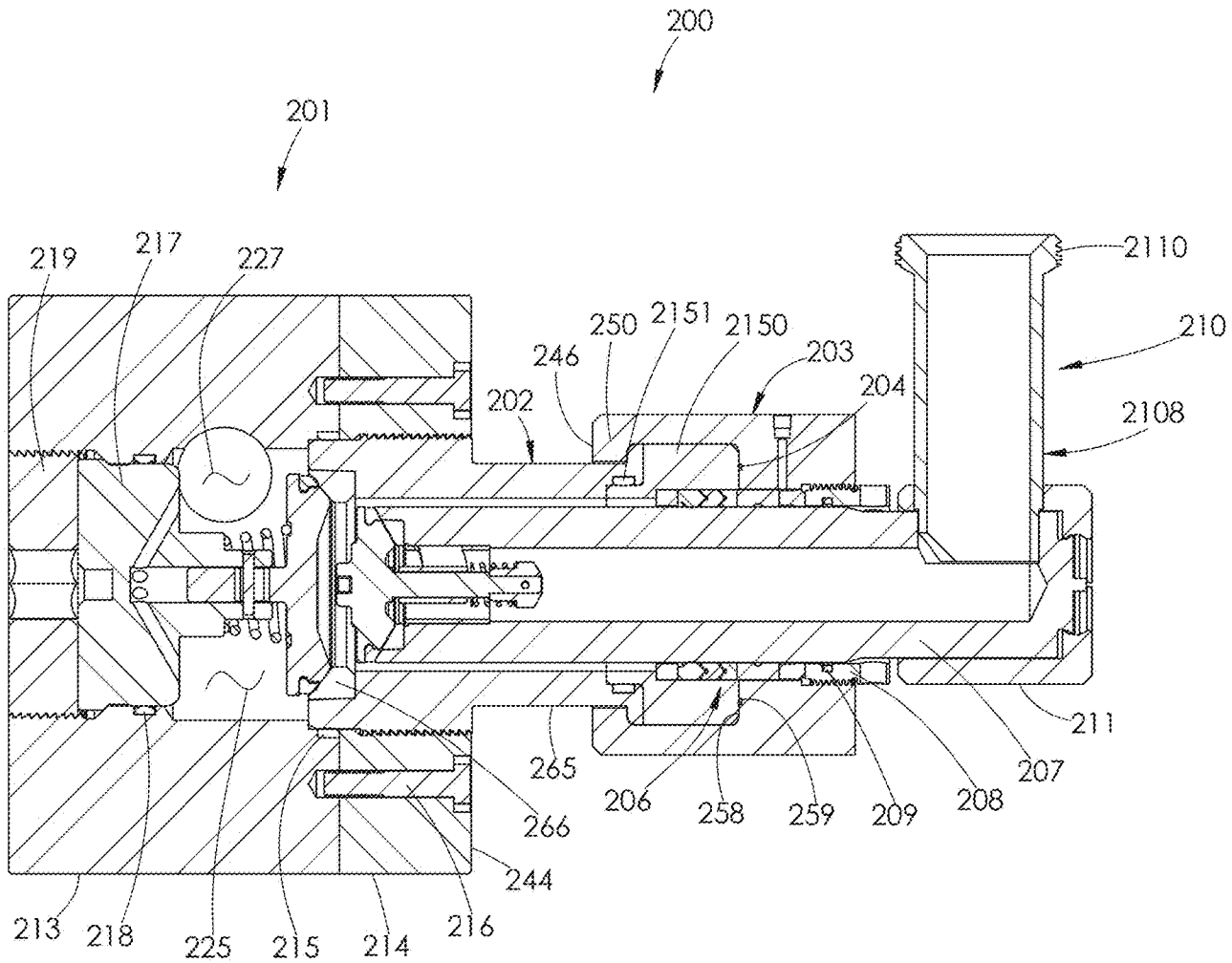
FIG. 95 is a cross-sectional view of the fluid end shown in FIG. 81, taken along line X-X.

Referring now to FIG. 95, the static section 201 comprises a front static section 213, a rear static section 214, a plurality of dynamic seals 215, a plurality of static section connectors 216, a plurality of discharge valve assemblies 217, a plurality of discharge plug seals 218, and a plurality of discharge plug retainers 219. The front static section 213 comprises a plurality of flow bores 225 and a discharge bore 227. The rear static section 214 comprises a rear surface 244. In alternative embodiments, the static section 201 may comprise a single-piece body.

Figure 97:
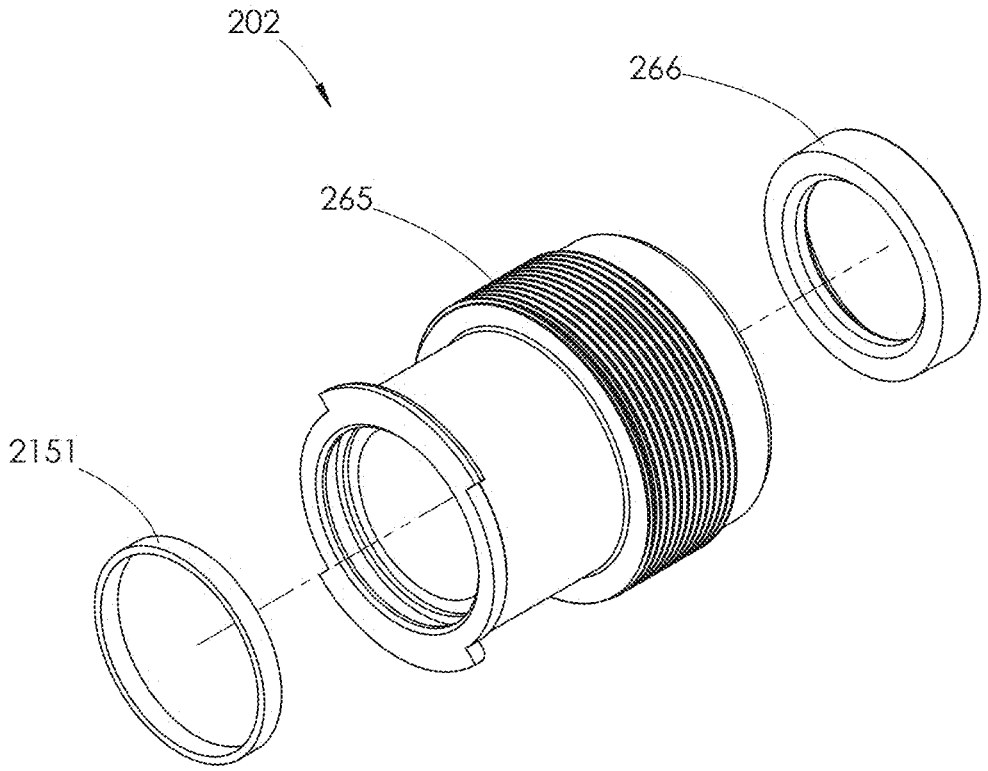
FIG. 97 is a rear perspective and exploded view showing the assembly of the dynamic section of the fluid end shown in FIG. 81.
Figure 98:
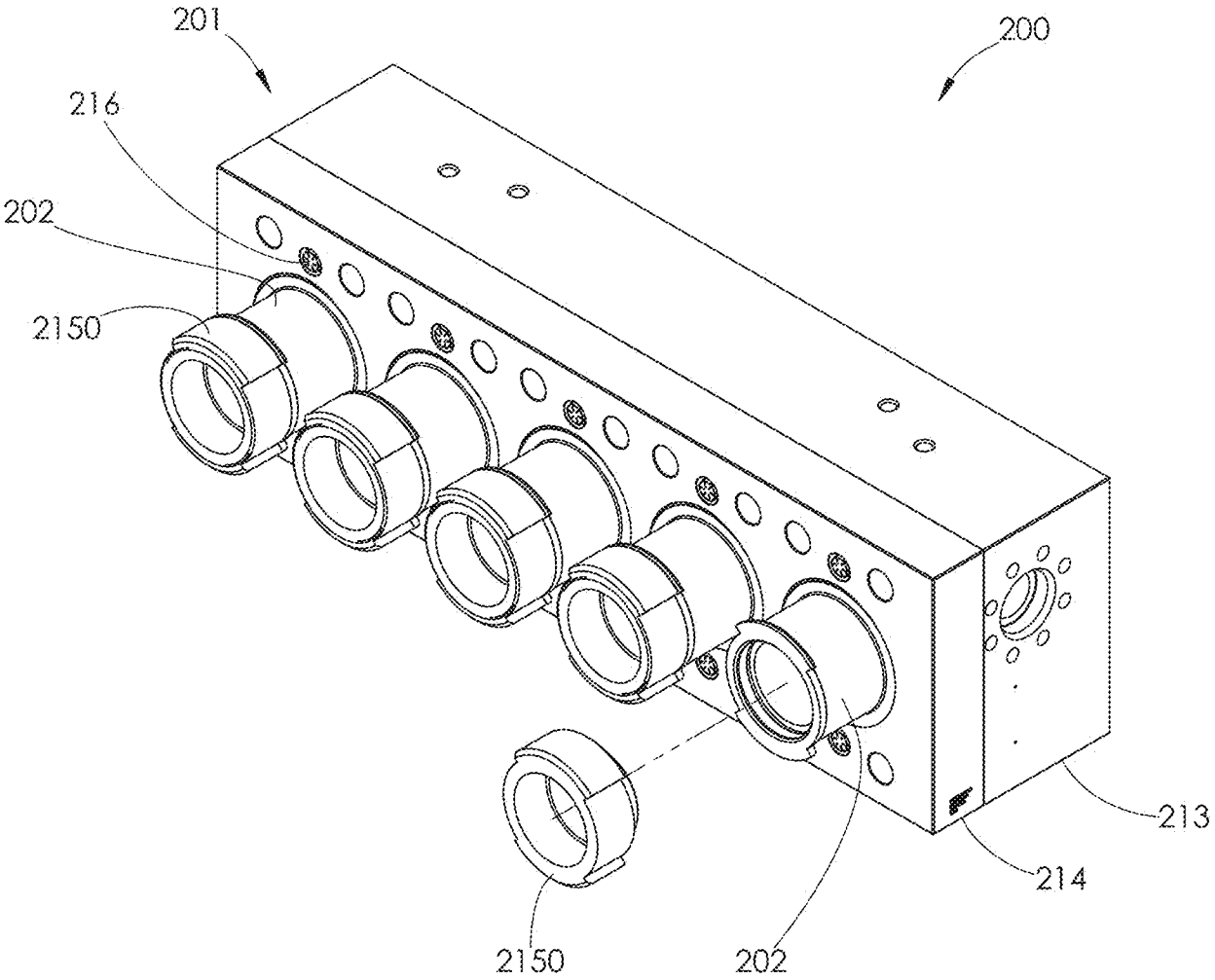
FIG. 98 is a rear perspective and exploded view showing the assembly of the packing sleeve to the dynamic section of the fluid end shown in FIG. 81.

Referring now to FIGS. 95 and 97, each dynamic section 202 comprises a dynamic section body 265, a discharge valve seat 266, and a packing sleeve seal 2151.

Figure 87:
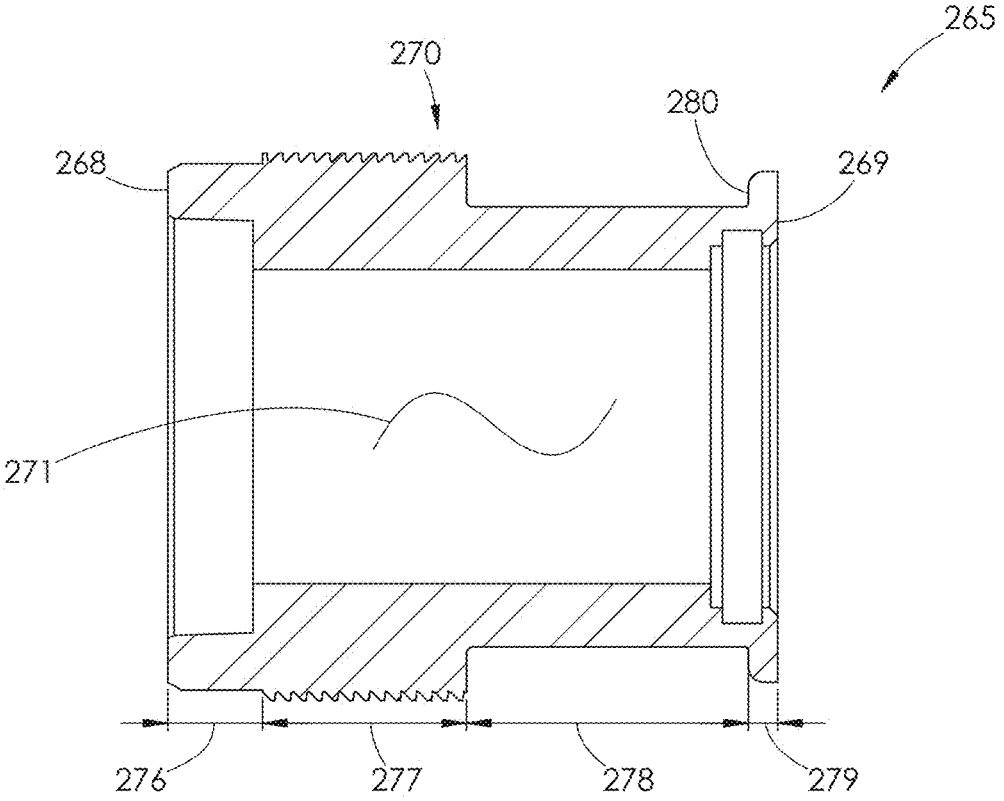
FIG. 87 is a cross-sectional view of the dynamic section shown in FIG. 86, taken along line T-T.
Figure 88:
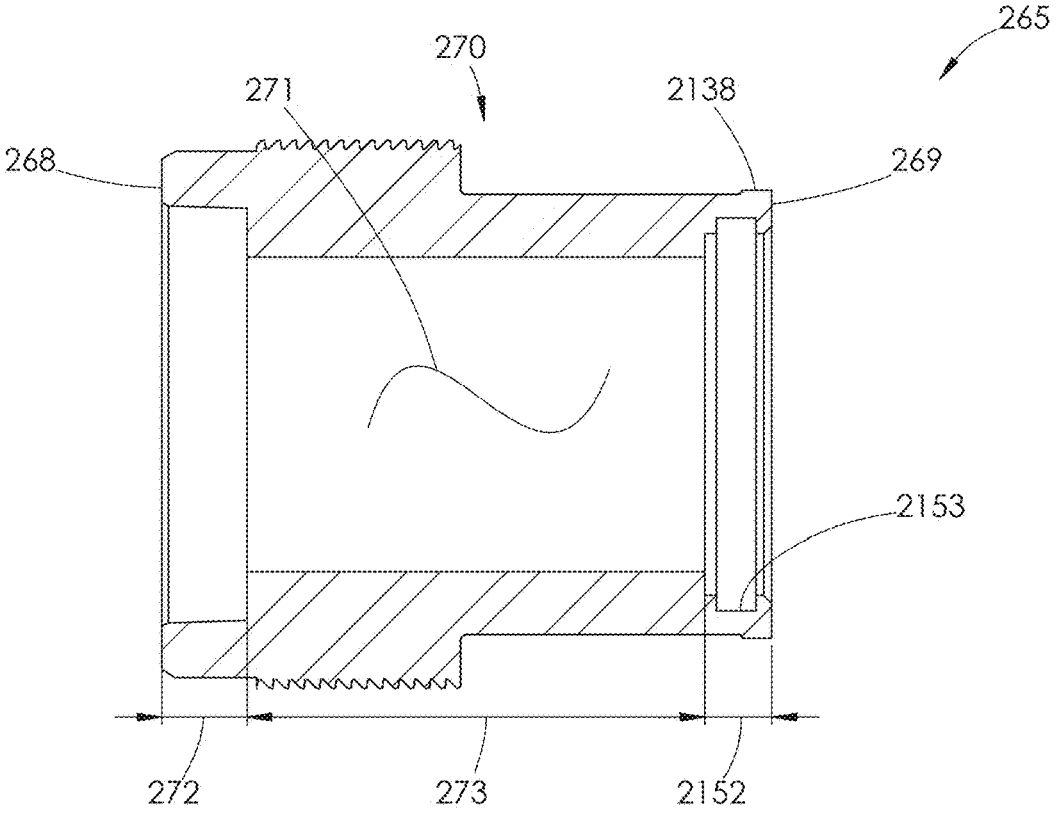
FIG. 88 is a cross-sectional view of the dynamic section shown in FIG. 86, taken along line U-U.
Figure 89:
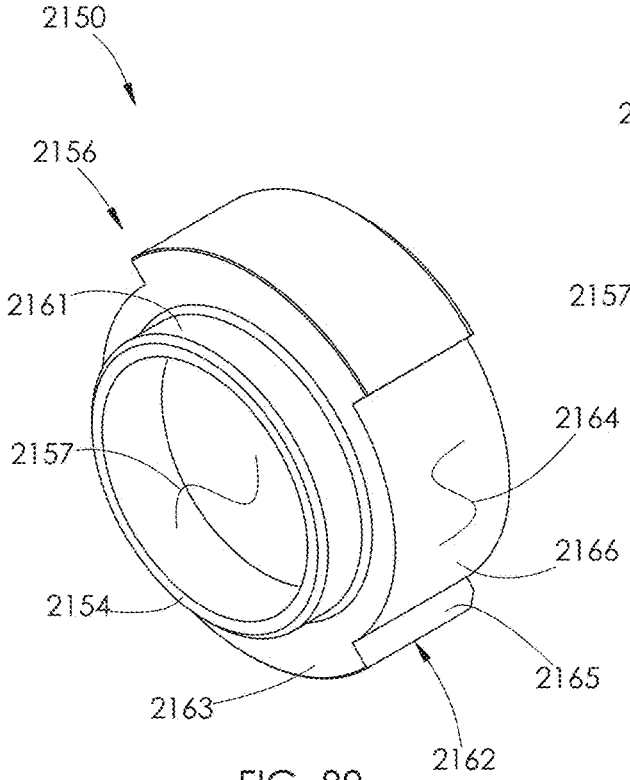
FIG. 89 is a front perspective view of a packing sleeve of the fluid end shown in FIG. 81.
Figure 90:
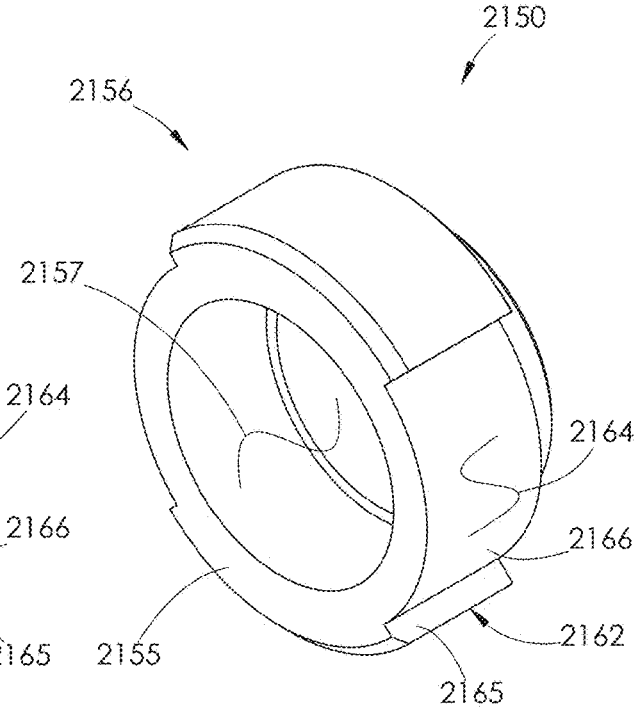
FIG. 90 is a rear perspective view of the packing sleeve shown in FIG. 89.
Figure 91:
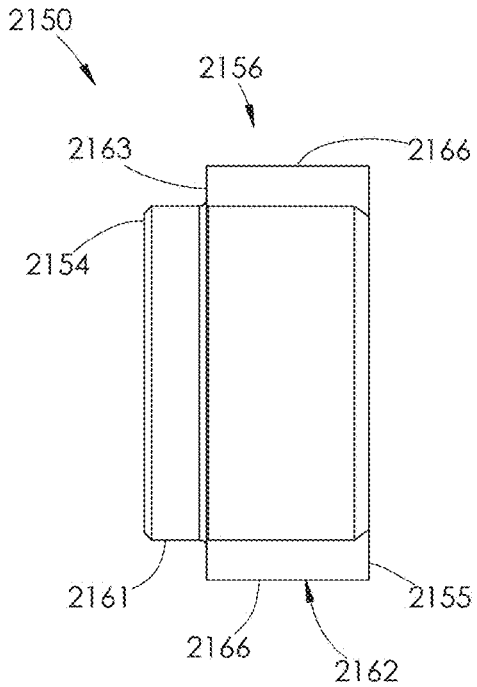
FIG. 91 is a top plan view of the packing sleeve shown in FIG. 89.
Figure 92:
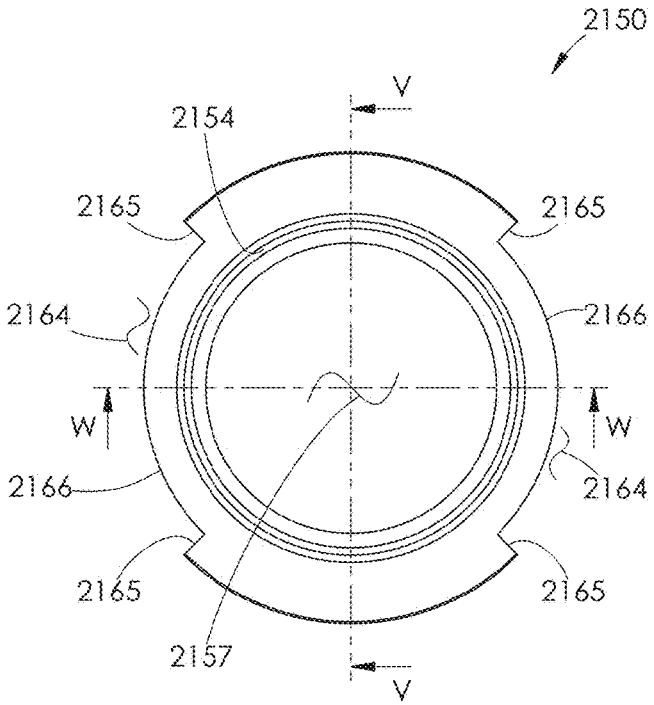
FIG. 92 is a front elevation view of the packing sleeve shown in FIG. 89.

Referring now to FIGS. 83-88 the dynamic section body 265 has a generally cylindrical shape comprising opposed front 268 and rear 269 surfaces connected by an intermediate outer surface 270. The dynamic section body 265 further comprises a through bore 271 that also connects the front 268 and rear 269 surfaces. The bore axis of the through bore 271 is collinear with the longitudinal axis of the dynamic section body 265. Beginning at the front surface 268 and continuing along the bore axis to the rear surface 269, each through bore 271 comprises a discharge valve seat section 272, a plunger section 273, and a packing sleeve section 2152, as shown in FIG. 88. The packing sleeve section 2152 comprises a packing sleeve seal groove 2153.

The intermediate outer surface 270 also has areas with different features. Beginning at the front surface 268 and continuing to the rear surface 269, each intermediate outer surface 270 comprises a dynamic seal section 276, an external thread 277, a retainer flange relief section 278, and a dynamic flange section 279. The retainer flange relief section 278 has a smaller diameter than dynamic flange section 279, thus forming a rear shoulder 280 as part of the retainer flange relief section 278, as shown in FIG. 87.

The dynamic flange section 279 comprises a plurality of cutouts 2136. In this embodiment, there are two cutouts 2136 to match the number of cutouts 254 in the retainer flange section 250 of retainer 203. Since the diameter of the dynamic flange section 279 is larger than that of the retainer flange relief section 278, the cutouts 2136 only modify the dynamic flange section 279. Radially, each cutout 2136 removes only a portion of the dynamic flange section 279 from the intermediate outer surface 270 down, that is radially, toward the longitudinal axis of the dynamic section body 265 but not all the way through to the through bore 271. The cutouts 2136 thus form a radial wall 2137 at the radial limits of each cutout 2136, that is two for each cutout 2136. Longitudinally, the cutout 2136 begins at the rear surface 269 and continues through the entire length of the dynamic flange section 279. The radial depth of the cutouts 2136 is such that the rear shoulder 280 height is reduced but the rear shoulder 280 is not eliminated. The cutouts 2136 also form a cutout surface 2138 that is the radial base of the cutout 2136 with a diameter smaller than the diameter of the dynamic flange section 279.

Figure 93:
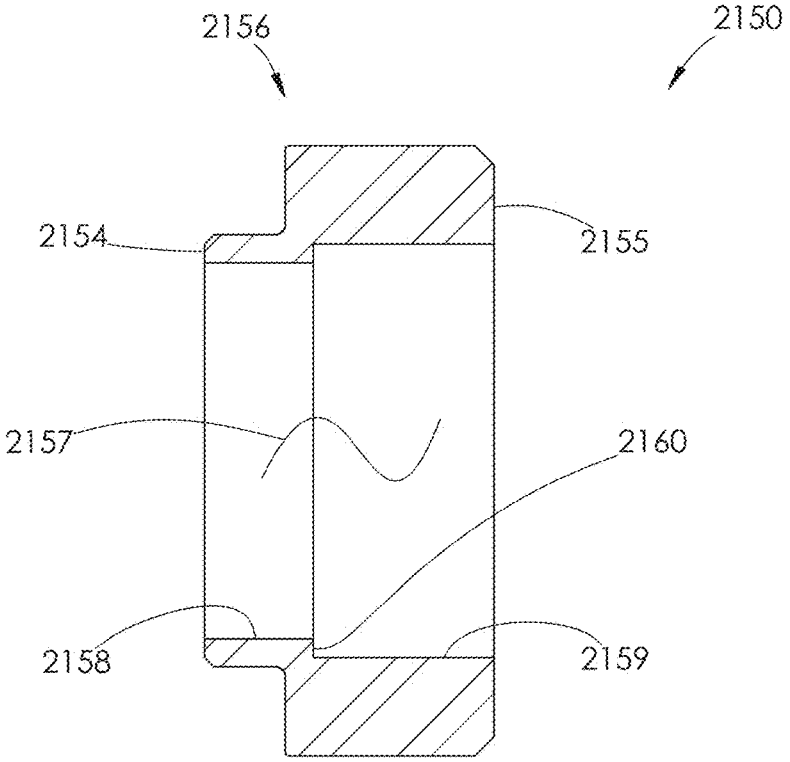
FIG. 93 is a cross-sectional view of the packing sleeve shown in FIG. 92, taken along line V-V.

Referring now to FIGS. 89-94 the packing sleeve 2150 has a generally cylindrical shape comprising opposed front 2154 and rear 2155 surfaces connected by an intermediate outer surface 2156. The packing sleeve 2150 further comprises a through bore 2157 that also connects the front 2154 and rear 2155 surfaces. The bore axis of the through bore 2157 is collinear with the longitudinal axis of the packing sleeve 2150. As shown in FIG. 93, the through bore 2157 comprises a plunger section 2158 and a packing section 2159. The packing section 2159 has a larger diameter than the plunger section 2158, which forms a packing shoulder 2160 at the transition between the packing section 2159 and plunger section 2158.

Figure 94:
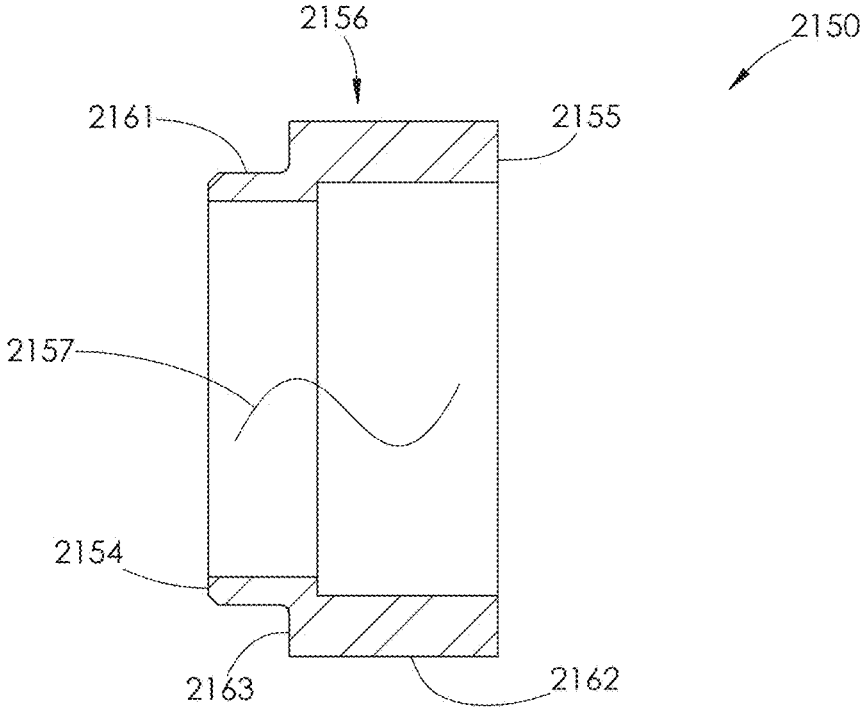
FIG. 94 is a cross-sectional view of the packing sleeve shown in FIG. 92, taken along line W-W.

The intermediate outer surface 2156 comprises a packing sleeve seal section 2161 and a dynamic flange section 2162. The packing sleeve seal section 2161 has a smaller diameter than dynamic flange section 2162, thus forming a dynamic flange shoulder 2163, as shown in FIG. 94.

The dynamic flange section 2162 comprises a plurality of cutouts 2164. In this embodiment, there are two cutouts 2164 to match the number of cutouts 254 in the retainer 203. Since the diameter of the dynamic flange section 2162 is larger than that of the packing sleeve seal section 2161, the cutouts 2164 only modify the dynamic flange section 2162. Radially, each cutout 2164 removes only a portion of the dynamic flange section 2162 from the intermediate outer surface 2156 down, that is radially, toward the longitudinal axis of the packing sleeve 2150 but not all the way through to the through bore 2157. The cutouts 2164 thus form a radial wall 2165 at the radial limits of each cutout 2164, that is two for each cutout 2164. Longitudinally, the cutout 2164 begins at the rear surface 2155 and continues through the entire length of the dynamic flange section 2162. The radial depth of the cutouts 2164 is such that the dynamic flange shoulder 2163 height is reduced, but the dynamic flange shoulder 2163 is not eliminated. The cutouts 2164 also form a cutout surface 2166 that is the radial base of the cutout 2164 with a diameter smaller than the diameter of the dynamic flange section 2162. Once assembled, the cutouts 2164 longitudinally extend the cutouts 2136 of the dynamic section body 265.

Referring now to FIGS. 61, 63-64, 67-80, 95-99, the assembly of the fluid end 200 will be discussed. Reference may be made to the assembly of fluid end 100 when necessary. First, the dynamic seals 215 are installed in the front static section 213 of the static section 201, as shown in FIG. 95. This is done in the same manner as described for the similar dynamic seals 115 of fluid end 100 shown in FIG. 61.

Second, the dynamic sections 202 are assembled by pressing the discharge valve seats 266 into the discharge valve seat sections 272 of the through bores 271 of each dynamic section body 265 and installing the packing sleeve seals 2151 in the packing seal sleeve grooves 2153 of the packing sleeve sections 2152 of the through bores 271, as shown in FIGS. 88, 95, and 97.

Third, each dynamic section 202 is threaded into the rear static section 214, as shown in FIG. 95. This is done in the same manner as described for the similar dynamic sections 102 of fluid end 100 shown in FIG. 63.

Fourth, the rear static section 214 is attached to the front static section 213 and assembled dynamic seals 215 using static section connectors 216, as shown in FIG. 95. This is done in the same manner as described for the similar parts of fluid end 100 shown in FIG. 64.

Fifth, the packing sleeve seal section 2161 of the intermediate outer surface 2156 of a packing sleeve 2150 is aligned with the through bore 271 of a dynamic section body 265 and inserted into the packing sleeve section 2152 until the dynamic flange shoulder 2163 abuts the rear surface 269 of the dynamic section body 265, as shown in FIGS. 88, 94, 95 and 98. At this point in the assembly, the packing sleeve seal section 2161 will also be inserted into the packing sleeve seal 2151.

Figure 83:
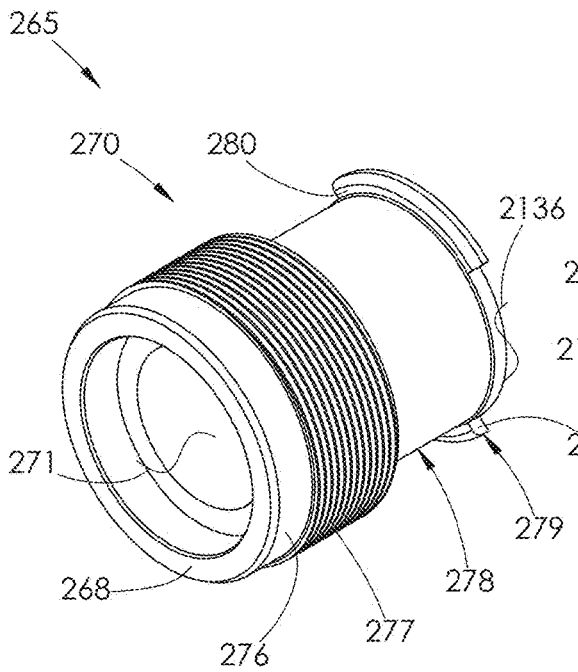
FIG. 83 is a front perspective view of a dynamic section of the fluid end shown in FIG. 81.
Figure 84:
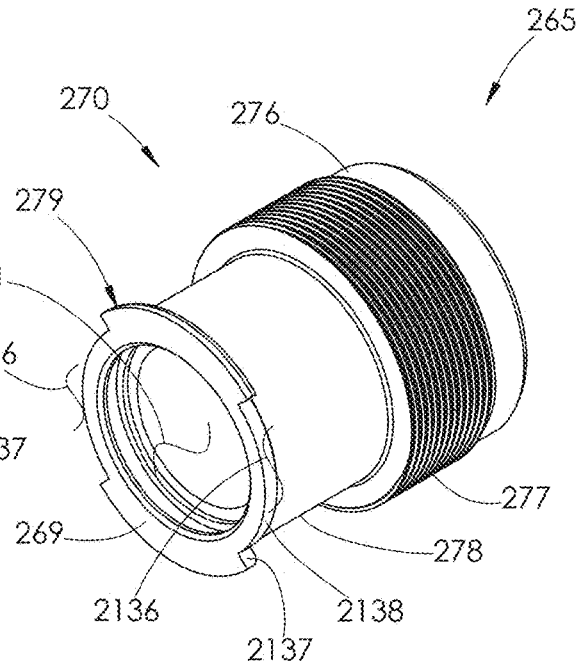
FIG. 84 is a rear perspective view of the dynamic section shown in FIG. 83.
Figure 85:
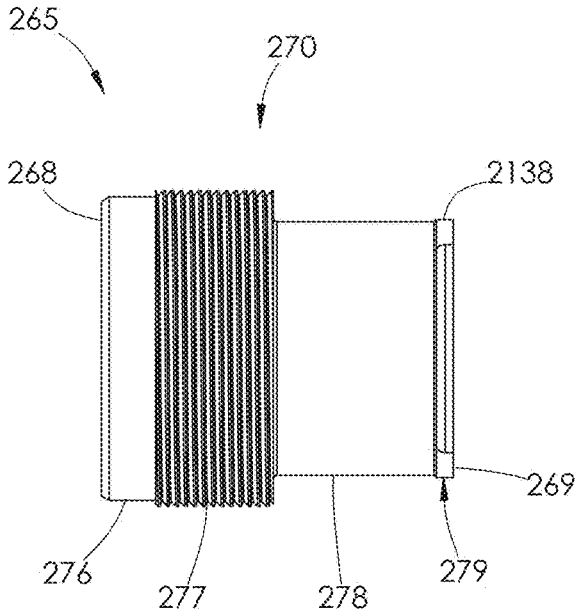
FIG. 85 is a top plan view of the dynamic section shown in FIG. 83.
Figure 86:
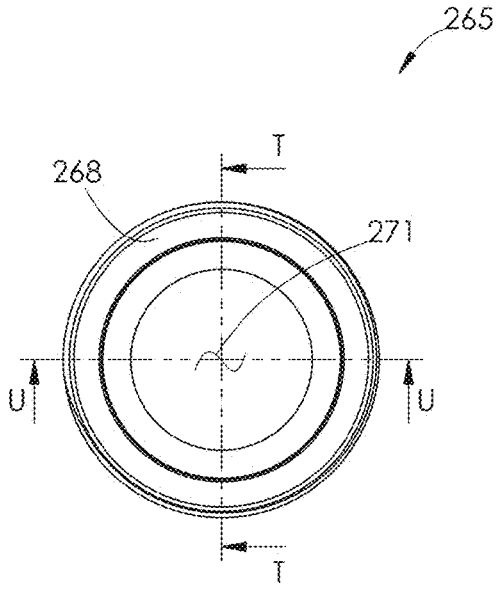
FIG. 86 is a front elevation view of the dynamic section shown in FIG. 83.

Sixth, the packing sleeve 2150 is rotated until the radial walls 2165 of the packing sleeve 2150 align with the radial walls 2137 of the dynamic section body 265 such that cutouts 2136 and 2164 align, as shown in FIG. 83, 90, 99.

Figure 99:
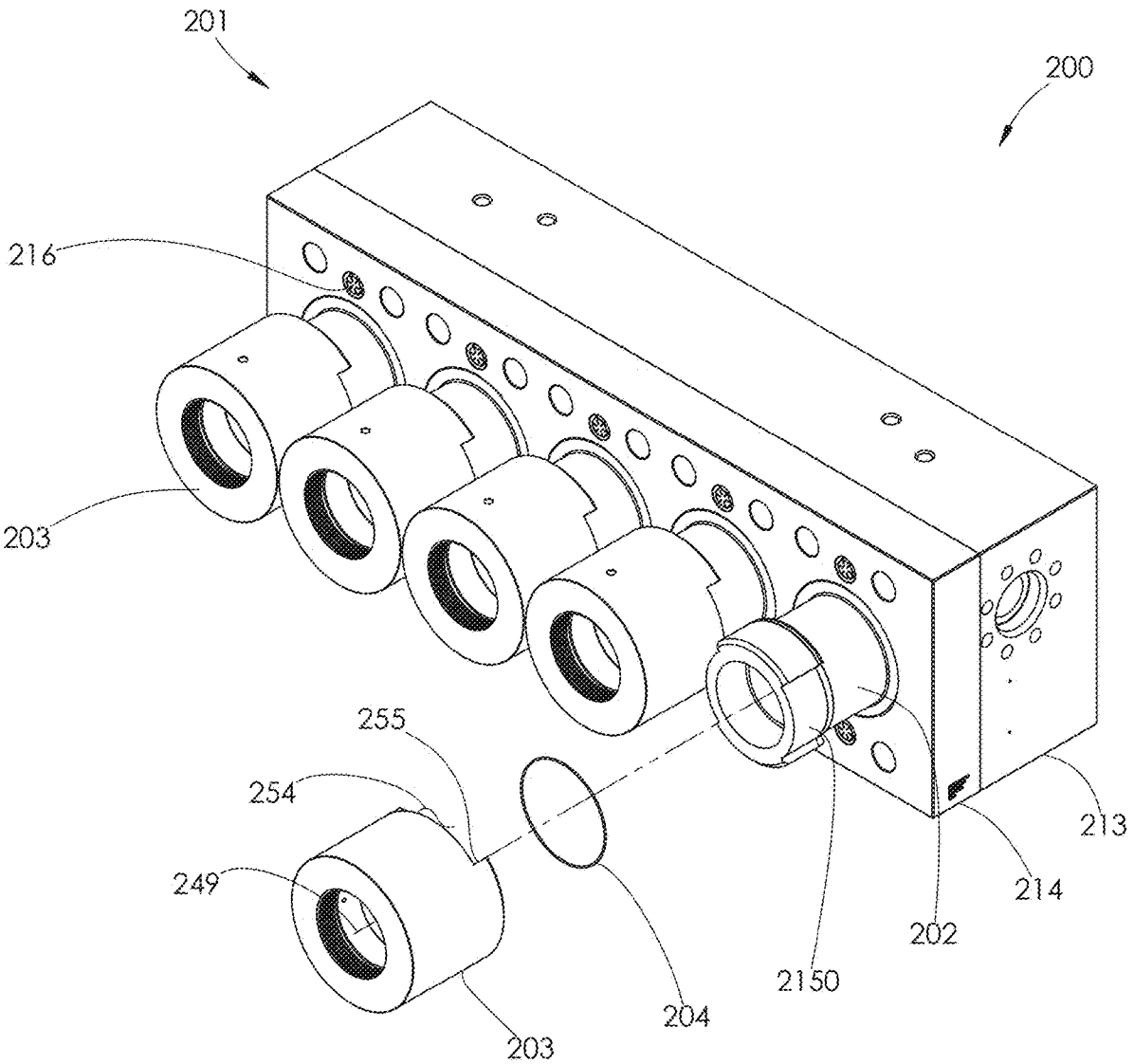
FIG. 99 is a rear perspective and exploded view showing the assembly of the retainer to the packing sleeve and dynamic section of the fluid end shown in FIG. 81.

Seventh, a retainer seal 204 is inserted into the seal groove 259 in the rear shoulder 258 of a retainer 203, as shown in FIGS. 95 and 99.

Eighth, the front surface 246 of the retainer 203 and the rear surface 2155 of the packing sleeve 2150 are oriented to face each other, and the through bores 249 and 2157 are aligned to be concentric, as shown in FIG. 99.

Ninth, the retainer 203 is oriented rotationally such that the cutouts 254 of the retainer 203 align with the non-cutout sections of the packing sleeve 2150 and dynamic section 202. Also, the cutouts 2136 and 2164 of the dynamic section 202 and packing sleeve 2150 align with the non-cutout sections of the retainer 203, as shown in FIG. 99.

Figure 96:
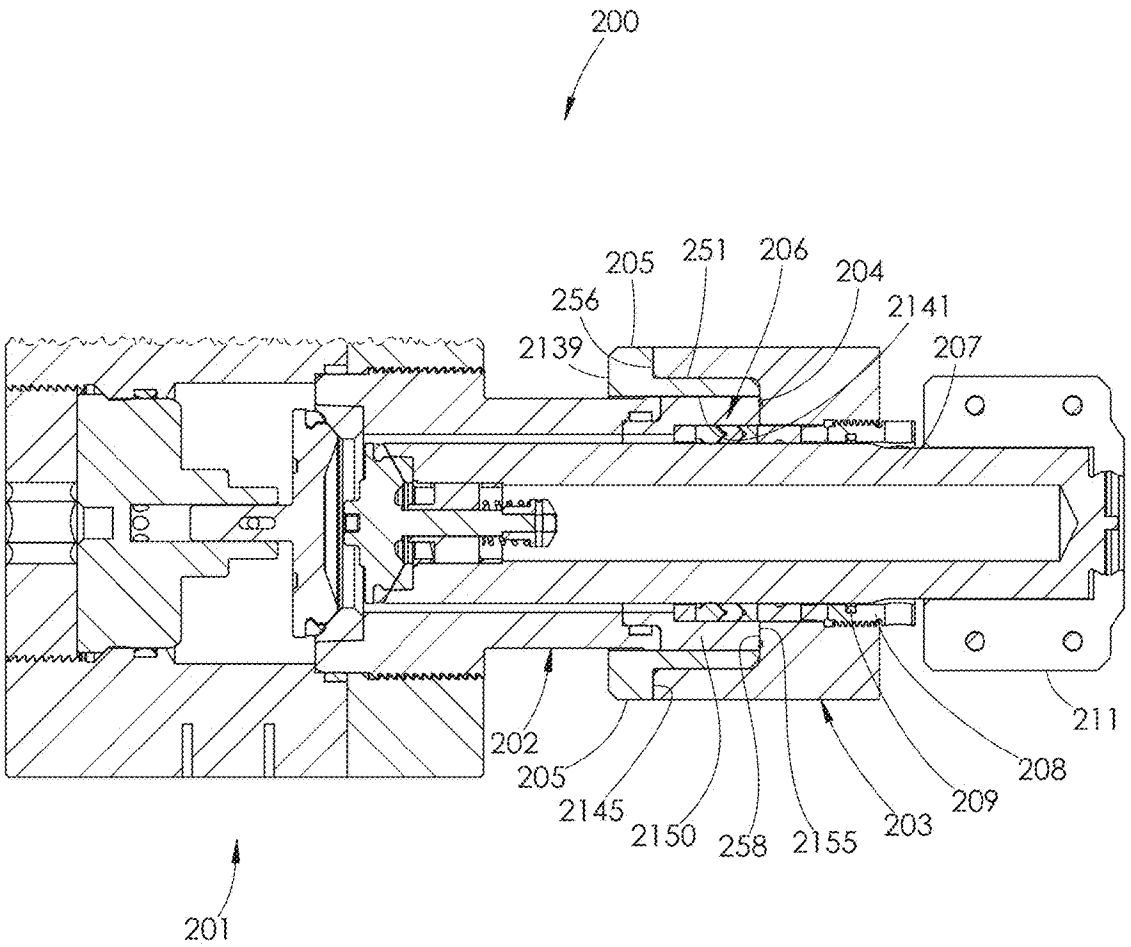
FIG. 96 is a partial cross-sectional view of the fluid end shown in FIG. 81, taken along line Y-Y.

Tenth, the retainer 203 is advanced longitudinally over the packing sleeve 2150 and dynamic section 202 until the rear shoulder 258 of the dynamic flange section 251 of the retainer 203 abuts the rear surface 2155 of the packing sleeve 2150, as shown in FIG. 96. This is done in the same manner as described for the similar retainer 103 of fluid end 100 shown in FIG. 66.

Eleventh, the retainer 203 is rotated about its longitudinal axis until the radial walls 255 of the retainer 203 align radially with the radial walls 2137 and 2165 of the dynamic section 202 and packing sleeve 2150. This is done in the same manner as described for the similar retainer 103 of fluid end 100 shown in FIGS. 66-68.

Twelfth, a retainer lock 205 is oriented and positioned such that the front surface 2139 faces and nearly abuts the rear surface 244 of the rear static section 214. This is done in the same manner as described for the similar retainer lock 105 of fluid end 100 shown in FIGS. 69-70.

Thirteenth, the retainer lock 205 is positioned such that the intermediate inner surface 2141 abuts the retainer flange relief section 278 of the dynamic section 202, and the radial walls 2137 are radially aligned with the already aligned radial walls 255 and 2165 of cutout 254 of the retainer 203 and cutout 2164 of the packing sleeve 2150. This is done in the same manner as described for the similar retainer lock 105 of fluid end 100 shown in FIGS. 70-71.

Fourteenth, the retainer lock 205 is inserted into the annular space between the dynamic flange section 251 of the through bore 249 of the retainer 203 and the cutout surfaces 2138 and 2166 of the dynamic section 202 and packing sleeve 2150 until the limit shoulder 2145 of the retainer lock 205 abuts the cutout surface 256 of the retainer 203, as shown in FIG. 96. This is done in the same manner as described for the similar retainer lock 105 of fluid end 100 shown in FIGS. 70-71.

Fifteenth, steps twelve through fourteen are repeated for a second retainer lock 205.

Sixteenth, the plurality of packing stacks 206, plurality of plunger assemblies 207, plurality of packing nuts 208, plurality of packing nut seals 209, plurality of top plunger suction fittings 210, plurality of bottom plunger suction fittings 211, and plurality of suction fitting connectors 212 may be assembled as shown in FIGS. 95-96. This is done in the same manner described for the similar parts of fluid end 100 and shown in FIGS. 66-80.

Seventeenth, the assembly of the remaining components such as the discharge plug seal 218, discharge valve assembly 217, and discharge plug retainer 219 are assembled as shown in FIGS. 95-96. This is done in the same manner described for the similar parts of fluid end 100 and shown in FIGS. 55 and 80.

Assembly steps five through seventeen may be repeated for each flow bore 225 of front static section 213, preferably in the same manner. The assembly of the fluid end 200 is now complete and may be mounted to a power end using stay rods similar to those shown in the '710 patent. After mounting to a power end, suction conduits (not shown) may be attached to the external threads 2110 of the riser sections 2108 of the top plunger fittings 210, and discharge conduits (not shown) may be attached to discharge fittings (not shown) installed in the discharge bore 227.

The advantages in assembly and operation listed for fluid end 100 are all present in fluid end 200. Fluid end 200 has an additional operational advantage—the packing sleeve 2150 eliminates the need for a wear sleeve such as wear sleeve 167 of fluid end 100, thus simplifying maintenance.

Referring now to FIGS. 100, 101, 128, and 129, another embodiment of a fluid end 300 is shown. The fluid end 300 is similar to fluid ends 100 and 200, but utilizes bolt-on packing sleeves 3150 and retainers 303. The fluid end 300 comprises a static section 301, a plurality of dynamic sections 302, a plurality of packing sleeves 3150, a plurality of retainers 303, a plurality of dynamic section connectors 3167, a plurality of packing stacks 306, a plurality of plunger assemblies 307, a plurality of packing nuts 308, a plurality of packing nut seals 309, a plurality of top plunger suction fittings 310, a plurality of bottom plunger suction fittings 311, and a plurality of suction fitting connectors 312. Because many of the components of fluid end 300 are similar to that of fluid end 100 and fluid end 200, some details may be spared in the description of fluid end 300. An artisan will understand to refer to the description of fluid ends 100 and 200 if needed.

Figure 101:
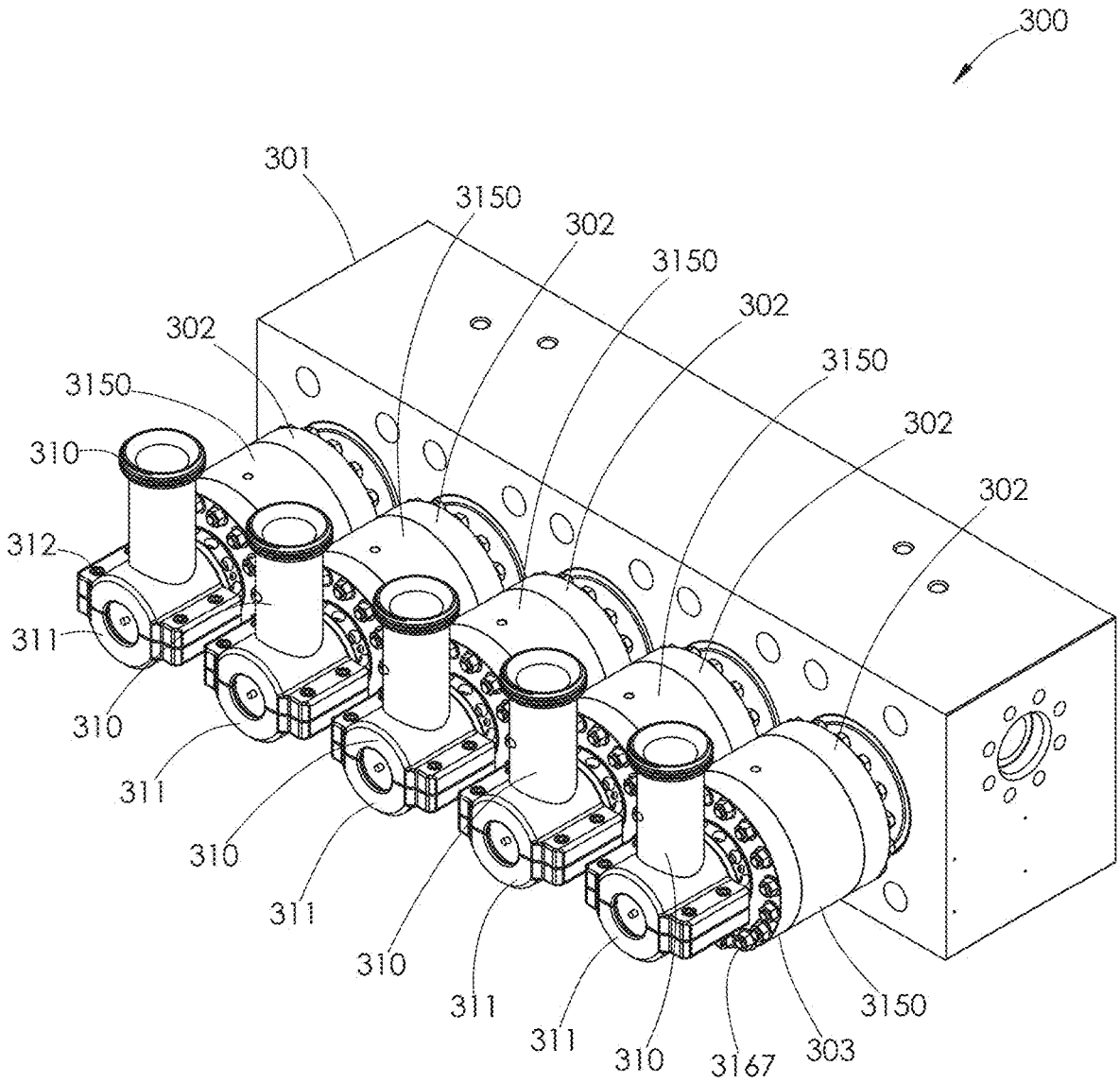
FIG. 101 is a rear perspective view of the fluid end shown in FIG. 100.
Figure 102:
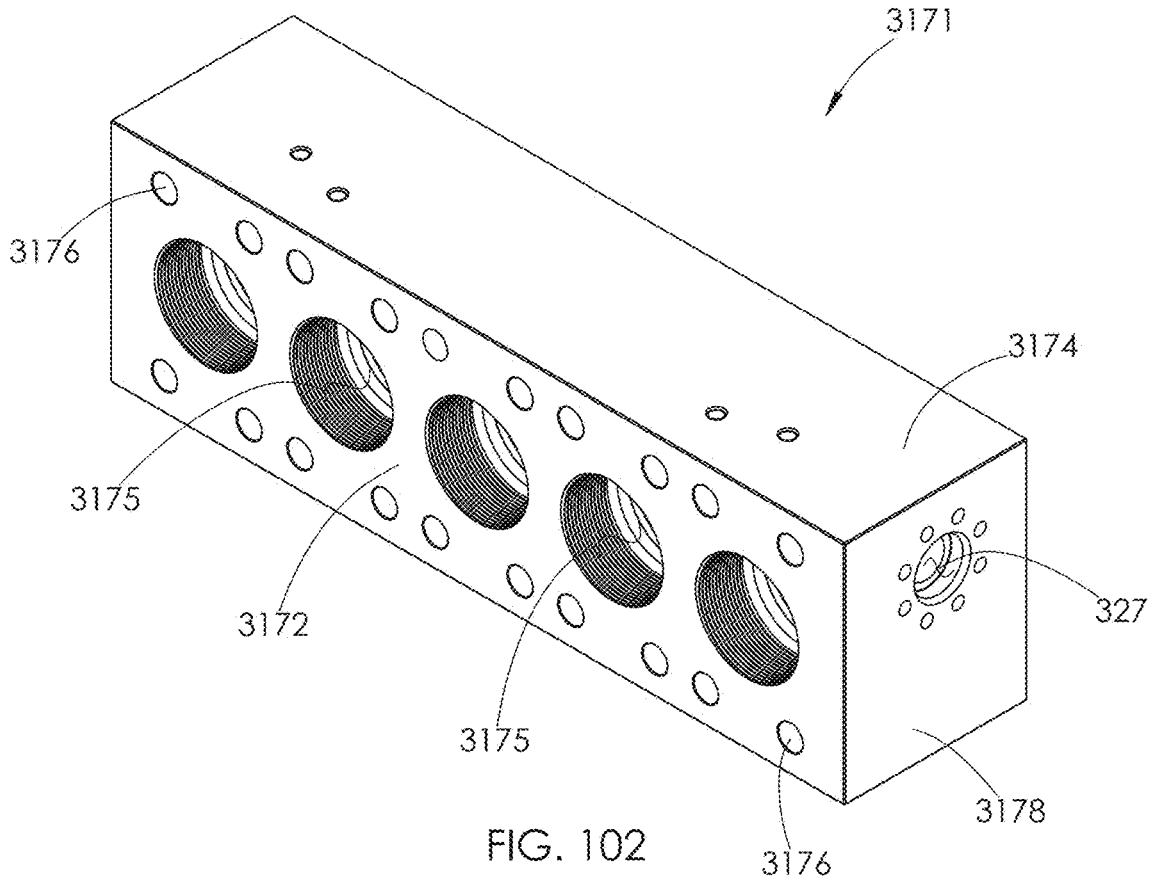
FIG. 102 is a front perspective view of a static section of the fluid end shown in FIG. 100.
Figure 103:
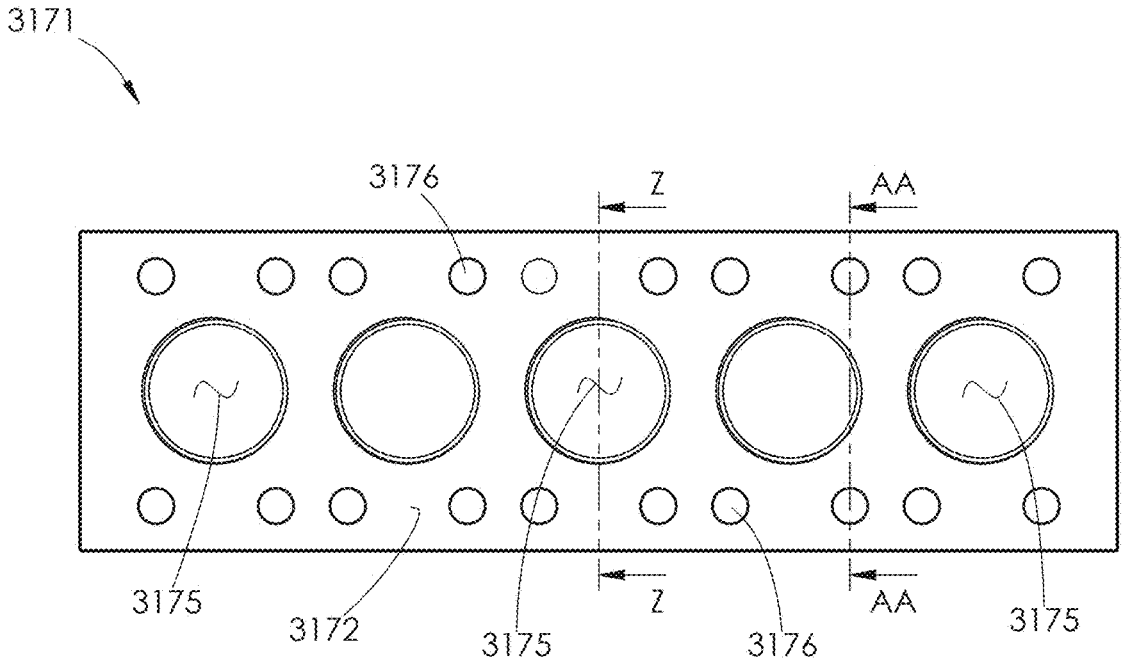
FIG. 103 is a front elevation view of the static section shown in FIG. 102.
Figure 104:
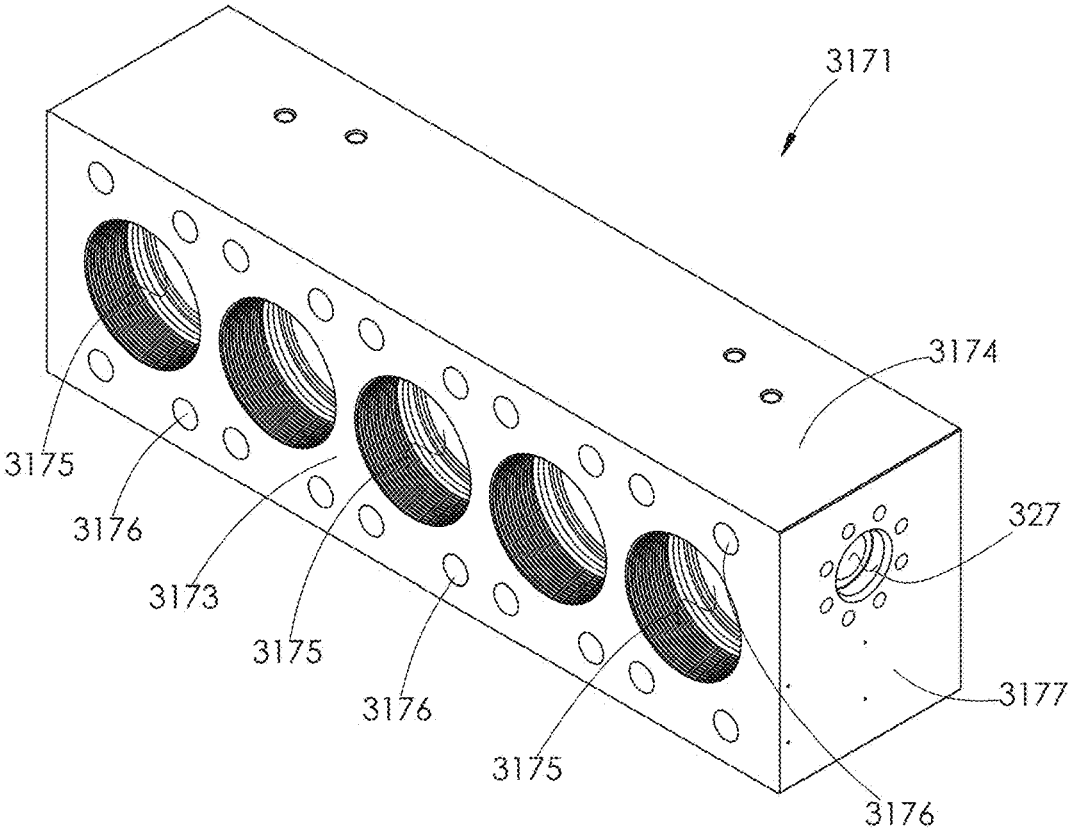
FIG. 104 is a rear perspective view of the static section shown in FIG. 102.
Figure 105:
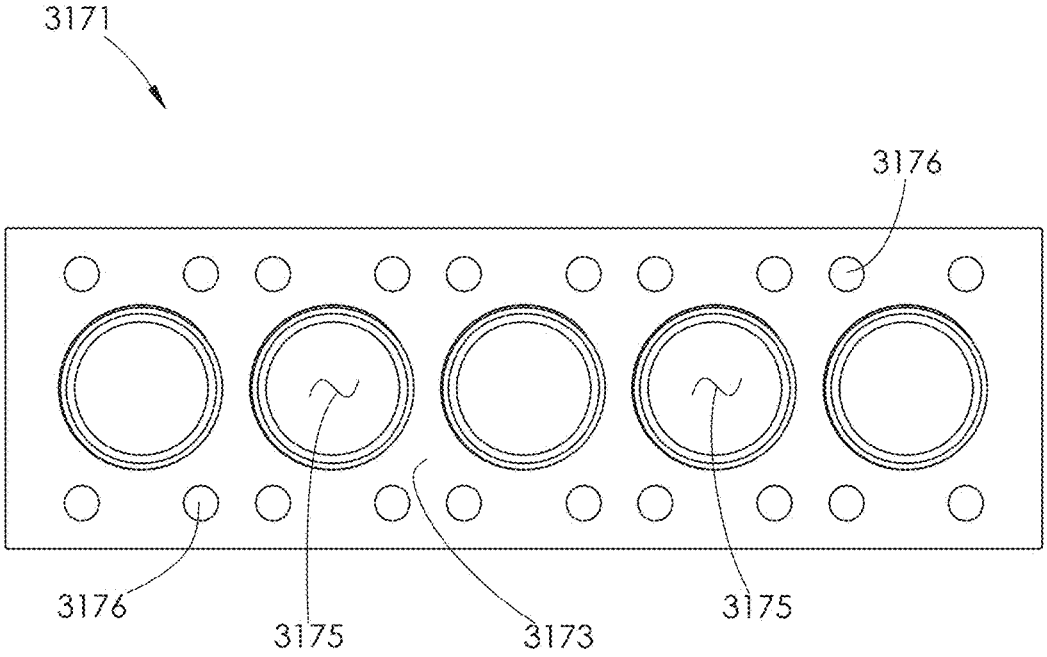
FIG. 105 is a rear elevation view of the static section shown in FIG. 102.
Figure 128:
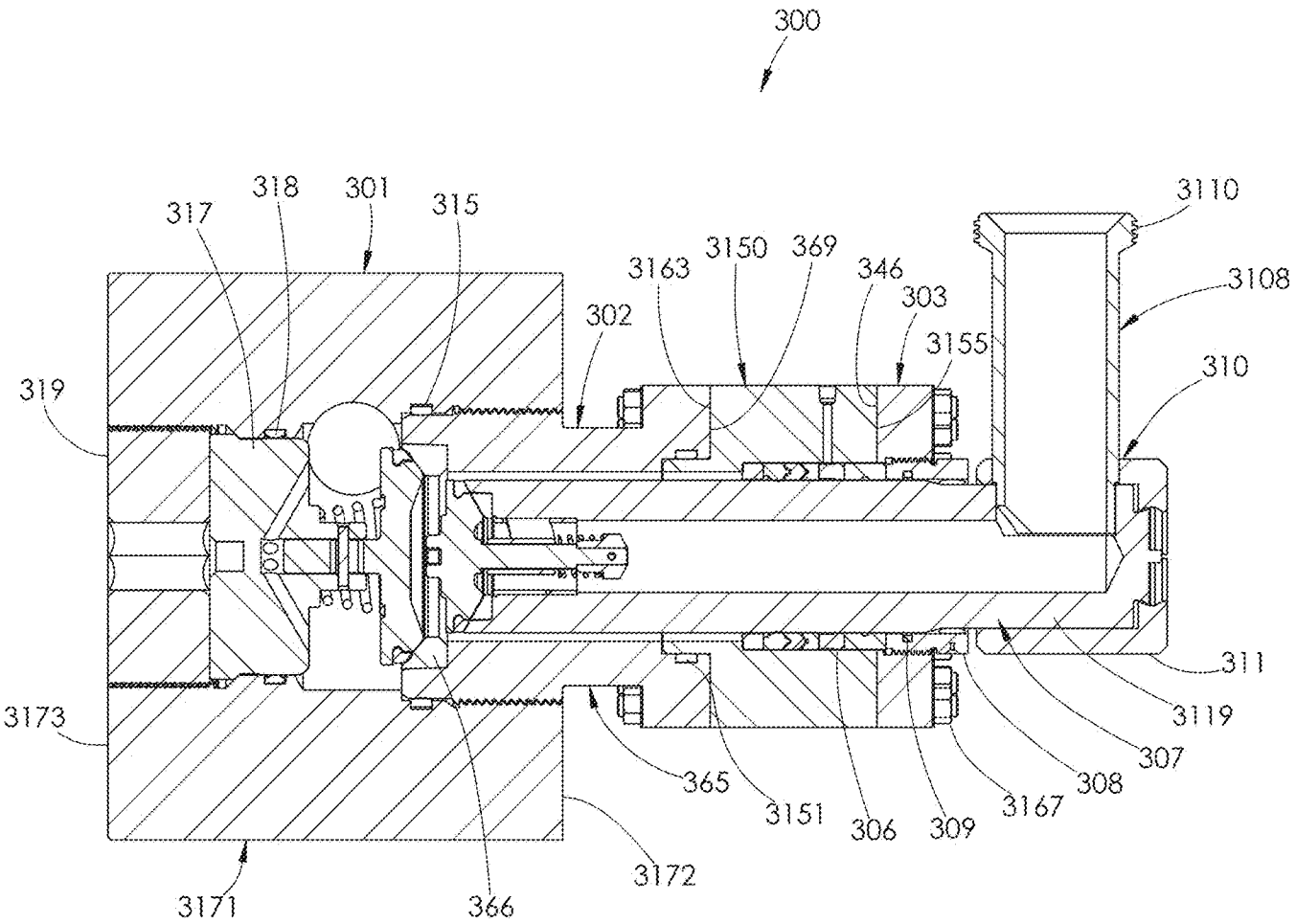

Referring now to FIGS. 100, 101, and 128, the static section 301 comprises a static section body 3171, a plurality of dynamic seals 315, a plurality of discharge valve assemblies 317, a plurality of discharge plug seals 318, and a plurality of discharge plug retainers 319. The static section body 3171 is a single-piece body. In alternative embodiments, the static section 301 may comprise a plurality of static section bodies, such as those shown in static sections 101 and 201.

Referring now to FIGS. 102-109, the static section body 3171 has the general shape of a rectangular prism comprising front 3172 and rear 3173 surfaces connected by an intermediate outer surface 3174. The front 3172 and rear 3173 surfaces are also connected by a plurality of flow bores 3175. The static section body 3171 further comprises a plurality of stay rod through holes 3176, and a discharge bore 327. The stay rod through holes 3176 are parallel to the flow bores 3175, which are perpendicular to the front surface 3172 and parallel to the longitudinal axis of the fluid end 300. The stay rod through holes 3176 are spaced evenly about each flow bore 3175.

Figure 107:
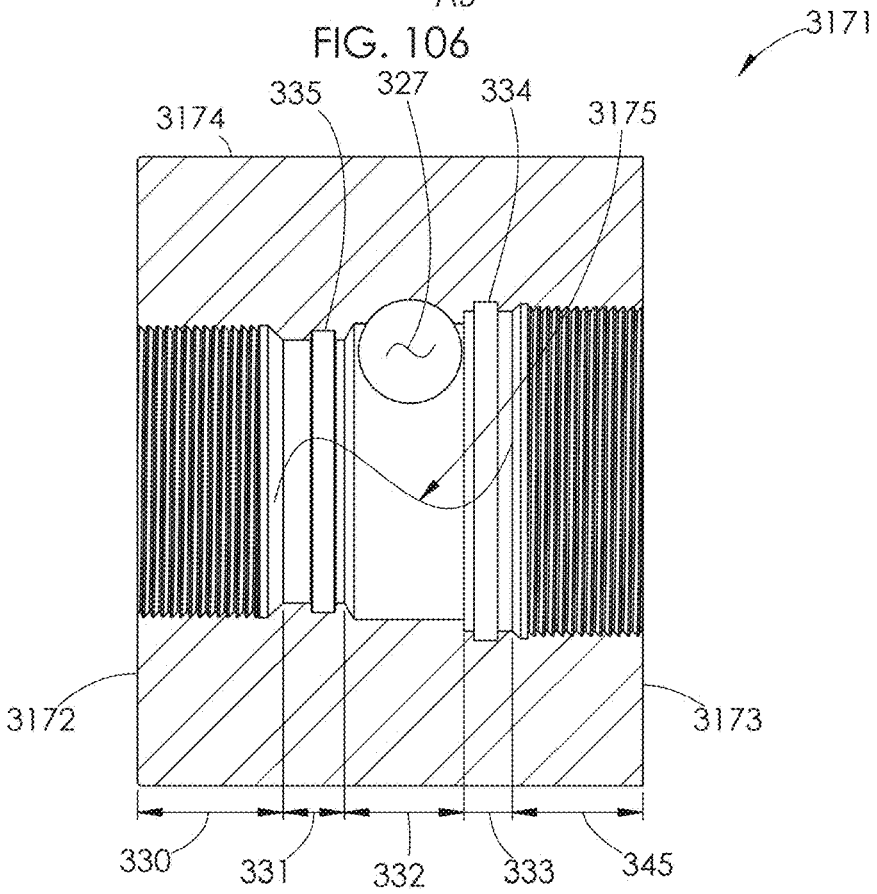
FIG. 107 is a cross-sectional view of the static section shown in FIG. 103, taken along line Z-Z.
Figure 108:
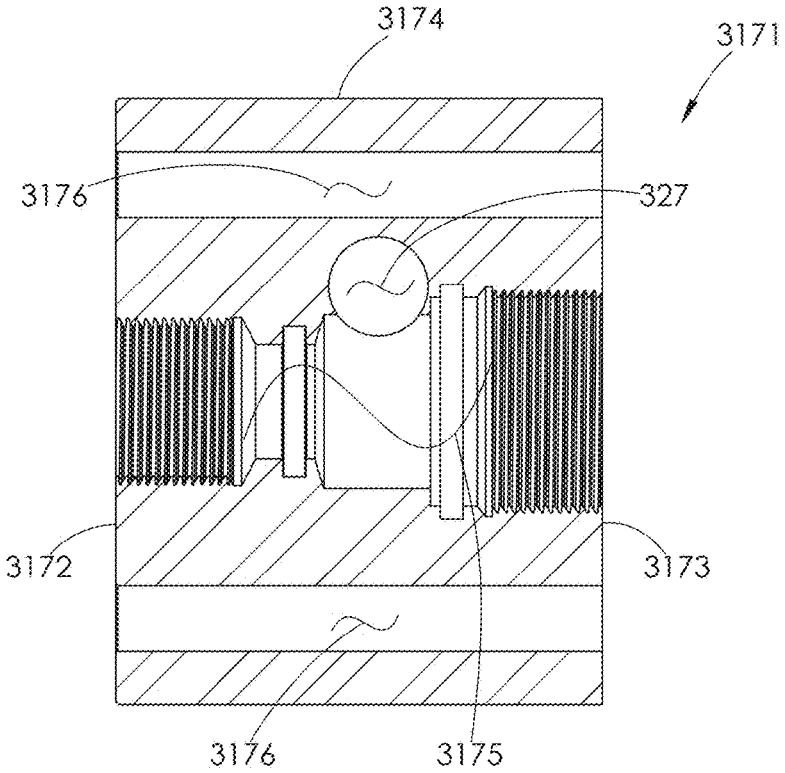
FIG. 108 is a cross-sectional view of the static section shown in FIG. 103, taken along line AA-AA.

Referring now to FIG. 107, each flow bore 3175 connects the front 3172 and rear 3173 surfaces of the static section body 3171. Beginning at the front surface 3172 and continuing along the bore axis to the rear surface 3173, each flow bore 3175 comprises a discharge plug thread 330, a discharge plug section 331, a chamber section 332, a dynamic seal section 333, and a dynamic section thread 345. The discharge plug section 331 comprises a discharge plug seal groove 335. The dynamic seal section 333 comprises a dynamic seal groove 334.

Figure 106:
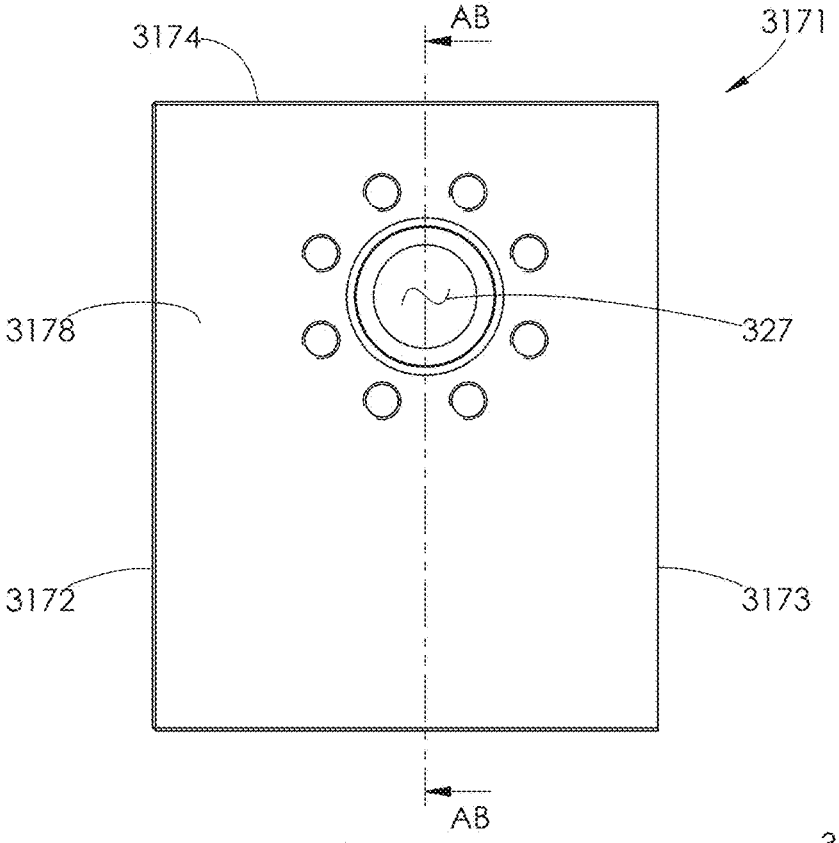
FIG. 106 is a right side elevation view of the static section shown in FIG. 102.
Figure 109:
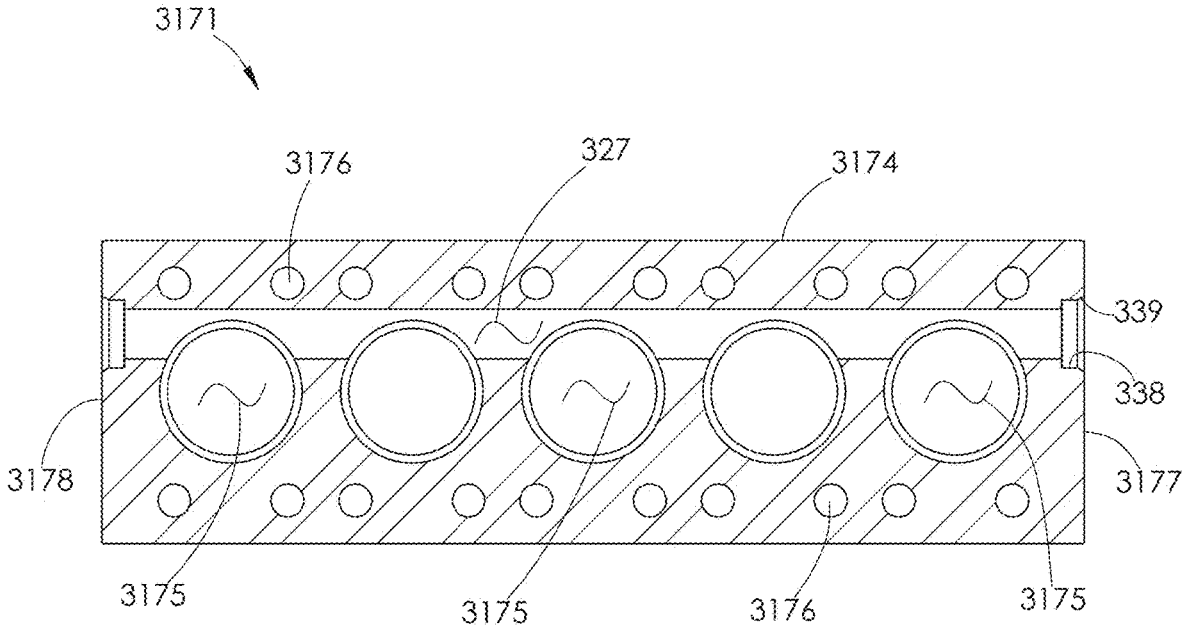
FIG. 109 is a cross-sectional view of the static section shown in FIG. 106, taken along line AB-AB.
Figure 110:
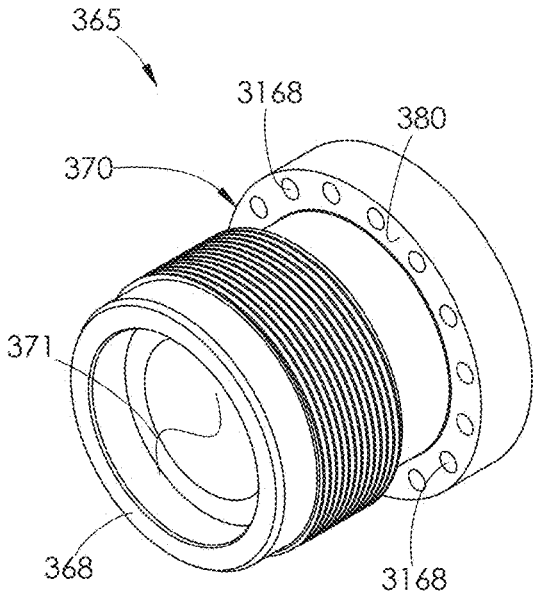
FIG. 110 is a front perspective view of a dynamic section of the fluid end shown in FIG. 100.
Figure 111:
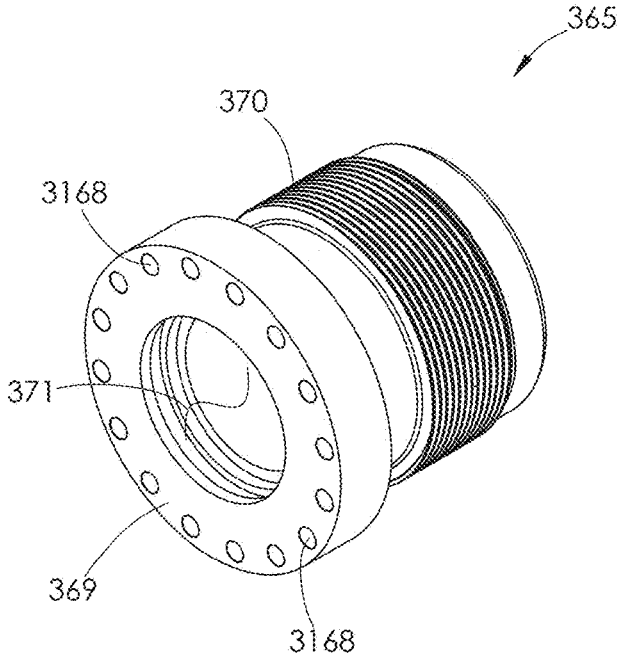
Figure 112:
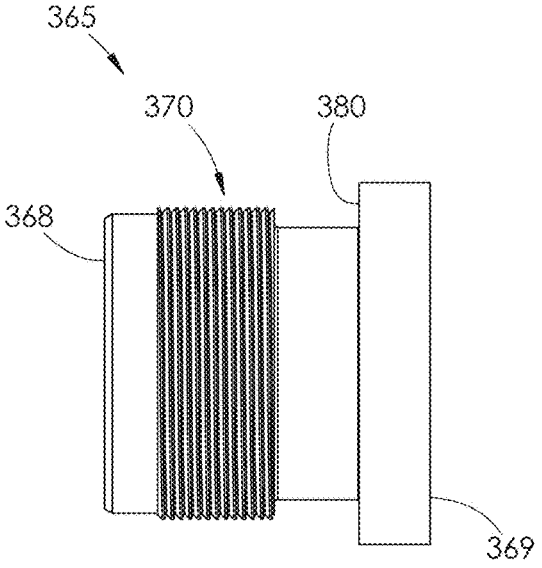
FIG. 112 is a top plan view of the dynamic section shown in FIG. 110.
Figure 113:
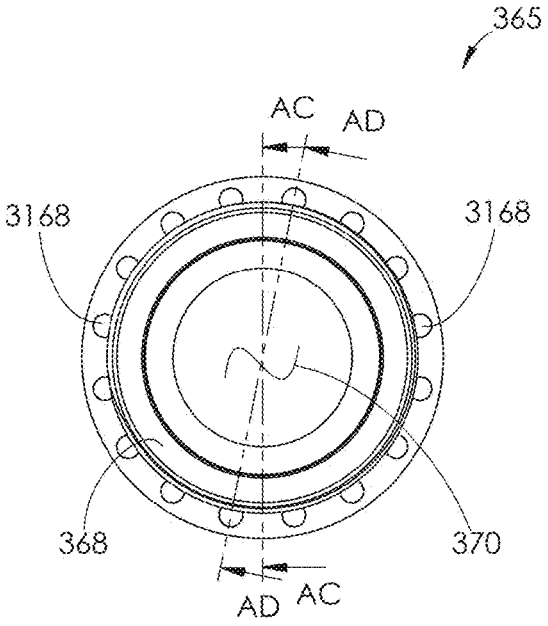
FIG. 113 is a front elevation view of the dynamic section shown in FIG. 110.

Referring now to FIGS. 106, 107, and 109, the discharge bore 327 connects the left 3177 and right 3178 side surfaces of the static section body 3171. The discharge bore 327 also partially intersects each of the plurality of flow bores 3175, specifically in the chamber section 332 of each flow bore 3175. The discharge bore 327 further comprises a counterbore 338 and countersink 339 at the intersection of the discharge bore 327 and each side surface 3177 and 3178 to facilitate the connection of discharge fittings (not shown).

Figure 131:
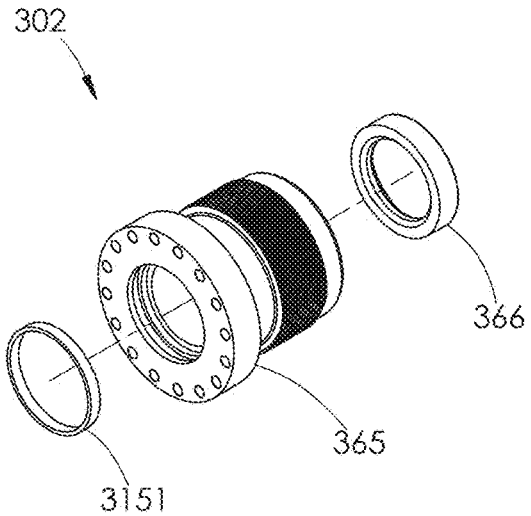

Referring now to FIGS. 128 and 131, each dynamic section 302 comprises a dynamic section body 365, a discharge valve seat 366, and a packing sleeve seal 3151.

Figure 114:
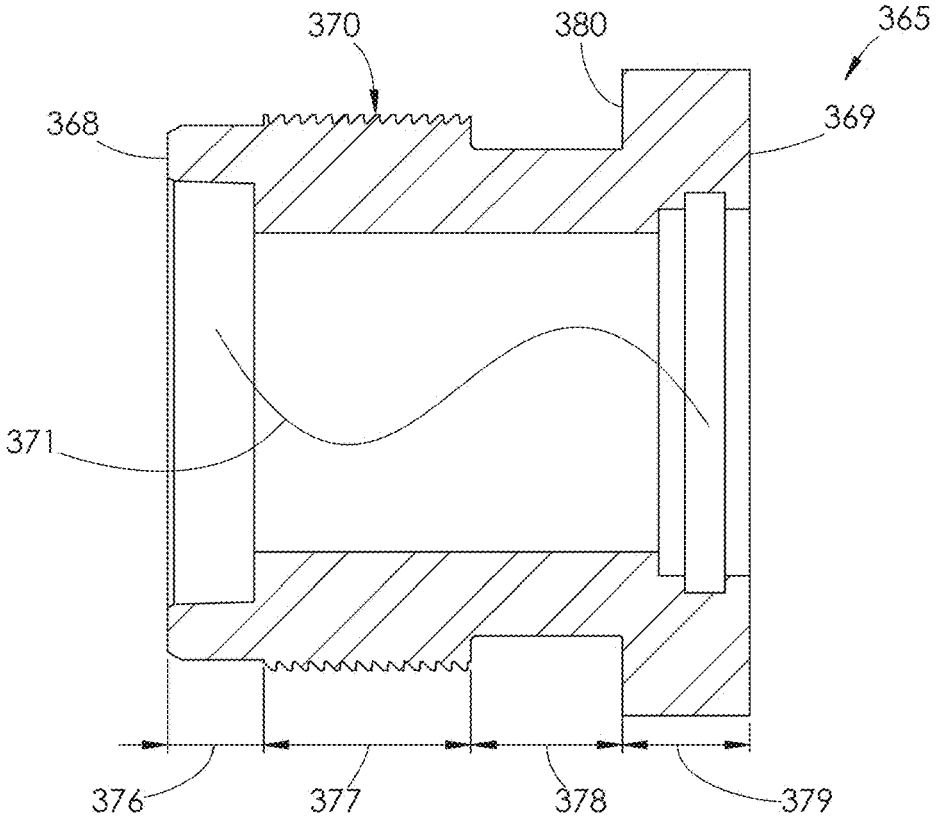
FIG. 114 is a cross-sectional view of the dynamic section shown in FIG. 113, taken along line AC-AC.
Figure 115:
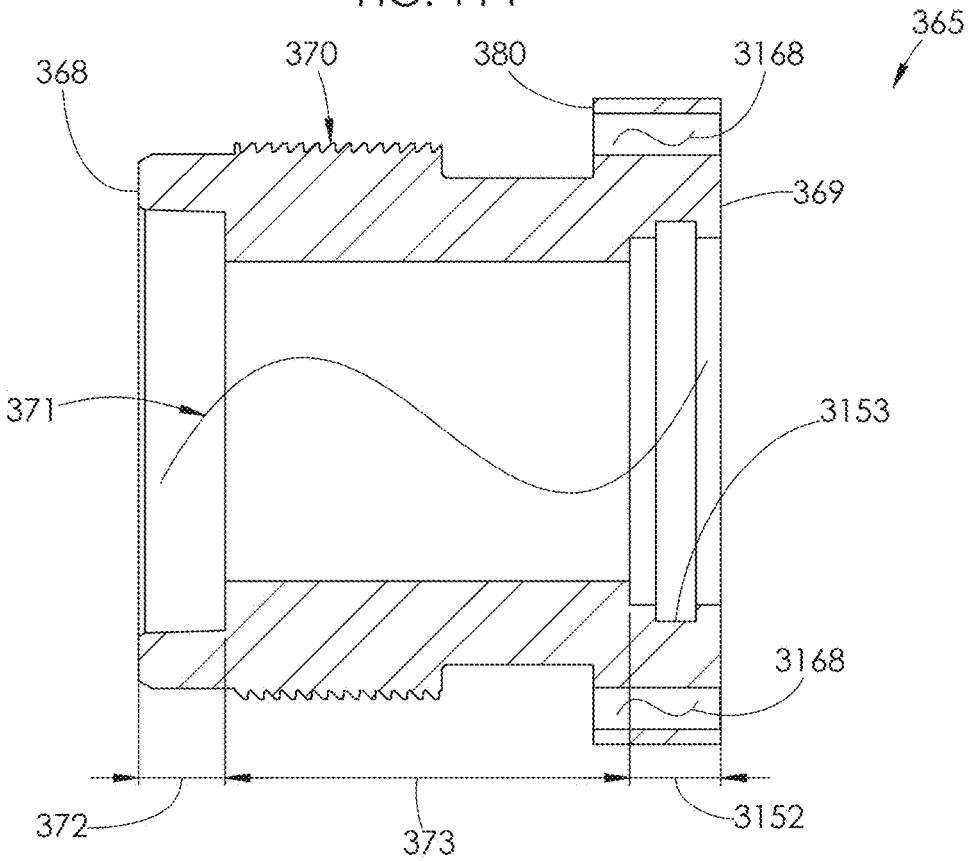
FIG. 115 is a cross-sectional view of the dynamic section shown in FIG. 113, taken along line AD-AD.
Figure 116:
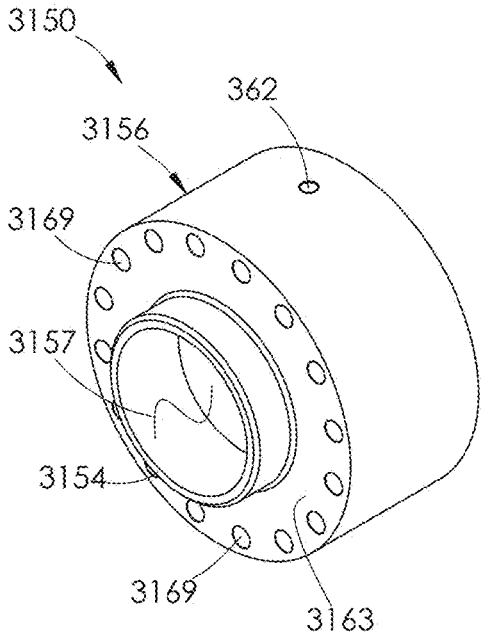
FIG. 116 is a front perspective view of a packing sleeve of the fluid end shown in FIG. 100.
Figure 117:
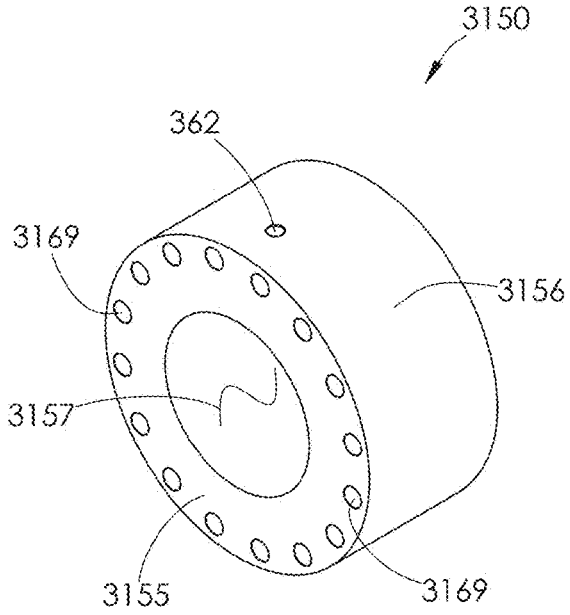
FIG. 117 is a rear perspective view of the packing sleeve shown in FIG. 116.
Figure 118:
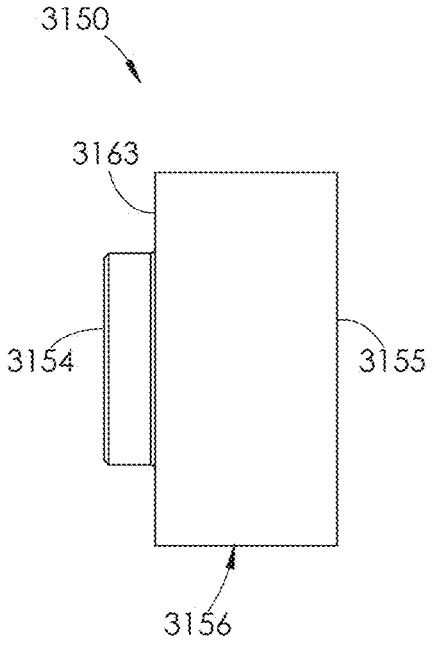
FIG. 118 is a top plan view of the packing sleeve shown in FIG. 116.
Figure 119:
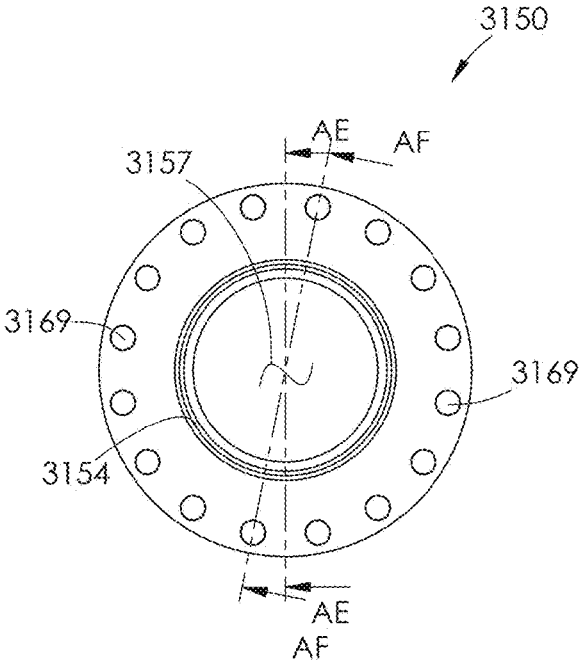
FIG. 119 is a front elevation view of the packing sleeve shown in FIG. 116.

Referring now to FIGS. 110-115, the dynamic section body 365 has a generally cylindrical shape comprising opposed front 368 and rear 369 surfaces connected by an intermediate outer surface 370. The dynamic section body 365 further comprises a through bore 371 that also connects the front 368 and rear 369 surfaces. The bore axis of the through bore 371 is collinear with the longitudinal axis of the dynamic section body 365. Beginning at the front surface 368 and continuing along the bore axis to the rear surface 369, each through bore 371 comprises a discharge valve seat section 372, a plunger section 373, and a packing sleeve section 3152, as shown in FIG. 115. The packing sleeve section 3152 comprises a packing sleeve seal groove 3153.

The intermediate outer surface 370 also has areas with different features. Beginning at the front surface 368 and continuing to the rear surface 369, each intermediate outer surface 370 comprises a dynamic seal section 376, an external thread 377, a relief section 378, and a packing sleeve flange 379. The relief section 378 has a smaller diameter than packing sleeve flange 379, thus forming a rear shoulder 380, as shown in FIG. 114.

The dynamic section body 365 further comprises a plurality of stud through holes 3168. In this embodiment, there are sixteen stud through holes 3168 to match the number of stud through holes 3169 and 3170 in the packing sleeve 3150 and retainer 303, however there may more or less if desired. Each stud through hole 3168 connects the rear surface 369 and the rear shoulder 380. The bore axis of each stud through hole 3168 is parallel to the longitudinal axis of the dynamic section 302. The stud through holes 3168 are spaced evenly about the circumference of the packing sleeve flange 379. The even circumferential spacing results in an 11.25-degree circumferential spacing between adjacent stud through holes 3168. In alternative embodiments, the circumferential spacing may not be even. The radial location of the stud through holes 3168 is near the intermediate outer surface 370 and far enough from the relief section 378 to allow assembly of the dynamic section connector 3167. The circumferential and radial locations of the stud through holes 3168 match the circumferential and radial locations of the stud through holes 3169 and 3170 in the packing sleeve 3150 and retainer 303 when assembled.

Figure 120:
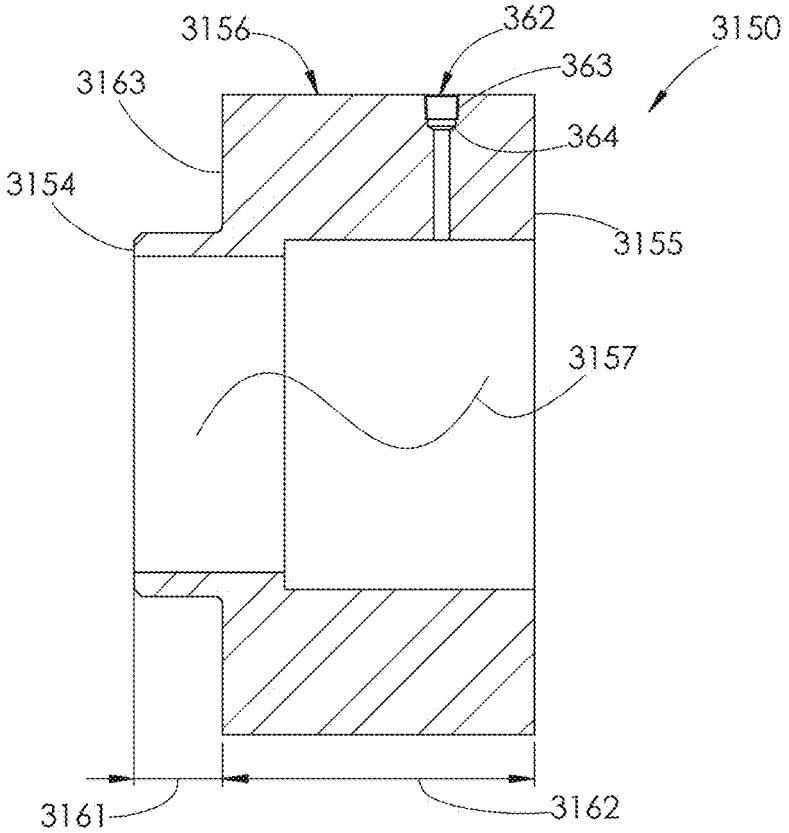
Figure 121:
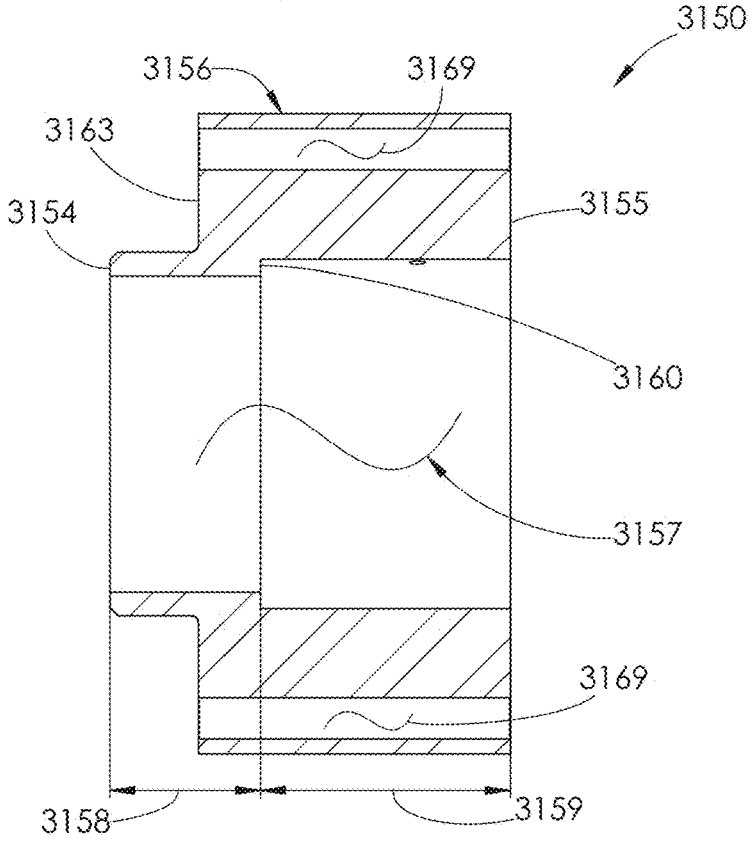
Figure 122:
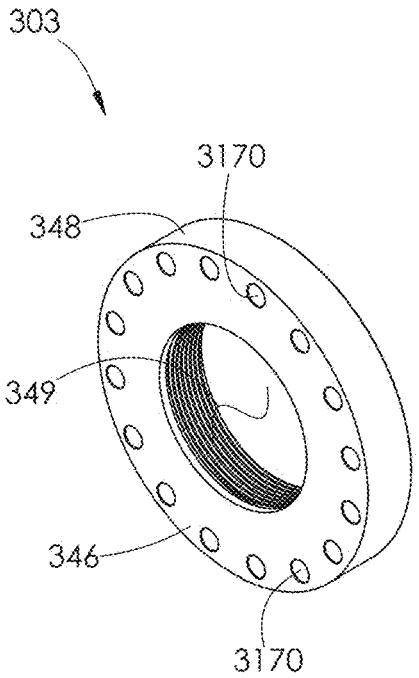
Figure 123:
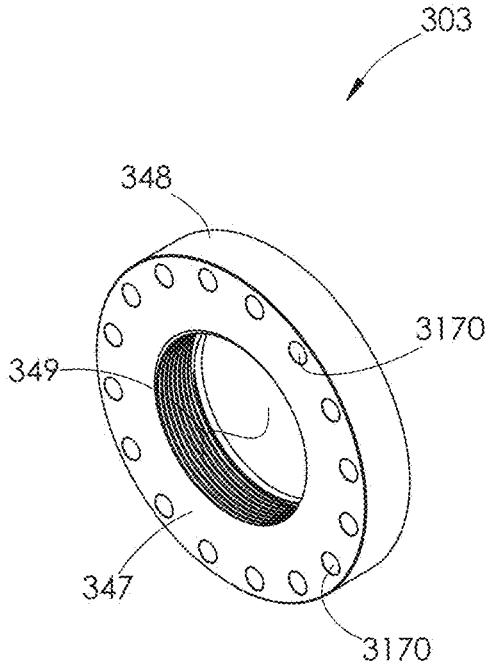
Figure 124:
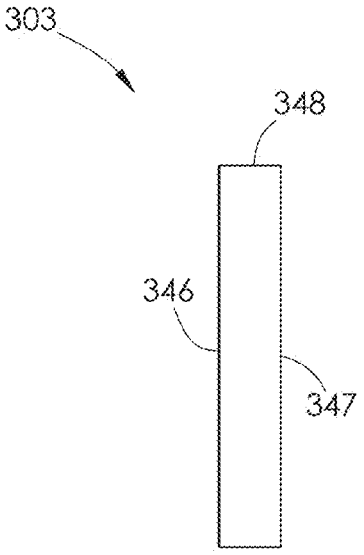
Figure 125:
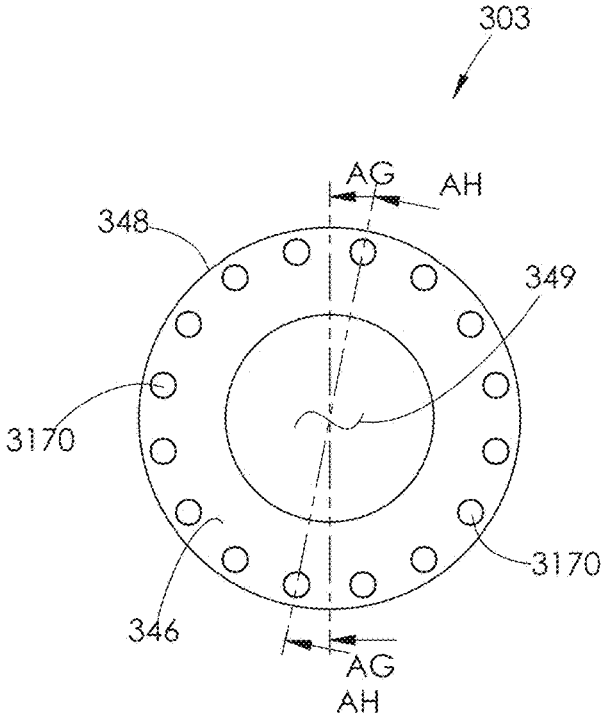
Figure 126:
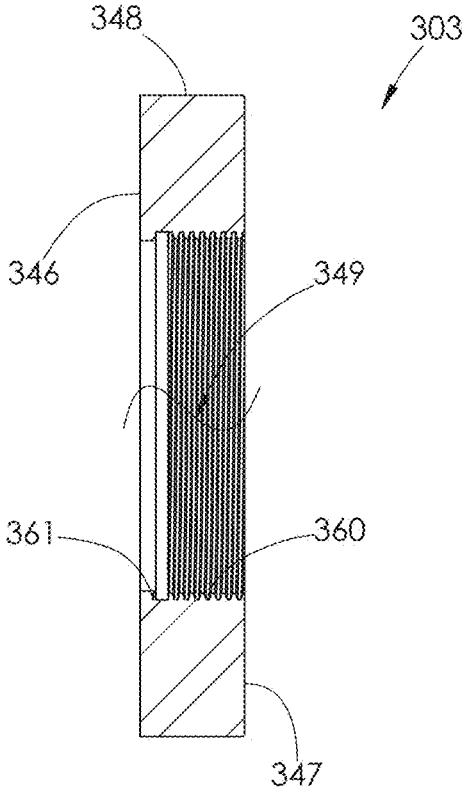
Figure 127:
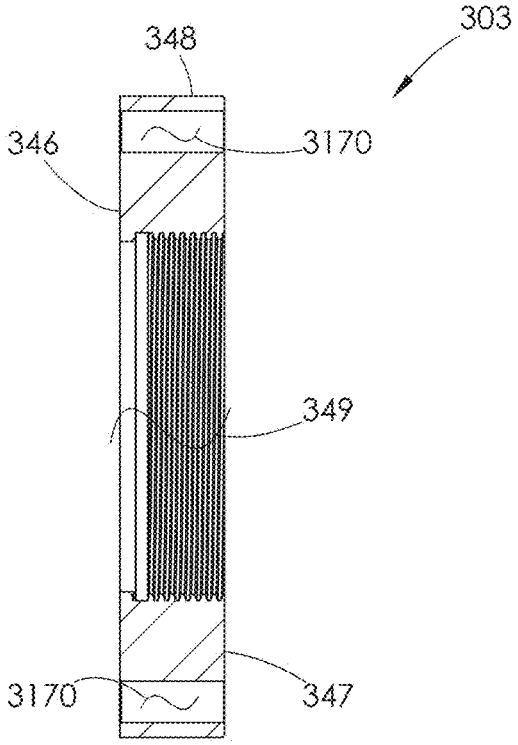

Referring now to FIGS. 116-121, the packing sleeve 3150 has a generally cylindrical shape comprising opposed front 3154 and rear 3155 surfaces connected by an intermediate outer surface 3156. The packing sleeve 3150 further comprises a through bore 3157 that also connects the front 3154 and rear 3155 surfaces. The bore axis of the through bore 3157 is collinear with the longitudinal axis of the packing sleeve 3150. As shown in FIG. 121, the through bore 3157 comprises a plunger section 3158 and a packing section 3159. The packing section 3159 has a larger diameter than the plunger section 3158, which forms a packing shoulder 3160 at the transition between the packing section 3159 and plunger section 3158.

The intermediate outer surface 3156 comprises a packing sleeve seal section 3161 and an outer limit section 3162. The packing sleeve seal section 3161 has a smaller diameter than the outer limit section 3162, thus forming a packing sleeve shoulder 3163, as shown in FIG. 120.

The packing sleeve 3150 further comprises a plurality of stud through holes 3169. In this embodiment, there are sixteen stud through holes 3169 to match the number of stud through holes 3168 and 3170 in the dynamic section body 365 and retainer 303, however there may more or less if desired. Each stud through hole 3169 connects the packing sleeve shoulder 3163 and the rear surface 3155. The bore axis of each stud through hole 3169 is parallel to the longitudinal axis of the packing sleeve 3150. The stud through holes 3169 are spaced evenly about the circumference of the packing sleeve shoulder 3163. The even circumferential spacing results in an 11.25-degree circumferential spacing between adjacent stud through holes 3169. In alternative embodiments, the circumferential spacing may not be even. The radial location of the stud through holes 3169 is near the intermediate outer surface 3156. The circumferential and radial locations of the stud through holes 3169 match the circumferential and radial locations of the stud through holes 3168 and 3170 in the dynamic section body 365 and retainer 303 when assembled.

The packing sleeve 3150 further comprises a lubrication port 362 connecting the intermediate outer surface 3156 to the packing section 3159 of the through bore 3157. The lubrication port 362 may have internal threads 363 and/or a counterbore 364 configured to accept a lubrication fitting (not shown) as needed.

Referring now to FIGS. 122-127, the retainer 303 has a generally cylindrical shape comprising opposed front 346 and rear 347 surfaces connected by an intermediate outer surface 348. The retainer 303 further comprises a through bore 349 that also connects the front 346 and rear 347 surfaces. The bore axis of the through bore 349 is collinear with the longitudinal axis of the retainer 303. Each through bore 349 comprises an internal thread 360 and a thread relief 361.

The retainer 303 further comprises a plurality of stud through holes 3170. In this embodiment, there are sixteen stud through holes 3170 to match the number of stud through holes 3168 and 3169 in the dynamic section body 365 and packing sleeve 3150, however there may more or less if desired. Each stud through hole 3170 connects the front 346 and rear surfaces 347. The bore axis of each stud through hole 3170 is parallel to the longitudinal axis of the retainer 303. The stud through holes 3170 are spaced evenly about the circumference of the retainer 303. The even circumferential spacing results in an 11.25-degree circumferential spacing between adjacent stud through holes 3170. In alternative embodiments, the circumferential spacing may not be even. The radial location of the stud through holes 3170 is near the intermediate outer surface 348. The circumferential and radial locations of the stud through holes 3170 match the circumferential and radial locations of the stud through holes 3168 and 3169 in the dynamic section body 365 and packing sleeve 3150 when assembled.

Figure 129:
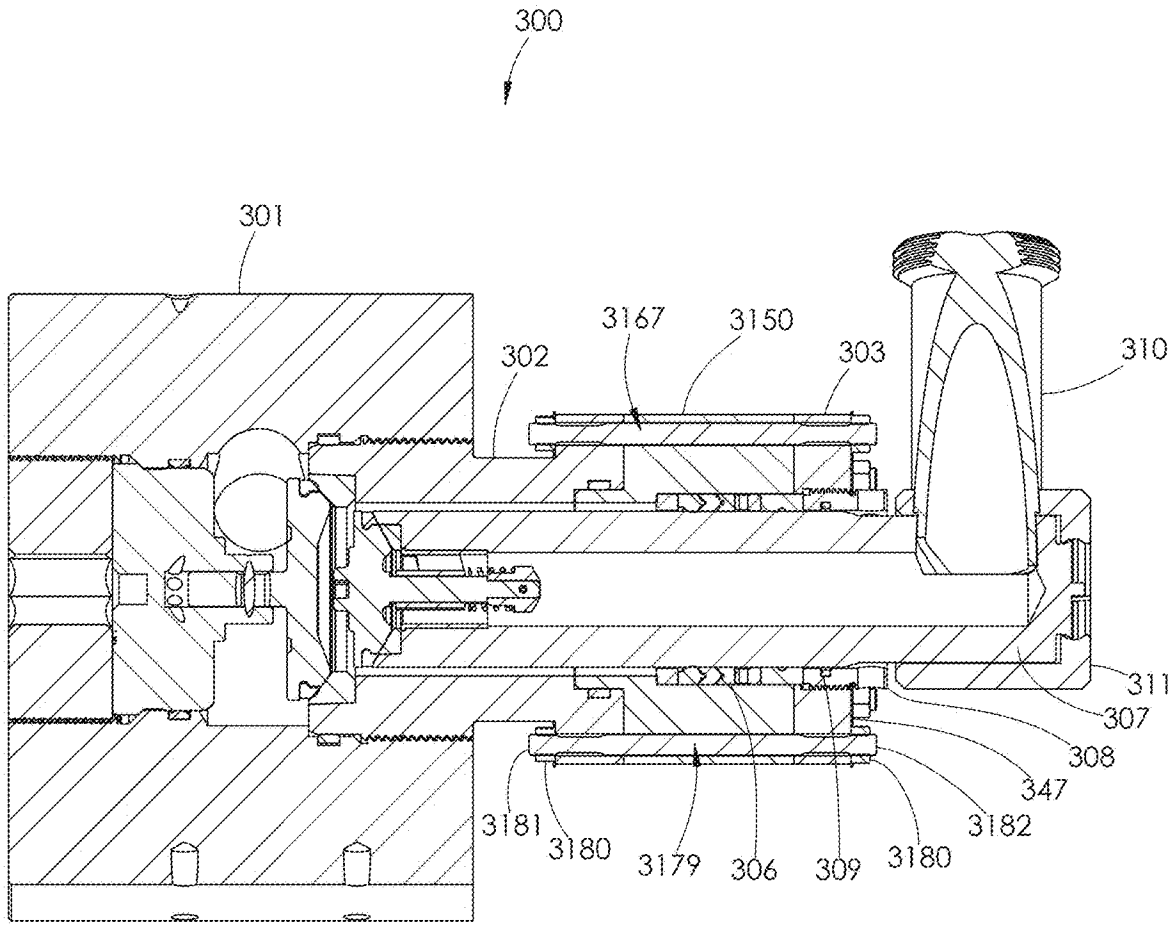

Referring now to FIGS. 129 and 133, each dynamic section connector 3167 comprises a stud 3179 and a plurality of nuts 3180. Each stud 3179 comprises a first threaded end 3181 and a second threaded end 3182.

Referring now to FIGS. 78-80, 100-101, and 128-135, the assembly of the fluid end 300 will be discussed. Reference may be made to the assembly of fluid end 100 when necessary.

Figure 130:
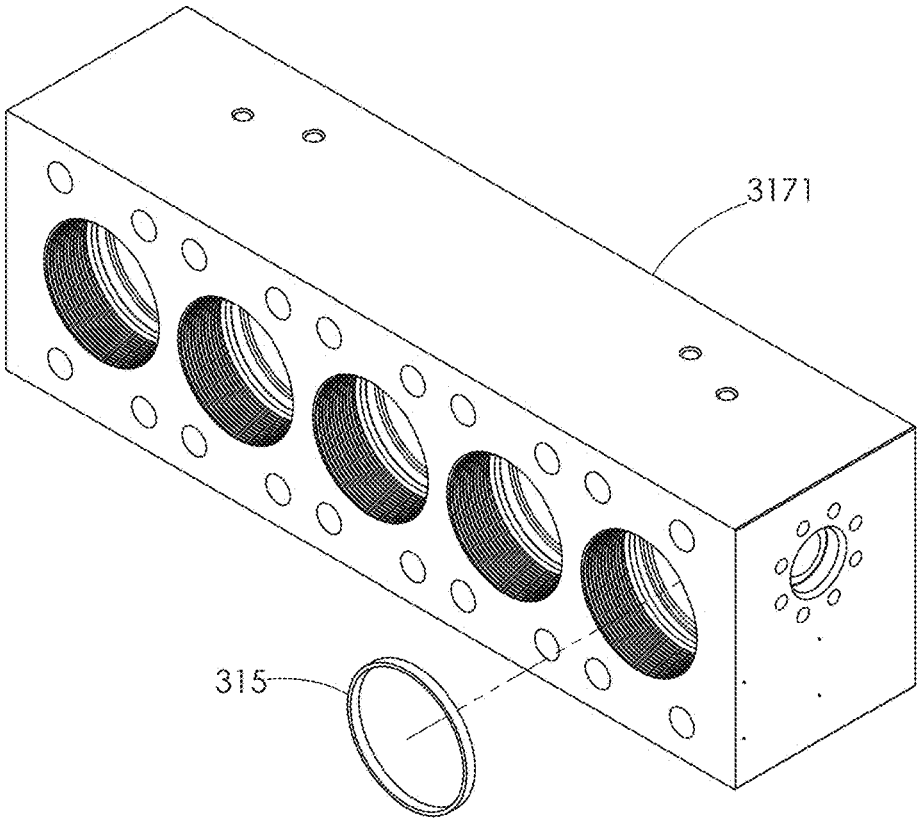

First, the dynamic seals 315 are installed in the static section body 3171 of the static section 301 as shown in FIGS. 128 and 130.

Second, the dynamic sections 302 are assembled by pressing the discharge valve seats 366 into the discharge valve seat sections 372 of the through bores 371 of each dynamic section body 365 and installing the packing sleeve seals 3151 in the packing sleeve seal grooves 3153 of the packing sleeve sections 3152 of the through bores 371, as shown in FIGS. 115, 128, and 131.

Third, each dynamic section 302 is threaded into the static section body 3171, as shown in FIGS. 128 and 132.

Fourth, the packing sleeve seal section 3161 of the intermediate outer surface 3156 of a packing sleeve 3150 is aligned with the through bore 371 of a dynamic section body 365 and inserted into the packing sleeve section 3152 until the packing sleeve shoulder 3163 abuts the rear surface 369 of the dynamic section body 365 as shown in FIGS. 115, 120, 128, and 133. At this point in the assembly the packing sleeve seal section 3161 will also be inserted into the packing sleeve seal 3151.

Fifth, the packing sleeve 3150 is rotated until the stud through holes 3169 align with the stud through holes 3168 of the dynamic section body 365, as shown in FIGS. 115, 121, 129, and 133.

Sixth, the first threaded end 3181 of a stud 3179 is inserted in a stud through hole 3169 of the packing sleeve 3150 and further through an aligned stud through hole 3168 of the dynamic section body 365 until the first threaded end 3181 protrudes from the rear shoulder 380 of the dynamic section body 365, as shown in FIGS. 115, 121, 129 and 133.

Seventh, a nut 3180 is threaded on the protruding first threaded end 3181 as shown in FIGS. 129 and 133.

Eighth, steps six and seven are repeated for each stud through hole 3169. At this point in the assembly, the second threaded ends 3182 will be protruding from the rear surface 3155 of the packing sleeve 3150.

Ninth, the front surface 346 of the retainer 303 is oriented to face the rear surface 3155 of the packing sleeve 3150, as shown in FIGS. 128 and 133. The retainer 303 is further oriented rotationally such that the stud through holes 3170 align with the protruding second threaded ends 3182 of the studs 3179, as shown in FIGS. 129 and 133.

Tenth, the retainer 303 is advanced longitudinally until the front surface 346 of the retainer 303 abuts the rear surface 3155 of the packing sleeve 3150, as shown in FIGS. 128 and 133.

Eleventh, nuts 3180 are threaded on the second threaded ends 3182 of each of the studs 3179 that are now protruding from the rear surface 347 of the retainer 303, and torqued to specification, as shown in FIGS. 129 and 133.

Twelfth, the packing stack 306 is inserted into the now aligned through bores 349, 3157, and 371 of the retainer 303, packing sleeve 3150, and dynamic section 302, as shown in FIGS. 128 and 134.

Thirteenth, the plunger assembly 307 is inserted in the through bores 349, 3157, and 371 into the packing stack 306, as shown in FIGS. 128 and 134.

Fourteenth, the packing nut seal 309 is inserted into the packing nut 308, as shown in FIGS. 128 and 134.

Fifteenth, the packing nut 308 and installed packing nut seal 309 are threaded into the internal thread 360 of the through bore 349 of the retainer 303, while simultaneously advancing over the plunger assembly 307, and torqued until the desired compressive load is achieved on the packing stack 306, as shown in FIGS. 128 and 134.

Sixteenth, top 310 and bottom 311 plunger suction fittings are assembled to the plunger 3119 using the plurality of suction fitting connectors 312, as shown in FIGS. 128 and 135. This is done in the same manner described for the similar parts of fluid end 100 and shown in FIGS. 55 and 77.

Seventeenth, the discharge valve assembly 317 is assembled as shown in FIG. 128. This is done in the same manner described for the similar parts of fluid end 100 and shown in FIGS. 78-79.

Eighteenth, the discharge plug seal 318, discharge valve assembly 317, and discharge plug retainer 319 are assembled as shown in FIG. 128. This is done in the same manner described for the similar parts of fluid end 100 and shown in FIGS. 55 and 80.

Assembly steps four through eighteen may be repeated for each flow bore 3175 of static section body 3171, preferably in the same manner. The assembly of the fluid end 300 is now complete and it may be mounted to a power end using stay rods similar to those shown in the '710 patent. After mounting to a power end, suction conduits (not shown) may be attached to the external threads 3110 of the riser sections 3108 of the top plunger fittings 310, and discharge conduits (not shown) may be attached to discharge fittings (not shown) installed in the discharge bore 327.

In operation, stress concentrations due to the presence of intersecting bores have been eliminated along with the intersecting bores. This increases the life of the fluid end 300. The fluid end 300 also has the operational advantage of the packing sleeve 3150, which eliminates the need for a wear sleeve such as wear sleeve 167 of fluid end 100, thus simplifying maintenance.

The fluid end described herein has various embodiments of sections, bodies, assemblies, and components attached to each other. One of skill in the art will appreciate that the various sections, bodies, assemblies, and components described herein may have different shapes and sizes, depending on the shape and size of the various sections, bodies, assemblies, and components chosen to assemble each fluid end.

One or more kits may be useful in assembling a fluid end out of the various sections, bodies, assemblies, and components described herein. A single kit may comprise a plurality of one of the various embodiments of sections, bodies, assemblies, and components described herein. The kit may even further comprise a plurality of one or more of the various sections, bodies, assemblies, and components attached to the various sections, bodies, assemblies, and components described herein.

The various features and alternative details of construction of the apparatuses described herein for the practice of the present technology will readily occur to the skilled artisan in view of the foregoing discussion. It is to be understood that even though numerous characteristics and advantages of various embodiments of the present technology have been set forth in the foregoing description, together with details of the structure and function of various embodiments of the technology, this detailed description is illustrative only. Changes may be made in detail, especially in matters of structure and arrangements of parts within the principles of the present technology to the full extent indicated by the broad general meaning of the terms in which the appended claims are expressed. Changes may also be made in the construction, operation and arrangement of the various parts, elements, steps, and procedures described herein without departing from the spirit and scope of the invention.

The invention claimed is:

1. A fluid end, comprising:

a first section comprising a plurality of plunger bores formed therein, each plunger bore joining opposed first and second threaded openings formed in the first section;

a plurality of second sections, each second section configured to thread at least partially into a selected one of the second threaded openings, each second section comprising a through bore coaxially aligned with a selected plunger bore; and a plurality of reciprocating plungers, each plunger configured to extend at least partially within a selected through bore and at least partially within a selected plunger bore, in which each plunger comprises:

a first end and an opposed second end;

a blind suction bore formed on the first end;

a suction fitting bore formed perpendicular to the suction bore;

a sleeve installed within the suction bore; and a valve seat installed within the first end of the plunger such that the sleeve is situated intermediate the valve seat and the second end of the plunger;

in which the number of second sections is the same as the number of plunger bores.

2. The fluid end of claim 1, in which each plunger further comprises:

a valve assembly, comprising:

a valve body configured to seal against the valve seat;

a stem having a first end attached to the valve body an opposed second end;

a retainer surrounding and engaging at least a portion of the stem; and a spring surrounding the stem and engaging the retainer;

in which the spring is situated between the retainer and the second end of the plunger.

3. The fluid end of claim 1, in which the first section comprises:

a first body containing the first threaded openings of the plurality of plunger bores;

a second body containing the second threaded openings of the plurality of plunger bores;

a plurality of connectors interconnecting the first and second bodies; and a plurality of seals.

4. The fluid end of claim 3, in which the first body comprises a plurality of counterbores formed therein, the counterbores configured to receive the plurality of seals.

5. The fluid end of claim 4, in which a selected one of the plurality of second sections engages a selected one of the plurality of seals.

6. A method of assembling the fluid end of claim 4, the method comprising:

inserting the plurality of seals into the plurality of counterbores formed in the first body in a one-to-one relationship;

securing the plurality of second sections into the second threaded openings formed in the second body;

abutting the second body against the first body such that the first threaded openings are coaxial with the second threaded openings; and securing the first and second bodies together via the plurality of connectors.

7. A fluid end, comprising:

a housing comprising a plurality of bores formed therein; and a plunger configured to reciprocate within a selected one of the plurality of bores, the plunger comprising:

a first end having a blind bore formed therein;

a second end opposed to the first end;

an exterior surface interconnecting the first and second ends, the exterior surface having a suction fitting bore formed therein;

a valve seat installed within the first end of the plunger;

a sleeve installed within the blind bore; and a valve assembly installed at least partially within the blind bore, the valve assembly comprising:

a valve body configured to engage the valve seat;

a stem joined to the valve body;

a retainer surrounding at least a portion of the stem; and a spring configured to bias the valve body against the valve seat;

in which the sleeve is configured to receive a portion of the retainer;

in which the retainer is situated intermediate the valve body and the spring.

8. The fluid end of claim 7, in which the sleeve is situated intermediate the valve seat and the second end of the plunger.

9. The fluid end of claim 7, in which the sleeve comprises:

a tubular body having a longitudinal axis;

a passage extending along the longitudinal axis, the passage having a circular cross-section defining a cylindrical inner surface;

an exterior surface having a non-uniform diameter along the longitudinal axis;

a front surface formed at a terminal end of the exterior surface; and a plurality of openings formed in the exterior surface, each opening comprising:

a central void;

a slot extending through the exterior surface from the central void to the front surface in a direction parallel to the longitudinal axis of the tubular body; and a notch extending from the central void to the front surface in a direction parallel to the longitudinal axis of the tubular body, the notch terminating before reaching the front surface.

10. A method of assembling the fluid end of claim 9, the method comprising:

installing the sleeve within the blind bore of the plunger;

inserting the valve assembly at least partially into the blind bore such that the retainer enters the slot of one of the plurality of openings;

pushing the valve assembly such that the retainer enters the central void of the opening; and rotating the valve assembly such that at least a portion of the retainer is situated in the notch formed in the opening.

11. The fluid end of claim 7, in which the valve seat is formed of a harder material than a material used to form the plunger.

12. The fluid end of claim 7, in which the housing comprises:

a first section having a plurality of threaded openings formed therein; and a plurality of second sections, each second section threaded into a selected one of the plurality of threaded openings.

13. The fluid end of claim 7, further comprising:

a packing stack configured to engage at least a portion of the plunger's exterior surface; and a retainer attached to the housing, the retainer surrounding at least a portion of the packing stack.

14. The fluid end of claim 13, further comprising a retainer lock, in which the retainer lock is situated intermediate at least a portion of the retainer and at least a portion of the housing.

15. A method of assembling the fluid end of claim 14, the method comprising:

advancing the retainer over the housing;

rotating the retainer such that an annular space appears between the retainer and the housing;

inserting the retainer lock into the annular space;

inserting the packing stack into the housing and retainer; and inserting the plunger into the housing and retainer such that the packing stack engages the exterior surface of the plunger.

16. The fluid end of claim 13, further comprising a threaded packing nut configured to thread into the retainer such that the packing stack is compressed to a desired state.

17. The fluid end of claim 13, in which the retainer is secured to the housing using a plurality of threaded fasteners.

18. The fluid end of claim 13, further comprising a wear sleeve situated within the housing and surrounding at least a portion of the packing stack.

19. The fluid end of claim 18, in which the wear sleeve is formed from a harder material than a material used to form the housing.

20. The fluid end of claim 13, further comprising a packing sleeve surrounding at least a portion of the packing stack such that no portion of the packing stack engages the housing, in which the retainer is configured to surround at least a portion of the packing sleeve.

* * * * *